US005629099A

United States Patent [19]

Sakurai et al.

[11] Patent Number: 5,629,099

[45] Date of Patent: May 13, 1997

[54] ALLOYING-TREATED IRON-ZINC ALLOY DIP-PLATED STEEL SHEET EXCELLENT IN PRESS-FORMABILITY AND METHOD FOR MANUFACTURING SAME

[75] Inventors: Michitaka Sakurai; Kenji Tahara; Junichi Inagaki; Toyofumi Watanabe, all of Tokyo, Japan

[73] Assignee: NKK Corporation, Tokyo, Japan

[21] Appl. No.: 356,341

[22] PCT Filed: Jun. 29, 1994

[86] PCT No.: PCT/JP94/01052

§ 371 Date: Dec. 19, 1994

§ 102(e) Date: Dec. 19, 1994

[87] PCT Pub. No.: WO95/01462

PCT Pub. Date: Jan. 12, 1995

[30] Foreign Application Priority Data

| | | | |
|---|---|---|---|
| Jun. 30, 1993 | [JP] | Japan | 5-186705 |
| Jun. 30, 1993 | [JP] | Japan | 5-186706 |
| Dec. 20, 1993 | [JP] | Japan | 5-344828 |
| Dec. 24, 1993 | [JP] | Japan | 5-347747 |

[51] Int. Cl.[6] ..... B32B 15/18; C23C 2/06; C23C 2/28

[52] U.S. Cl. ..... 428/659; 428/687; 428/939; 148/242; 148/533; 148/534

[58] Field of Search ..... 428/659, 601, 428/687, 939; 148/242, 533, 534, 537

[56] References Cited

U.S. PATENT DOCUMENTS

| | | | |
|---|---|---|---|
| 3,190,768 | 6/1965 | Wright . | |
| 4,059,711 | 11/1977 | Mino et al. | 428/659 |
| 5,049,453 | 9/1991 | Suemitsu et al. | 428/659 |
| 5,316,652 | 5/1994 | Sagiyama et al. | 427/433 |
| 5,409,533 | 4/1995 | Sagiyama et al. | 148/533 |

FOREIGN PATENT DOCUMENTS

| | | |
|---|---|---|
| 0540005 | 5/1993 | European Pat. Off. . |
| 1268287 | 12/1961 | France . |
| 1-319661 | 12/1989 | Japan . |
| 2-57670 | 2/1990 | Japan . |
| 2-185959 | 7/1990 | Japan . |

(List continued on next page.)

OTHER PUBLICATIONS

M. Urai et al., "Effect of Aluminum on Powdering Characteristics of Galvannealed Steel Sheet", Galvatech, 1989, pp. 478–485.

Y. Hisamatsu, "Science and Technology of Zinc and Zinc Alloy Coated Steel Sheet", Galvatech, 1989, pp. 3–12.

Patent Abstracts of Japan, vol. 12, No. 242 (C510), 8 Jul. 1988 of JP–A–63 033591 (Kawasaki Steel), 13 Feb. 1988.

Patent Abstracts of Japan, vol. 9, No. 228 (C–303), 13 Sep. 1985 of JP–A–60 086257 (Kawasaki Steel), 15 May 1985.

*Primary Examiner*—John Zimmerman

*Attorney, Agent, or Firm*—Frishauf, Holtz, Goodman, Langer & Chick, P.C.

[57] ABSTRACT

An alloying-treated iron-zinc alloy dip-plated steel sheet excellent in press-formability, having, on the surface thereof, numerous fine concavities which satisfy the following conditions: (1) that the number of fine concavities having a depth of at least 2 μm is within a range of from 200 to 8,200 per $mm^2$ of the plating layer, and (2) that the total opening area per unit area of the fine concavities in the plating layer is within a range of from 10 to 70% of the unit area. The above-mentioned plated steel sheet is manufactured by subjecting a cold-rolled steel sheet to a zinc dip-plating treatment in a zinc dip-plating bath having an aluminum content of from 0.05 to 0.30 wt. %, in which the temperature region causing an initial reaction for forming an iron-aluminum layer is limited within a range of from 500° to 600° C., an alloying treatment in which an alloying treatment temperature is limited within a range of from 480° to 600° C., and a temper-rolling treatment. It is possible to further impart an excellent image clarity after painting to the above-mentioned plated steel sheet by replacing the above-mentioned condition (2) with a condition that a bearing length ratio tp (2 μm) in a profile curve is within a range of from 30 to 90%.

11 Claims, 13 Drawing Sheets

FOREIGN PATENT DOCUMENTS

| | | | |
|---|---|---|---|
| 2-190483 | 7/1990 | Japan . | |
| 2-175007 | 7/1990 | Japan . | |
| 2-225652 | 9/1990 | Japan . | |
| 2-274859 | 11/1990 | Japan . | |
| 2-274860 | 11/1990 | Japan . | |
| 2-274854 | 11/1990 | Japan | 428/659 |
| 3-211264 | 9/1991 | Japan . | |
| 3-243755 | 10/1991 | Japan . | |
| 3-271356 | 12/1991 | Japan . | |
| 3-285056 | 12/1991 | Japan | 148/533 |
| 4-358 | 1/1992 | Japan . | |
| 4-285149 | 10/1992 | Japan . | |
| WO92/12271 | 7/1992 | WIPO . | |

ALLOYING-TREATED IRON-ZINC ALLOY DIP-PLATED STEEL SHEET EXCELLENT IN PRESS-FORMABILITY AND METHOD FOR MANUFACTURING SAME

FIELD OF THE INVENTION

The present invention relates to an alloying-treated iron-zinc alloy dip-plated steel sheet excellent in press-formability and a method for manufacturing same.

BACKGROUND OF THE INVENTION

Alloying-treated iron-zinc alloy dip-plated steel sheets and zinciferous electroplated steel sheets have conventionally been used as outer shells for an automobile body, a home electric appliance and furniture. Recently, however, the alloying-treated iron-zinc dip-plated steel sheet is attracting greater general attention than the zinciferous electroplated steel sheet for the following reasons:

(1) The zinciferous electroplated steel sheet having a relatively small plating weight, manufactured usually by subjecting a cold-rolled steel sheet having an adjusted surface roughness to a zinc electroplating treatment, is preferably employed as a steel sheet required to be excellent in finish appearance after painting and in corrosion resistance such as a steel sheet for an automobile body;

(2) However, the steel sheet for an automobile body is required to exhibit a further excellent corrosion resistance;

(3) In order to impart a further excellent corrosion resistance to the above-mentioned zinciferous electroplated steel sheet, it is necessary to increase a plating weight thereof, and the plating weight thus increased leads to a higher manufacturing cost of the zinciferous electroplated steel sheet; and (4) On the other hand, the alloying-treated iron-zinc alloy dip-plated steel sheet is excellent in electro-paintability, weldability and corrosion resistance, and furthermore, it is relatively easy to increase a plating weight thereof.

However, in the above-mentioned conventional alloying-treated iron-zinc alloy dip-plated steel sheet, the difference in an iron content between the surface portion and the inner portion of the alloying-treated iron-zinc alloy dip-plating layer becomes larger according as the plating weight increases, because the alloying treatment is accomplished through the thermal diffusion. More specifically, a Γ-phase having a high iron content tends to be easily produced on the interface between the alloying-treated iron-zinc alloy dip-plating layer and the steel sheet, and a ζ-phase having a low iron content is easily produced, on the other hand, in the surface portion of the alloying-treated iron-zinc alloy dip-plating layer. The Γ-phase is more brittle as compared with the ζ-phase. In the alloying-treated iron-zinc alloy dip-plating layer which has a structure comprising the Γ-phase and a structure comprising the ζ-phase, a high amount of the Γ-phase results in breakage of the brittle Γ-phase during the press-forming, which leads to a powdery peeloff of the plating layer and to a powdering phenomenon. When the ζ-phase is present in the surface portion of the alloying-treated iron-zinc alloy dip-plating layer, on the other hand, the ζ-phase structure adheres to a die during the press-forming because the ζ-phase has a relatively low melting point, leading to a higher sliding resistance, and this poses a problem of the occurrence of die galling or press cracking.

In the above-mentioned conventional alloying-treated iron-zinc alloy dip-plated steel sheet, particularly in an alloying-treated iron-zinc alloy dip-plated steel sheet having a large plating weight, furthermore, an effect of improving image clarity after painting of the alloying-treated iron-zinc alloy dip-plated steel sheet cannot be expected from adjustment of surface roughness of the steel sheet before a zinc dip-plating treatment.

Various methods have therefore been proposed to improve press-formability and/or image clarity after painting of an alloying-treated iron-zinc alloy dip-plated steel sheet.

Japanese Patent Provisional Publication No. 4-358 discloses a method for improving press-formability of an alloying-treated iron-zinc alloy dip-plated steel sheet by applying any of various high-viscosity rust-preventive oils and solid lubricants onto a surface of the alloying-treated iron-zinc alloy dip-plated steel sheet (hereinafter referred to as the "prior art 1").

Japanese Patent Provisional Publication No. 1-319,661 discloses a method for improving press-formability of an alloying-treated iron-zinc alloy dip-plated steel sheet by forming a plating layer having a relatively high hardness, such as an iron-group metal alloy plating layer on a plating layer of the alloying-treated iron-zinc alloy dip-plated steel sheet; Japanese Patent Provisional Publication No. 3-243,755 discloses a method for improving press-formability of an alloying-treated iron-zinc alloy dip-plated steel sheet by forming an organic resin film on a plating layer of the alloying-treated iron-zinc alloy dip-plated steel sheet; and Japanese Patent Provisional Publication No. 2-190,483 discloses a method for improving press-formability of an alloying-treated iron-zinc alloy dip-plated steel sheet by forming an oxide film on a plating layer of the alloying-treated iron-zinc alloy dip-plated steel sheet (methods for improving press-formability of an alloying-treated iron-zinc alloy dip-plated steel sheet by forming another layer or another film on the plating layer of the alloying-treated iron-zinc alloy dip-plated steel sheet as described above, being hereinafter referred to as the "prior art 2").

Japanese Patent Provisional Publication No. 2-274,859 discloses a method for improving press-formability and image clarity after painting of an alloying-treated iron-zinc alloy dip-plated steel sheet by subjecting the alloying-treated zinc dip-plated steel sheet to a temper-rolling treatment with the use of rolls of which surfaces have been applied with a dull-finishing treatment by means of a laser beam, i.e., with the use of laser-textured dull rolls, to adjust a surface roughness thereof (hereinafter referred to as the "prior art 3").

Japanese Patent Provisional Publication No. 2-57,670 discloses a method for improving press-formability of an alloying-treated zinc dip-plated steel sheet by imparting, during an annealing step in a continuous zinc dip-plating line, a surface roughness comprising a center-line mean roughness (Ra) of up to 1.0 μm to a steel sheet through inhibition of an amount of an oxide film formed on the surface of the steel sheet, and imparting a surface roughness having a peak counting (PPI) of at least 250 (a cutoff value of 1.25 μm) to an alloying-treated zinc dip-plating layer (hereinafter referred to as the "prior art 4").

Japanese Patent Provisional Publication No. 2-175,007, Japanese Patent Provisional Publication No. 2-185,959, Japanese Patent Provisional Publication No. 2-225,652 and Japanese Patent Provisional Publication No. 4-285,149 disclose a method for improving image clarity after painting of an alloying-treated iron-zinc alloy dip-plated steel sheet by using, as a substrate sheet for plating, a cold-rolled steel sheet of which a surface roughness as represented by a center-line mean roughness (Ra), a filtered center-line waviness (Wca) and a peak counting (PPI), is adjusted through the cold-rolling with the use of specific rolls, and subjecting a zinc dip-plating layer formed on the surface of said cold-rolled steel sheet to an alloying treatment, or subjecting the thus obtained alloying-treated iron-zinc alloy dip-plated steel sheet to a temper-rolling treatment with the use of specific rolls (hereinafter referred to as the "prior art 5").

Japanese Patent Provisional Publication No. 2-274,860 discloses a method for improving press-formability of an alloying-treated iron-zinc alloy dip-plated steel sheet by forming numerous fine concavities on a surface of a cold-rolled steel sheet as a substrate sheet for plating with the use of the laser-textured dull rolls to impart a prescribed surface roughness on said surface (hereinafter referred to as the "prior art 6").

Japanese Patent Provisional Publication No. 2-225,652 discloses a method for improving press-formability of an alloying-treated iron-zinc alloy dip-plated steel sheet by forming numerous fine concavities having a depth within a range of from 10 to 500 μm on a surface of a cold-rolled steel sheet, particularly, by forming numerous fine concavities having a wavelength region within a range of from 10 to 100 μm and a depth of about 10 μm on a surface of a plating layer during the alloying treatment of the plating layer (hereinafter referred to as the "prior art 7").

However, the prior art 1 has the following problems: It is not easy to remove a high-viscosity rust-preventive oil or a solid lubricant applied over the surface of the alloying-treated iron-zinc alloy dip-plated steel sheet, so that it is inevitable to use an organic solvent as a degreasing agent for facilitating removal of such a rust-preventive oil or a solid lubricant, thus resulting in a deteriorated environment of the press-forming work site.

The prior art 2 not only requires a high cost, but also leads to deterioration of operability and productivity.

The prior art 3 has the following problems:

(a) Because each of the numerous fine concavities formed on the alloying-treated iron-zinc alloy dip-plating layer on the surface of the steel sheet has such a large area as from 500 to 10,000 $\mu m^2$, it is difficult to keep a press oil received in these concavities, and the press oil tends to easily flow out from the concavities. Consequently, the press oil flows out from the concavities during the transfer of the steel sheet in the press-forming step, thus decreasing press-formability.

(b) Because, from among the above-mentioned numerous fine concavities, a length of a flat portion between two adjacent concavities is relatively large as from 50 to 300 μm, improvement of press-formability by keeping the press oil in the concavities is limited to a certain extent. More specifically, even when the press oil is kept in these concavities, lack of the press oil occurs while a die passes on the above-mentioned flat portion during the press-forming because of the long flat portion between two adjacent concavities, so that the sudden increase in coefficient of friction causes a microscopic seizure, resulting in die galling and press cracking.

(c) When the length of the flat portion between two adjacent concavities from among the numerous fine concavities is so large as described above, a so-called surface waviness component, which deteriorates image clarity after painting, remains on the surface of the plating layer of the alloying-treated zinc dip-plated steel sheet, thus resulting in a decreased image clarity after painting.

(d) When, after the manufacture of an alloying-treated iron-zinc alloy dip-plated steel sheet, forming numerous fine concavities having the above-mentioned shape and size on the surface of the alloying-treated iron-zinc alloy dip-plating layer by applying a temper-rolling treatment to the alloying-treated iron-zinc alloy dip-plated steel sheet with the use of the laser-textured dull rolls, the alloying-treated iron-zinc alloy dip-plating layer is subjected to a serious deformation during the temper-rolling treatment, and this causes easy peeloff of the plating layer.

(e) Application of the dull-finishing treatment to the roll surface by means of a laser beam requires a large amount of cost, and furthermore, it is necessary to frequently replace the laser-textured dull rolls because of serious wear of the numerous fine concavities formed on the surface thereof.

The prior art 4 has the following problems:

(a) When using, as a substrate sheet for plating, a steel sheet having a surface roughness as represented by a center-line mean roughness (Ra) of up to 1.0 μm, dross tends to easily adhere onto the surface of the steel sheet because of a large area of the close contact portion of the steel sheet with a roll in the zinc-dip-plating bath. It is therefore impossible to prevent defects in the plated steel sheet caused by adhesion of dross to the surface of the steel sheet. When using a steel sheet applied with a temper rolling with the use of dull rolls, on the other hand, dross hardly adheres onto the surface of the steel sheet because of a small area of the close contact portion of the steel sheet with a roll in the zinc dip-plating bath, but is blown back to the zinc dip-plating bath during the gas wiping. As a result, the plated steel sheet is free from defects caused by dross.

(b) The prior art 4 imparts a high peak counting (PPI) to an alloying-treated iron-zinc alloy dip-plating layer through an alloying reaction of the plating layer itself during the alloying treatment of the zinc dip-plating layer. With a high peak counting (PPI) alone, however, not only self-lubricity is insufficient, but also the amount of the press oil kept on the surface of the plating layer is small. As a result, lack of the press oil occurs while the die passes on the surface of the alloying-treated iron-zinc alloy dip-plating layer during the press-forming, and the sudden increase in coefficient of friction causes a microscopic seizure, resulting in die galling and press cracking.

(c) In the alloying-treated iron-zinc alloy dip-plated steel sheet of the prior art 4, while the number of fine concavities per $mm^2$ of the alloying-treated iron-zinc alloy dip-plating layer is satisfactory, no consideration is made on a bearing length ratio tp (2 μm). It is therefore impossible to impart an excellent image clarity after painting to the alloying-treated iron-zinc alloy dip-plated steel sheet.

The prior arts 5 to 7 have the following problems:

(a) Image clarity after painting is not necessarily improved by using, as a substrate sheet for plating, a cold-rolled steel sheet having an adjusted surface roughness as represented by a center-line mean roughness (Ra), a filtered center-line waviness (Wca) and a peak counting (PPI), or a steel sheet subjected to a cold-rolling treatment with the use of specific rolls, as in the prior art 5.

(b) When carrying out a cold-rolling treatment with the use of the bright rolls or the laser-textured dull rolls, serious wear of the rolls during the cold-rolling leads to a shorter service life of the rolls. In order to achieve a satisfactory image clarity after painting and a good press-formability, therefore, it is necessary to frequently replace the rolls, thus resulting in a serious decrease in productivity.

(c) Image clarity after painting is not always improved even by applying a temper-rolling treatment with the use of specific rolls as disclosed in the prior art 5 after applying a zinc dip-plating treatment followed by an alloying treatment to a steel sheet.

(d) When carrying out a temper-rolling treatment with the use of the bright rolls or the laser-textured dull rolls, the rolls suffer from serious wear during the temper-rolling, leading to a shorter service life of the rolls. In order to achieve a satisfactory image clarity after painting and a good press-formability, therefore, it is necessary to frequently replace the rolls, thus resulting in a serious decrease in productivity.

(e) When manufacturing an alloying-treated iron-zinc alloy dip-plated steel sheet in accordance with the method disclosed in the prior art 5, press-formability thereof is deteriorated.

(f) In the method comprising forming numerous fine concavities on the surface of a cold-rolled steel sheet as in the prior art 7, the numerous fine concavities cannot be formed under some alloying treatment conditions, and even when numerous fine concavities are formed, the press oil received in the concavities cannot be kept satisfactorily. Consequently, the press oil easily flows out from the concavities during the transfer of the alloying-treated iron-zinc alloy dip-plated steel sheet. The lubricity effect is therefore insufficient, easily causing die galling or press cracking.

(g) When numerous fine concavities are formed on the surface of an alloying-treated iron-zinc alloy dip-plated steel sheet by subjecting a cold-rolled steel sheet to a zinc dip-plating treatment followed by an alloying treatment, and then applying a temper-rolling treatment with the use of the laser-textured dull rolls, as in the prior art 6, the alloying-treated iron-zinc alloy dip-plating layer tends to be seriously damaged during the temper rolling, leading to easy peeloff and a deteriorated powdering resistance.

(h) Each of the numerous fine concavities formed on the surface of a cold-rolled steel sheet with the use of the laser-textured dull rolls is relatively large in size. The press oil received in the concavities cannot therefore be kept satisfactorily, but flows out from the concavities during the transfer of the alloying-treated iron-zinc dip-plated steel sheet in the press-forming step, and this leads to an insufficient lubricity effect and to easy occurrence of die galling and press cracking.

(i) From among numerous fine concavities formed on the surface of a cold-rolled steel sheet with the use of the laser-textured dull rolls, a length of a flat portion between two adjacent concavities is relatively large. The effect of improving press-formability by keeping the press oil in the concavities is therefore limited to a certain extent. Even when the press oil is kept in these concavities, lack of the press oil occurs while a die passes on the above-mentioned flat portion during the press-forming because of the long flat portion between two adjacent concavities, resulting in an insufficient lubricity. Die galling and press cracking may easily be caused.

Under such circumstances, there is a strong demand for development of (1) an alloying-treated iron-zinc alloy dip-plated steel sheet excellent in press-formability, which enables to solve the problems involved in the prior arts 1 to 4, (2) an alloying-treated iron-zinc alloy dip-plated steel sheet excellent in press-formability and image clarity after painting, which enables to solve the problems involved in the prior arts 3 and 4, and (3) a method for manufacturing an alloying-treated iron-zinc alloy dip-plated steel sheet excellent in press-formability, which enables to solve the problems involved in the prior arts 5 to 7, but such an alloying-treated iron-zinc alloy dip-plated steel sheet and a method for manufacturing thereof have not as yet been proposed.

Therefore, a first object of the present invention is to provide an alloying-treated iron-zinc alloy dip-plated steel sheet excellent in press-formability, which enables to solve the above-mentioned problems involved in the prior arts 1 to 4.

A second object of the present invention is to provide an alloying-treated iron-zinc alloy dip-plated steel sheet excellent in press-formability and image clarity after painting, which enables to solve the above-mentioned problems involved in the prior arts 3 and 4.

A third object of the present invention is to provide a method for manufacturing an alloying-treated iron-zinc alloy dip-plated steel sheet excellent in press-formability, which enables to solve the above-mentioned problems involved in the prior arts 5 to 7.

DISCLOSURE OF THE INVENTION

In accordance with the first object of the present invention, there is provided an alloying-treated iron-zinc alloy dip-plated steel sheet excellent in press-formability, which comprises:

a steel sheet; and an alloying-treated iron-zinc alloy dip-plating layer formed on at least one surface of said steel sheet, said alloying-treated iron-zinc alloy dip-plating layer having numerous fine concavities on the surface thereof;

characterized in that:

the number of fine concavities having a depth of at least 2 μm from among said numerous fine concavities is within a range of from 200 to 8,200 per $mm^2$ of said alloying-treated iron-zinc alloy dip-plating layer; and the total opening area per unit area of said fine concavities having a depth of at least 2 μm in said alloying-treated iron-zinc alloy dip-plating layer, is within a range of from 10 to 70% of said unit area (hereinafter referred to as the "first invention").

In accordance with the second object of the present invention, there is provided an alloying-treated iron-zinc alloy dip-plated steel sheet excellent in press-formability and image clarity after painting, which comprises:

a steel sheet; and an alloying-treated iron-zinc alloy dip-plating layer formed on at least one surface of said steel sheet, said alloying-treated iron-zinc alloy dip-plating layer having numerous fine concavities on the surface thereof:

characterized in that:

the number of fine concavities having a depth of at least 2 μm from among said numerous fine concavities is within a range of from 200 to 8,200 per $mm^2$ of said alloying-treated iron-zinc alloy dip-plating layer; and said fine concavities having a depth of at least 2 μm further satisfy the following condition:

a bearing length ratio tp (2 μm) is within a range of from 30 to 90%, said bearing length ratio tp (2 μm) being expressed, when cutting a profile curve over a prescribed length thereof by means of a straight line parallel to a mean line and located below the highest peak in said profile curve by 2 μm, by a ratio in percentage of a total length of cut portions thus determined of said alloying-treated iron-zinc alloy dip-plating layer having a surface profile which corresponds to said profile curve, relative to said prescribed length of said profile curve (hereinafter referred to as the "second invention").

In accordance with the third object of the present invention, there is provided a method for manufacturing an alloying-treated iron-zinc alloy dip-plated steel sheet excellent in press-formability, which comprises the steps of:

subjecting a hot-rolled steel sheet to a cold-rolling treatment to prepare a cold-rolled steel sheet;

passing said cold-rolled steel sheet through a zinc dip-plating bath having a chemical composition comprising zinc, aluminum and incidental impurities to apply a zinc dip-plating treatment to said cold-rolled steel sheet, thereby forming a zinc dip-plating layer on at least one surface of said cold-rolled steel sheet;

subjecting said cold-rolled steel sheet having said zinc dip-plating layer thus formed on the surface thereof to an alloying treatment at a prescribed temperature, thereby forming an alloying-treated iron-zinc alloy dip-plating layer on said at least one surface of said cold-rolled steel sheet, said alloying-treated iron-zinc alloy dip-plating layer having numerous fine concavities; and then subjecting said cold-rolled steel sheet having said alloying-treated iron-zinc alloy dip-plating layer having said numerous fine concavities thus formed on the surface thereof to a temper-rolling, thereby manufacturing an alloying-treated iron-zinc alloy dip-plated steel sheet excellent in press-formability;

characterized by:

limiting the content of said aluminum in said zinc dip-plating bath within a range of from 0.05 to 0.30 wt. %;

limiting the temperature region causing an initial reaction for forming an iron-aluminum alloy layer in said zinc dip-plating treatment within a range of from 500° to 600° C.; and limiting said prescribed temperature in said alloying treatment within a range of from 480° to 600° C. (hereinafter referred to as the "third invention").

In accordance with the third object of the present invention, there is provided a method for manufacturing an alloying-treated iron-zinc alloy dip-plated steel sheet excellent in press-formability, which comprises the steps of:

subjecting a hot-rolled steel sheet to a cold-rolling treatment to prepare a cold-rolled steel sheet;

passing said cold-rolled steel sheet through a zinc dip-plating bath having a chemical composition comprising zinc, aluminum and incidental impurities to apply a zinc dip-plating treatment to said cold-rolled steel sheet, thereby forming a zinc dip-plating layer on at least one surface of said cold-rolled steel sheet;

subjecting said cold-rolled steel sheet having said zinc dip-plating layer thus formed on the surface thereof to an alloying treatment at a prescribed temperature, thereby forming an alloying-treated iron-zinc alloy dip-plating layer on said at least one surface of said cold-rolled steel sheet, said alloying-treated iron-zinc alloy dip-plating layer having numerous fine concavities; and then subjecting said cold-rolled steel sheet having said alloying-treated iron-zinc alloy dip-plating layer having said numerous fine concavities thus formed on the surface thereof to a temper rolling, thereby manufacturing an alloying-treated iron-zinc alloy dip-plated steel sheet excellent in press-formability;

characterized by:

using, as said cold-rolled steel sheet, a cold-rolled steel sheet into which at least one element selected from the group consisting of carbon, nitrogen and boron is dissolved in the form of solid-solution in an amount within a range of from 1 to 20 ppm;

limiting the content of said aluminum in said zinc dip-plating bath within a range of from 0.05 to 0.30 wt. %; and limiting said prescribed temperature in said alloying treatment within a range of from 480° to 600° C. (hereinafter referred to as the "fourth invention").

In accordance with the third object of the present invention, there is provided a method for manufacturing an alloying-treated iron-zinc alloy dip-plated steel sheet excellent in press-formability, which comprises the steps of:

subjecting a hot-rolled steel sheet to a cold-rolling treatment to prepare a cold-rolled steel sheet;

passing said cold-rolled steel sheet through a zinc dip-plating bath having a chemical composition comprising zinc, aluminum and incidental impurities to apply a zinc dip-plating treatment to said cold-rolled steel sheet, thereby forming a zinc dip-plating layer on at least one surface of said cold-rolled steel sheet;

subjecting said cold-rolled steel sheet having said zinc dip-plating layer thus formed on the surface thereof to an alloying treatment at a prescribed temperature, thereby forming an alloying-treated iron-zinc alloy dip-plating layer on at least one surface of said cold-rolled steel sheet, said alloying-treated iron-zinc alloy dip-plating layer having numerous fine concavities; and then subjecting said cold-rolled steel sheet having said alloying-treated iron-zinc alloy dip-plating layer having said numerous fine concavities thus formed on the surface thereof to a temper rolling, thereby manufacturing an alloying-treated iron-zinc alloy dip-plated steel sheet excellent in press-formability;

characterized by:

limiting the content of said aluminum in said zinc dip-plating bath within a range of from 0.10 to 0.25 wt. %; and carrying out said alloying treatment at a temperature T(°C.) satisfying the following formula:

$$440+400\times[\text{Al wt. \%}]\leqq T\leqq 500+400\times\{\text{Al wt. \%}]$$

where, [Al wt. %] is the aluminum content in said zinc dip-plating bath (hereinafter referred to as the "fifth invention").

According to the methods of the above-mentioned third to fifth inventions, it is possible to manufacture the alloying-treated iron-zinc alloy dip-plated steel sheet of the first invention excellent in press-formability.

In the methods of the third to fifth inventions, it is preferable to carry out the above-mentioned cold-rolling treatment using, at least at a final roll stand in a cold-rolling mill, rolls of which a surface profile is adjusted so that a center-line mean roughness (Ra) is within a range of from 0.1 to 0.8 μm, and an integral value of amplitude spectra in a wavelength region of from 100 to 2,000 μm, which amplitude spectra are obtained through the Fourier transformation of a profile curve of the cold-rolled steel sheet after the cold-rolling treatment, is up to 200 $\mu m^3$. According to the methods of the third to fifth inventions having the features described above, it is possible to manufacture the alloying-treated iron-zinc alloy dip-plated steel sheet of the second invention excellent in press-formability and image clarity after painting.

In the methods of the third to fifth inventions, it is more preferable to carry out the above-mentioned cold-rolling treatment using, at least at a final roll stand in a cold-rolling mill, rolls of which a surface profile is adjusted so that a center-line mean roughness (Ra) is within a range of from 0.1 to 0.8 μm, and an integral value of amplitude spectra in a wavelength region of from 100 to 2,000 μm, which amplitude spectra are obtained through the Fourier transformation of a profile curve of the cold-rolled steel sheet after the cold-rolling treatment, is up to 500 $\mu m^3$, and to carry out the above-mentioned temper-rolling treatment at an elongation rate within a range of from 0.3 to 5.0%, using rolls of which a surface profile is adjusted so that a center-line mean roughness (Ra) is up to 0.5 μm, and an integral value of amplitude spectra in a wavelength region of from 100 to 2,000 μm, which amplitude spectra are obtained through the Fourier transformation of a profile curve of the alloying-treated iron-zinc alloy dip-plated steel sheet after the temper-rolling treatment, is up to 200 $\mu m^3$. According to the methods of the third to fifth inventions having the features described above, it is possible to manufacture the alloying-treated iron-zinc alloy dip-plated steel sheet of the second invention excellent in press-formability and further excellent in image clarity after painting.

DETAILED DESCRIPTION OF THE PREFERRED EMBODIMENTS

Figure 1:
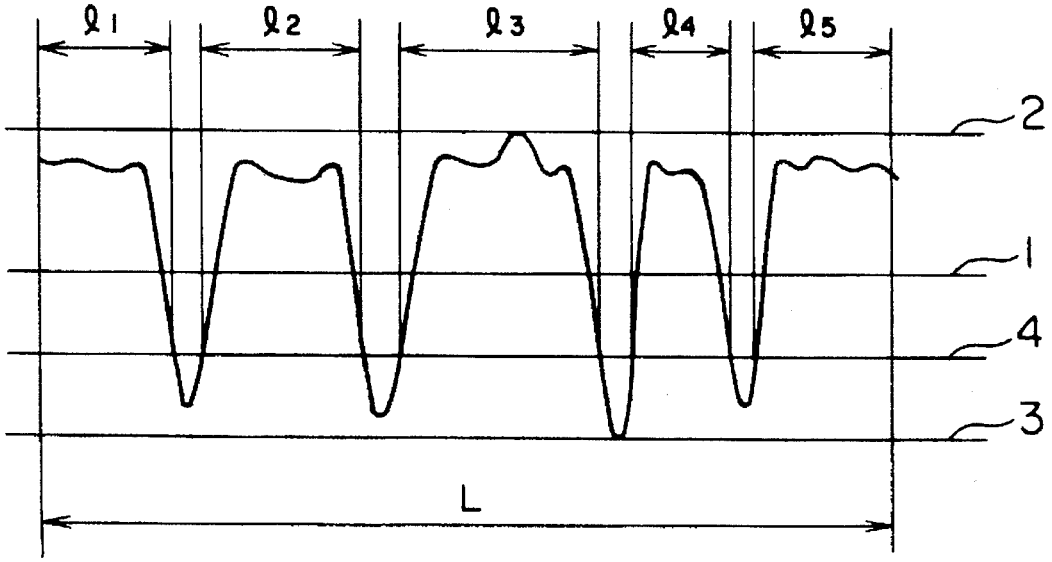
FIG. 1 is a schematic descriptive view illustrating a profile of a roughness curve having a cutoff value is 0.8 mm, which corresponds to an alloying-treated iron-zinc alloy dip-plated steel sheet of a second embodiment of the first invention.

From the above-mentioned point of view, extensive studies were carried out to develop (1) an alloying-treated iron-zinc alloy dip-plated steel sheet excellent in press-formability, which enables to solve the problems involved in the prior arts 1 to 4, (2) an alloying-treated iron-zinc alloy dip-plated steel sheet excellent in press-formability and image clarity after painting, which enables to solve the problems involved in the prior arts 3 and 4, and (3) a method for manufacturing an alloying-treated iron-zinc alloy dip-plated steel sheet excellent in press-formability, which enables to solve the problems involved in the prior arts 5 to 7.

As a result, the following findings were obtained regarding an alloying-treated iron-zinc alloy dip-plated steel sheet excellent in press-formability, which comprises: a steel sheet; and an alloying-treated iron-zinc alloy dip-plating layer formed on at least one surface of the steel sheet, the alloying-treated iron-zinc alloy dip-plating layer having numerous fine concavities on the surface thereof:

(a) it is possible to provide an alloying-treated iron-zinc alloy dip-plated steel sheet excellent in press-formability, which enables to solve the problems involved in the prior arts 1 to 4, by limiting the number of fine concavities having a depth of at least 2 μm from among the numerous fine concavities within a range of from 200 to 8,200 per $mm^2$ of the alloying-treated iron-zinc alloy dip-plating layer, and limiting the total opening area per unit area of the fine concavities having a depth of at least 2 μm in the alloying-treated iron-zinc alloy dip-plating layer within a range of from 10 to 70% of the unit area;

(b) it is possible to provide an alloying-treated iron-zinc alloy dip-plated steel sheet excellent in press-formability and image clarity after painting, which enables to solve the problems involved in the prior arts 3 and 4, by limiting the number of fine concavities having a depth of at least 2 μm from among the numerous fine concavities within a range of from 200 to 8,200 per $mm^2$ of the alloying-treated iron-zinc alloy dip-plating layer, and by further causing the fine concavities having a depth of at least 2 μm to satisfy the condition that a bearing length ratio tp (2 μm) is within a range of from 30 to 90%, the bearing length ratio tp (2 μm) being expressed, when cutting a profile curve over a prescribed length thereof by means of a straight line parallel to a mean line and located below the highest peak in the profile curve by 2 μm, by a ratio in percentage of a total length of cut portions thus determined of the alloying-treated iron-zinc alloy dip-plating layer having a surface profile which corresponds to the profile curve, relative to the prescribed length of the profile curve.

Furthermore, the following findings were obtained regarding a method for manufacturing an alloying-treated iron-zinc alloy dip-plated steel sheet excellent in press-formability, which comprises the steps of: subjecting a hot-rolled steel sheet to a cold-rolling treatment to prepare a cold-rolled steel sheet; passing the cold-rolled steel sheet through a zinc dip-plating bath having a chemical composition comprising zinc, aluminum and incidental impurities to apply a zinc dip-plating treatment to the cold-rolled steel sheet, thereby forming a zinc dip-plating layer on at least one surface of the cold-rolled steel sheet; subjecting the cold-rolled steel sheet having the zinc dip-plating layer thus formed on the surface thereof to an alloying treatment at a prescribed temperature, thereby forming an alloying-treated iron-zinc alloy dip-plating layer on the above-mentioned at least one surface of the cold-rolled steel sheet, the alloying-treated iron-zinc alloy dip-plating layer having numerous fine concavities; and then subjecting the cold-rolled steel sheet having the alloying-treated iron-zinc alloy dip-plating layer having the numerous fine concavities thus formed on the surface thereof to a temper rolling, thereby manufacturing an alloying-treated iron-zinc alloy dip-plated steel sheet excellent in press-formability:

(c) it is possible to provide a method for manufacturing an alloying-treated iron-zinc alloy dip-plated steel sheet excellent in press-formability, which enables to solve the problems involved in the prior arts 5 to 7, by limiting the content of aluminum in the zinc dip-plating bath within a range of from 0.05 to 0.30 wt. %; limiting the temperature region causing an initial reaction for forming an iron-aluminum alloy layer in the zinc dip-plating treatment within a range of from 500° to 600° C.; and limiting the prescribed temperature in the alloying treatment within a range of from 480° to 600° C.

(d) it is possible to provide a method for manufacturing an alloying-treated iron-zinc alloy dip-plated steel sheet excellent in press-formability, which enables to solve the problems involved in the prior arts 5 to 7, by using, as the above-mentioned cold-rolled steel sheet, a cold-rolled steel sheet into which at least one element selected from the group consisting of carbon, nitrogen and boron is dissolved in the form of solid-solution in an amount within a range of from 1 to 20 ppm; limiting the content of the above-mentioned aluminum in the zinc dip-plating bath within a range of from 0.05 to 0.30 wt. %; and limiting the above-mentioned prescribed temperature in the alloying treatment within a range of from 480° to 600° C.

(e) it is possible to provide a method for manufacturing an alloying-treated iron-zinc alloy dip-plated steel sheet excellent in press-formability, which enables to solve the problems involved in the prior arts 5 to 7, by limiting the content of the above-mentioned aluminum in the zinc dip-plating bath within a range of from 0.10 to 0.25 wt. %; and carrying out the above-mentioned alloying treatment at a temperature T(°C.) satisfying the following formula:

$$440+400\times[\text{Al wt. \%}]\leqq T\leqq 500+400\times[\text{Al wt. \%}]$$

where, [Al wt. %] is the aluminum content in the zinc dip-plating bath.

The first to fifth inventions were made on the basis of the above-mentioned findings (a) to (e), respectively.

Now, an alloying-treated iron-zinc alloy dip-plated steel sheet excellent in press-formability of a first embodiment of the first invention is described in detail below.

In general, press cracking during the press-forming occurs when flow resistance of a steel sheet into a die exceeds the fracture limit of the steel sheet. Flow resistance of a steel sheet into a die comprises deformation resistance during bending and stretching the steel sheet and frictional resistance of the steel sheet. In order to reduce flow resistance of the steel sheet into the die, therefore, it is effective to reduce frictional resistance of the steel sheet surface. Frictional resistance during the press-forming occurs when the die moves relative to the steel sheet surface in contact with the die, and increases when there occurs adhesion of the steel sheet to the die caused by the direct contact between the die and the steel sheet.

Usually, during the press-forming, increase in frictional force is prevented by forming a press oil film on the contact interface between the die and the steel sheet. When the contact surface pressure between the die and the steel sheet is high, however, the press oil film is broken, leading to the direct contact between the die and the steel sheet, thereby causing the increase in frictional resistance. In order to inhibit the increase in frictional resistance under such circumstances, the steel sheet should have a high keeping ability of the press oil film.

For these reasons, the alloying-treated iron-zinc alloy dip-plated steel sheet of the first embodiment of the first invention comprises a steel sheet, and an alloying-treated iron-zinc alloy dip-plating layer formed on at least one surface of the steel sheet and having numerous fine concavities on the surface thereof. In the alloying-treated iron-zinc alloy dip-plated steel sheet of the first embodiment of the first invention, the press oil is effectively kept in the above-mentioned numerous fine concavities, thereby independently forming numerous microscopic pools for the press oil on the contact interface between the die and the alloying-treated iron-zinc alloy dip-plated steel sheet, by causing these numerous fine concavities to satisfy the following conditions:

(1) the number of fine concavities having a depth of at least 2 μm from among the numerous fine concavities is within a range of from 200 to 8,200 per $mm^2$ of the alloying-treated iron-zinc alloy dip-plating layer; and (2) the total opening area per unit area of the fine concavities having a depth of at least 2 μm in the alloying-treated iron-zinc alloy dip-plating layer, is within a range of from 10 to 70% of the unit area.

The press oil thus received in the numerous microscopic pools bears only part of the contact surface pressure even under a high contact surface pressure between the die and the alloying-treated iron-zinc alloy dip-plated steel sheet, whereby the direct contact between the die and the steel sheet is prevented, making available an excellent press-formability.

The reasons of limiting values in the conditions regarding the above-mentioned numerous fine concavities are described.

With a depth of the numerous fine concavities of under 2 μm, it is impossible to form microscopic pools capable of receiving the press oil in a sufficient amount on the alloying-treated iron-zinc alloy dip-plating layer. The depth of the concavities in a prescribed number from among the numerous fine concavities should be limited to at least 2 μm.

When the number of the concavities having a depth of at least 2 μm from among the numerous fine concavities is under 200 per $mm^2$ of the alloying-treated iron-zinc alloy dip-plating layer, the length of a flat portion between two adjacent concavities from among the numerous fine concavities becomes too large. In such a case, even when the press oil is kept in these concavities, lack of the press oil occurs while a die passes on the above-mentioned flat portion during the press-forming because of the long flat portion between two adjacent concavities, so that the sudden increase in coefficient of friction causes a microscopic seizure. Because of a high surface pressure applied onto a single concavity, furthermore, the press oil film is broken, causing die galling and press cracking. On the other hand, even when the number of fine concavities having a depth of at least 2 μm is over 8,200 per $mm^2$ of the alloying-treated iron-zinc alloy dip-plating layer, no adverse effect is exerted on press-formability and image clarity after painting of the alloying-treated iron-zinc alloy dip-plated steel sheet. However, it is technically difficult and is not practical to form such extremely numerous fine concavities. The number of fine concavities having a depth of at least 2 μm should therefore be limited within a range of from 200 to 8,200, and more preferably, within a range of from 500 to 3,000 per $mm^2$ of the alloying-treated iron-zinc alloy dip-plating layer.

When the total opening area per a unit area of the fine concavities having a depth of at least 2 μm in the alloying-treated iron-zinc alloy dip-plating layer is under 10% of the unit area, there would be a shortage of the amount the press oil kept in the concavities. As a result, a shortage of the press oil is caused while a die passes on the flat portion between two adjacent concavities during the press-forming. Furthermore, the shortage of the amount of the press oil kept in the concavities makes it impossible to obtain a static pressure sufficient to resist the contact surface pressure between the die and the steel sheet. This causes breakage of the press oil film, resulting in die galling and press cracking. On the other hand, when the total opening area per the unit area of the fine concavities having a depth of at least 2 μm in the alloying-treated iron-zinc alloy dip-plating layer is over 70%, an area of the flat portion between two adjacent concavities would remarkably be reduced, so that the flat portion may be broken. The total opening area per the unit area of the fine concavities having a depth of at least 2 μm in the alloying-treated iron-zinc alloy dip-plating layer should therefore be limited within a range of from 10 to 70% of the unit area.

In the alloying-treated iron-zinc alloy dip-plated steel sheet of the first embodiment of the first invention, the fine concavities having a depth of at least 2 μm satisfy the condition as described above. In the alloying-treated iron-zinc alloy dip-plated steel sheet of a second embodiment of the first invention, in contrast, the fine concavities having a depth of at least 2 μm satisfy not only the above-mentioned condition, but also the following condition that:

a bearing length ratio tp (80%) is up to 90%, the bearing length ratio tp (80%) being expressed, when cutting a roughness curve having a cutoff value of 0.8 mm over a prescribed length thereof by means of a straight line parallel to a mean line and located below the highest peak by 80% of a vertical distance between the highest peak and the lowest trough in the roughness curve, by a ratio in percentage of a total length of cut portions thus determined of the alloying-treated iron-zinc alloy dip-plating layer having a surface profile which corresponds to the roughness curve, relative to the prescribed length of the roughness curve, thereby permitting a further improvement of press-formability of the alloying-treated iron-zinc alloy dip-plated steel sheet.

FIG. 1 is a schematic descriptive view illustrating a profile of a roughness curve having a cutoff value of 0.8 mm, which corresponds to the alloying-treated iron-zinc alloy dip-plated steel sheet of the second embodiment of the first invention.

In FIG. 1, 1 is a straight line, i.e., a mean line of a roughness curve, for which the square-sum of deviations from the roughness curve becomes the least over a prescribed length (L) of the roughness curve having a cutoff value of 0.8 mm; 2 is a straight line parallel to the mean line 1 and passing through the highest peak; 3 is a straight line parallel to the mean line 1 and passing through the lowest trough; 4 is a straight line parallel to the mean line 1 and located below the highest peak by 80% of a vertical distance between the highest peak and the lowest trough; and $l_1$, $l_2$, $l_3$, $l_4$ and $l_5$ are respective lengths of cut portions of the alloying-treated iron-zinc alloy dip-plating layer having a surface profile which corresponds to the roughness curve, which respective lengths are determined by cutting the roughness curve by means of the straight line 4 over the prescribed length (L). Here, a bearing length ratio tp (80%) is a ratio in percentage of the total length of cut portions of the alloying-treated iron-zinc alloy dip-plating layer having a surface profile which corresponds to the roughness curve, relative to the prescribed length of the roughness curve, which cut portions are determined by cutting the roughness curve having a cutoff value of 0.8 mm over the prescribed length (L) thereof by means of the straight line 4 parallel to the mean line 1 and located below the highest peak by 80% of a vertical distance between the highest peak and the lowest trough in the roughness curve. The bearing length ratio tp (80%) is expressed by the following formula:

$$tp(80\%)=(l_1+l_2+l_3+l_4+l_5)/L\times 100(\%)$$

By keeping the value of the bearing length ratio tp (80%) to up to 90%, it is possible to keep the press oil in a sufficient amount in the numerous fine concavities, thereby enabling to impart a more excellent press-formability to the alloying-treated iron-zinc alloy dip-plated steel sheet.

Figure 2:
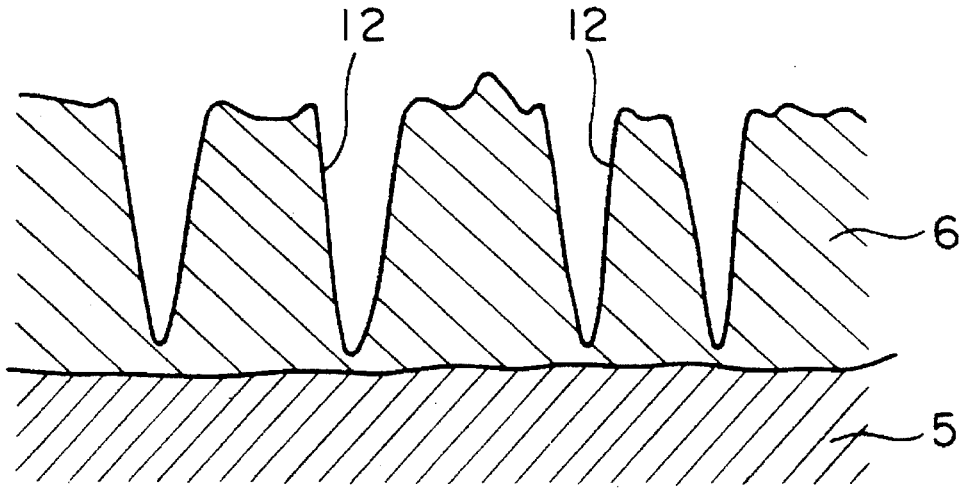
FIG. 2 is a schematic vertical sectional view of the alloying-treated iron-zinc alloy dip-plated steel sheet of the second embodiment of the first invention.

FIG. 2 is a schematic vertical sectional view illustrating the alloying-treated iron-zinc alloy dip-plated steel sheet of the second embodiment of the first invention. In FIG. 2, 5 is a steel sheet, and 6 is an alloying-treated iron-zinc alloy dip-plating layer formed on the steel sheet 5. As is clear from FIG. 2, the maximum depth of concavities 12 formed on the alloying-treated iron-zinc alloy dip-plating layer 6 is smaller than the minimum thickness of the alloying-treated iron-zinc alloy dip-plating layer 6. Therefore, although the thickness of the alloying-treated iron-zinc alloy dip-plating layer 6 becomes locally thinner, there is no portion in which the steel sheet 5 is exposed in the open air, whereby the above-mentioned alloying-treated iron-zinc alloy dip-plated steel sheet has excellent press-formability and excellent corrosion resistance. The fact that the alloying-treated iron-zinc alloy dip-plated steel sheet of the above-mentioned first embodiment of the first invention has a construction comprising a steel sheet and an alloying-treated iron-zinc alloy dip-plating layer having numerous fine concavities formed thereon, is not illustrated in a drawing. However, the alloying-treated iron-zinc alloy dip-plated steel sheet of the first embodiment of the first invention has also the same construction as that of the alloying-treated iron-zinc alloy dip-plated steel sheet of the second embodiment of the first invention as shown in FIG. 2.

Now, an alloying-treated iron-zinc alloy dip-plated steel sheet excellent in press-formability and image clarity after painting of a first embodiment of the second invention is described in detail with reference to FIG. 3. The fact that the alloying-treated iron-zinc alloy dip-plated steel sheet of the first embodiment of the second invention has a construction comprising a steel sheet and an alloying-treated iron-zinc alloy dip-plating layer having numerous fine concavities formed thereon, is not illustrated in a drawing. However, the alloying-treated iron-zinc alloy dip-plated steel sheet of the first embodiment of the second invention has also the same construction as that of the alloying-treated iron-zinc alloy dip-plated steel sheet of the second embodiment of the first invention as shown in FIG. 2.

As described above as to the alloy-treated iron-zinc alloy dip-plated steel sheet of the first embodiment of the first invention, it is important for the steel sheet to have a high keeping ability of the press oil film in order to inhibit the increase in frictional resistance during the press-forming.

For these reasons, the alloying-treated iron-zinc alloy dip-plated steel sheet of the first embodiment of the second invention comprises a steel sheet, and an alloying-treated iron-zinc alloy dip-plating layer formed on at least one surface of the steel sheet and having numerous fine concavities on the surface thereof. In the alloying-treated iron-zinc alloy dip-plated steel sheet of the first embodiment of the second invention, the press oil is effectively kept in the above-mentioned numerous fine concavities, thereby independently forming numerous microscopic pools for the press oil on the contact interface between the die and the alloying-treated iron-zinc alloy dip-plated steel sheet, by causing these fine concavities to satisfy the following conditions:

(1) that the number of fine concavities having a depth of at least 2 μm from among the numerous fine concavities is within a range of from 200 to 8,200 per $mm^2$ of the alloying-treated iron-zinc alloy dip-plating layer; and (2) that the fine concavities having a depth of at least 2 μm further satisfies the following condition:

that a bearing length ratio tp (2 μm) is within a range of from 30 to 90%, this bearing length ratio tp (2 μm) being expressed, when cutting a profile curve over a prescribed length thereof by means of a straight line parallel to a mean line and located below the highest peak in the profile curve by 2 μm, by a ratio in percentage of a total length of cut portions thus determined of the alloying-treated iron-zinc alloy dip-plating layer having a surface profile which corresponds to the profile curve, relative to the prescribed length of the profile curve.

Since the press oil received in the numerous micro-pools bears only part of the contact surface pressure even under a high contact surface pressure between the die and the alloying-treated iron-zinc alloy dip-plated steel sheet, thus enabling to avoid the direct contact between the die and the steel sheet and to obtain a satisfactory press-formability.

Now, the reasons of limiting values in the conditions regarding the above-mentioned numerous fine concavities are described below.

The reasons of the limitations regarding the depth of the numerous fine concavities in the alloying-treated iron-zinc alloy dip-plated steel sheet of the first embodiment of the second invention are the same as the reasons of limitations described as to the alloying-treated iron-zinc alloy dip-plated steel sheet of the first embodiment of the first invention. Description thereof is therefore omitted here.

When the number of the concavities having a depth of at least 2 μm from among the numerous fine concavities is under 200 per $mm^2$ of the alloying-treated iron-zinc alloy dip-plating layer, the length of a flat portion between two adjacent concavities from among the numerous fine concavities becomes excessively large, as in the case of the alloying-treated iron-zinc dip-plated steel sheet of the first embodiment of the first invention described above. In such a case, even when the press oil is kept in these concavities, lack of the press oil occurs while a die passes on the above-mentioned flat portion during the press-forming because of the long flat portion between to adjacent concavities, so that the sudden increase in coefficient of friction causes a microscopic seizure. Because of a high surface pressure applied onto a single concavity, furthermore, the press oil film is broken, which in turn causes die galling and press cracking. In addition to this problem, when the number of fine concavities having a depth of at least 2 μm is under 200 per $mm^2$ of the alloying-treated iron-zinc alloy dip-plating layer, it is impossible to eliminate a surface profile of the alloying-treated iron-zinc alloy dip-plated steel sheet, which has a wavelength within a range of from 100 to 2,000 μm exerting an adverse effect on image clarity after painting, and consequently, it is impossible to impart an excellent image clarity after painting to the alloying-treated iron-zinc alloy dip-plated steel sheet. On the other hand, even when the number of fine concavities having a depth of at least 2 μm is over 8,200 per $mm^2$ of the alloying-treated iron-zinc alloy dip-plating layer, no adverse effect is exerted on press-formability and image clarity after painting of the alloying-treated iron-zinc alloy dip-plated steel sheet, as in the case of the alloying-treated iron-zinc alloy dip-plated steel sheet of the first embodiment of the first invention described above. It is however technically difficult and is not practical to form such extremely numerous fine concavities. Therefore, the number of fine concavities having a depth of at least 2 μm should be limited within a range of from 200 to 8,200, and more preferably, within a range of from 500 to 3,000 per $mm^2$ of the alloying-treated iron-zinc alloy dip-plating layer.

Figure 3:
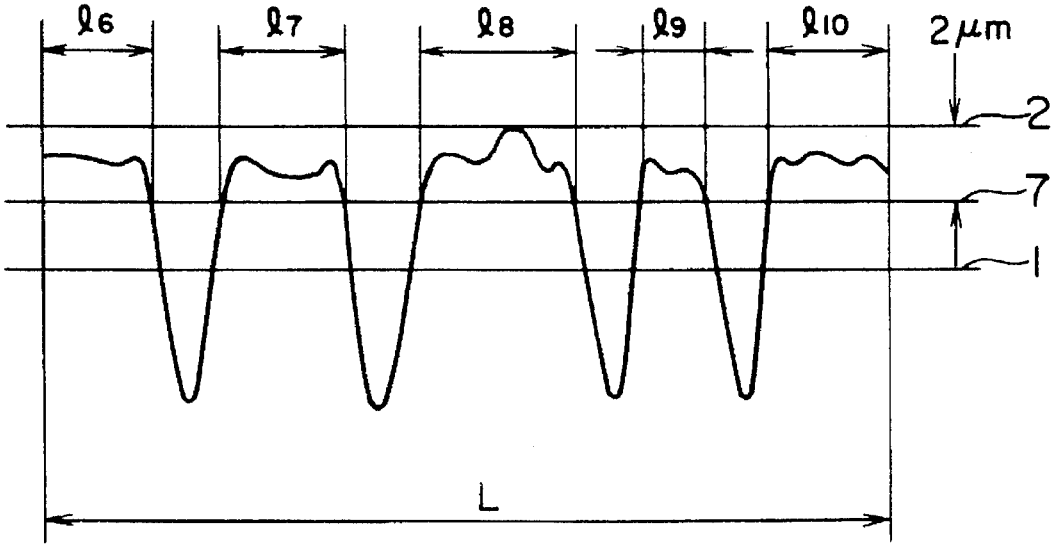
FIG. 3 is a schematic descriptive view illustrating a profile curve which corresponds to an alloying-treated iron-zinc alloy dip-plated steel sheet of a first embodiment of the second invention.

FIG. 3 is a schematic descriptive view illustrating a profile curve which corresponds to the alloying-treated iron-zinc alloy dip-plated steel sheet of the first embodiment of the second invention. In FIG. 3, 1 is a straight line, i.e., a mean line of a profile curve for which the square-sum of deviations from the profile curve becomes the least over a prescribed length (L) of the profile curve; 2 is a straight line parallel to the mean line 1 and passing through the highest peak; 7 is a straight line parallel to the mean line and located below the highest peak by 2 μm; and $l_6$, $l_7$, $l_8$, $l_9$ and $l_{10}$ are respective lengths of cut portions of the alloying-treated iron-zinc alloy dip-plating layer having a surface profile which corresponds to the profile curve, which respective lengths are determined by cutting the profile curve by means of the straight line 7 over the prescribed length (L). Here, a bearing length ratio tp (2 μm) is a ratio in percentage of the total length of cut portions of the alloying-treated iron-zinc alloy dip-plating layer having a surface profile which corresponds to the profile curve, relative to the prescribed length of the profile curve, which cut portions are determined by cutting the profile curve over the prescribed length (L) thereof by means of the straight line 7 parallel to the mean line 1 and located below the highest peak in the profile curve by 2 μm. The bearing length ratio tp (2 μm) is expressed by the following formula:

$$tp(2\ \mu m)=(l_6+l_7+l_8+l_9+l_{10})/L\times 100(\%)$$

When the bearing length ratio tp (2 μm) is over 90%, there would be a shortage of the amount of the press oil kept in the concavities. As a result, a shortage of the press oil is caused while a die passes on the flat portion between two adjacent concavities during the press-forming. In addition, the shortage of the amount of press oil kept in the concavities makes it impossible to obtain a static pressure sufficient to resist the contact surface pressure between the die and the steel sheet. Therefore, the press oil film is broken, resulting in die galling and press cracking. When the bearing length ratio tp (2 μm) is under 30%, on the other hand, image clarity after painting is degraded, and an area of the flat portion between concavities would remarkably reduced, and this may result in breakage of the flat portion. The bearing length ratio tp (2 μm) should therefore be limited within a range of from 30 to 90%.

In the alloying-treated iron-zinc alloy dip-plated steel sheet of the first embodiment of the second invention, it is possible to eliminate a surface profile of the alloying-treated iron-zinc alloy dip-plated steel sheet, which has a wavelength within a range of from 100 to 2,000 μm exerting an adverse effect on image clarity after painting, by limiting the depth, the number and the bearing length ratio tp (2 μm) of the numerous fine concavities formed on the alloying-treated iron-zinc alloy dip-plating layer, thereby improving image clarity after painting. The relationship between the surface profile and image clarity after painting of the alloying-treated iron-zinc alloy dip-plated steel sheet will be described later as to the method of the third invention.

Now, an alloying-treated iron-zinc alloy dip-plated steel sheet excellent in press-formability and image clarity after painting of a second embodiment of the second invention is described in detail with reference to FIG. 4. The fact that the alloying-treated iron-zinc alloy dip-plated steel sheet of the second embodiment of the second invention has a construction comprising a steel sheet and an alloying-treated iron-zinc alloy dip-plating layer having numerous fine concavities formed thereon, is not illustrated in a drawing. However, the alloying-treated iron-zinc alloy dip-plated steel sheet of the second embodiment of the second invention has also the same construction as that of the alloying-treated iron-zinc alloy dip-plated steel sheet of the second embodiment of the first invention as shown in FIG. 2.

In the alloying-treated iron-zinc alloy dip-plated steel sheet of the first embodiment of the second invention, the fine concavities having a depth of at least 2 μm satisfy the condition as described above. In the alloying-treated iron-zinc alloy dip-plated steel sheet of the second embodiment of the second invention, in contrast, the fine concavities having a depth of at least 2 μm satisfy not only the above-mentioned condition, but also the following condition that:

a bearing length ratio tp (80%) is up to 90%, the bearing length ratio tp (80%) being expressed, when cutting the profile curve over a prescribed length thereof by means of a straight line parallel to the mean line and located below the highest peak by 80% of a vertical distance between the highest peak and the lowest trough in the profile curve, by a ratio in percentage of a total length of cut portions thus determined of the alloying-treated iron-zinc alloy dip-plating layer having a surface profile which corresponds to the profile curve, relative to the prescribed length of the profile curve, thereby permitting a further improvement of press-formability and image clarity after painting of the alloying-treated iron-zinc dip-plated steel sheet.

Figure 4:
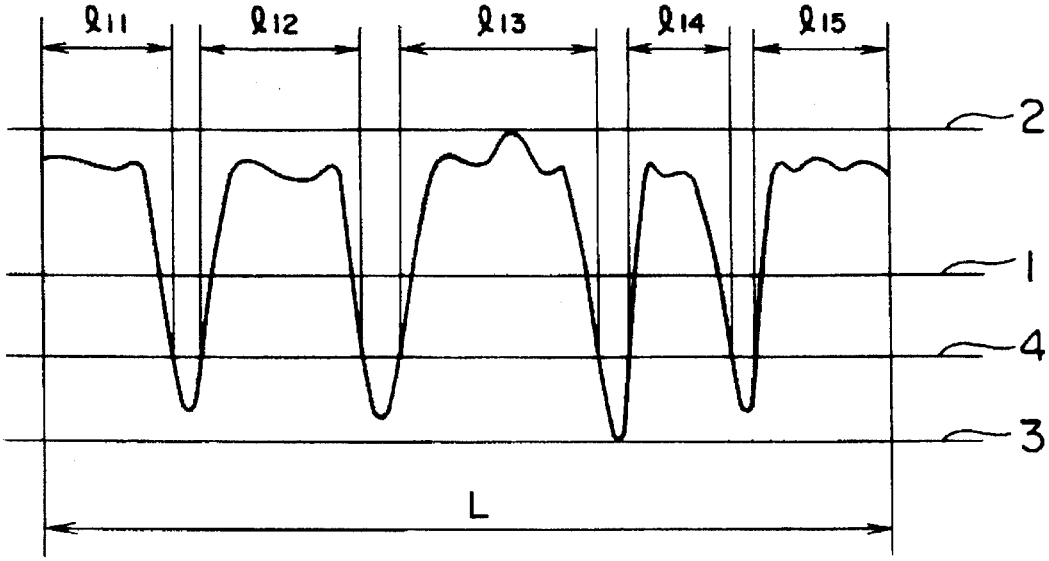
FIG. 4 is a schematic descriptive view illustrating a profile curve which corresponds to an alloying-treated iron-zinc alloy dip-plated steel sheet of a second embodiment of the second invention.

FIG. 4 is a schematic descriptive view illustrating a profile curve which corresponds to the alloying-treated iron-zinc alloy dip-plated steel sheet of the second embodiment of the second invention. In FIG. 4, 1 is a straight line, i.e., a mean line of a profile curve for which the square-sum of deviations from the profile curve becomes the least over a prescribed length (L) of the profile curve, 2 is a straight line parallel to the mean line 1 and passing through the highest peak; 3 is a straight line parallel to the mean line 1 and passing through the lowest trough; 4 is a straight line parallel to the mean line 1 and located below the highest peak by 80% of a vertical distance between the highest peak and the lowest trough; and $l_{11}$, $l_{12}$, $l_{13}$, $l_{14}$ and $l_{15}$ are respective lengths of cut portions of the alloying-treated iron-zinc alloy dip-plating layer having a surface profile which corresponds to the profile curve, which respective lengths are determined by cutting the profile curve by means of the straight line 4 over the prescribed length (L). Here, a bearing length ratio tp (80%) is a ratio in percentage of the total lengths of cut portions of the alloying-treated iron-zinc alloy dip-plating layer having a surface profile which corresponds to the profile curve, relative to the prescribed length of the profile curve, which cut portions are determined by cutting the profile curve over the prescribed length (L) thereof by means of the straight line 4 parallel to the mean line 1 and located below the highest peak by 80% of a vertical distance between the highest peak and the lowest trough in the profile curve. The bearing length ratio tp (80%) is expressed by the following formula:

$$tp(80\%)=(l_{11}+l_{12}+l_{13}+l_{14}+l_{15})/L\times 100(\%)$$

By keeping the value of the bearing length ratio tp (80%) to up to 90%, it is possible to keep the press oil in a sufficient amount in the numerous fine concavities, thereby imparting an excellent press-formability to the alloying-treated iron-zinc alloy dip-plated steel sheet, and at the same time, to impart an excellent image clarity after painting to the alloying-treated iron-zinc alloy dip-plated steel sheet.

The alloying-treated iron-zinc alloy dip-plated steel sheet of the second embodiment of the second invention, which has been described as having a single-layer construction comprising the alloying-treated iron-zinc alloy dip-plating layer, may have a dual-layer construction which comprises the above-mentioned alloying-treated iron-zinc alloy dip-plating layer as a lower layer and a ferrous or iron-zinc alloy plating layer as an upper layer formed thereon. It is also possible to improve lubricity by subjecting at least one surface of the above-mentioned alloying-treated iron-zinc alloy dip-plated steel sheet to an oxide film forming treatment, a chemical treatment, a composite organic resin film forming treatment or a solid lubricant applying treatment. Moreover, in the above-mentioned iron-zinc alloy dip-plated steel sheet, it is possible to improve corrosion resistance thereof by adding aluminum, magnesium, titanium, chromium, nickel, copper, silicon and/or tin to the alloying-treated iron-zinc alloy dip-plating layer.

Now, the method of the third invention for manufacturing an alloying-treated iron-zinc alloy dip-plated steel sheet excellent in press-formability is described.

The relationship between the plating conditions of a cold-rolled steel sheet including a zinc dip-plating treatment condition and an alloying treatment condition and the construction of a plating layer, was investigated and a method for improving press-formability was studied.

Numerous fine irregularities intrinsic to a plated steel sheet of this type are formed on the surface of the alloying-treated iron-zinc alloy dip-plated steel sheet. The situation of formation of such numerous fine irregularities is largely affected by a zinc dip-plating treatment condition and an alloying treatment condition. It is therefore possible to form numerous fine concavities permitting improvement of press-formability on the surface of the alloying-treated iron-zinc alloy dip-plated steel sheet, by appropriately selecting the zinc dip-plating treatment condition and the alloying treatment condition.

Extensive studies were therefore carried out to obtain a method for forming an alloying-treated iron-zinc alloy dip-plating layer on the surface of a steel sheet. As a result, the following findings were obtained. More specifically, in a method for manufacturing an alloying-treated iron-zinc alloy dip-plated steel sheet which comprises the steps of:

subjecting a hot-rolled steel sheet to a cold-rolling treatment to prepare a cold-rolled steel sheet; passing the cold-rolled steel sheet through a zinc dip-plating bath having a chemical composition comprising zinc, aluminum and incidental impurities to apply a zinc dip-plating treatment to the cold-rolled steel sheet, thereby forming a zinc dip-plating layer on at least one surface of the cold-rolled steel sheet; subjecting the cold-rolled steel sheet having the zinc dip-plating layer thus formed on the surface thereof to an alloying treatment at a prescribed temperature, thereby forming an alloying-treated iron-zinc alloy dip-plating layer on that at least one surface of the cold-rolled steel sheet, the alloying-treated iron-zinc alloy dip-plating layer having numerous fine concavities; and then subjecting the cold-rolled steel sheet having the alloying-treated iron-zinc alloy dip-plating layer having the numerous fine concavities thus formed on the surface thereof to a temper-rolling;

it is possible to manufacture an alloying-treated iron-zinc alloy dip-plated steel sheet excellent in press-formability, provided with an alloying-treated iron-zinc alloy dip-plating layer having numerous fine concavities, by:

(1) limiting the content of aluminum in the zinc dip-plating bath within a range of from 0.05 to 0.30 wt. %; (2) limiting the temperature region causing an initial reaction for forming an iron-aluminum alloy layer in the zinc dip-plating treatment within a range of from 500° to 600° C.; and (3) limiting the prescribed temperature in the alloying treatment within a range of from 480° to 600° C.

An investigation in detail was carried out regarding a zinc dip-plating treatment and an alloying treatment of a zinc dip-plating layer in the conventional method for manufacturing an alloying-treated iron-zinc alloy dip-plated steel sheet. As a result, the following facts were clarified. The zinc dip-plating treatment and the alloying treatment in the conventional method for manufacturing the alloying-treated iron-zinc alloy dip-plated steel sheet are described below with reference to FIGS. 5 to 8.

Figure 5:
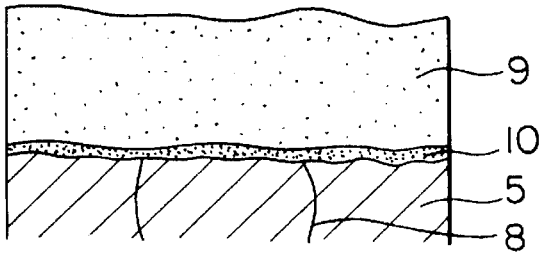
FIG. 5 is a schematic descriptive view illustrating an initial reaction in which an iron-aluminum alloy layer is formed in a conventional zinc dip-plating treatment for manufacturing an alloying-treated iron-zinc alloy dip-plated steel sheet.
Figure 6:
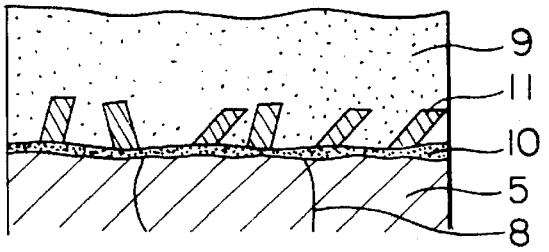
FIG. 6 is a schematic descriptive view illustrating columnar crystals comprising a ζ-phase formed on an iron-aluminum alloy layer in a conventional alloying treatment for manufacturing an alloying-treated iron-zinc alloy dip-plated steel sheet.
Figure 7:
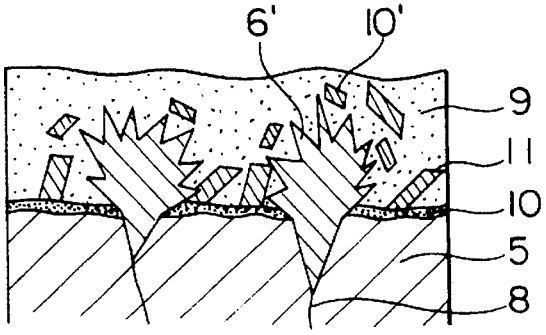
FIG. 7 is a schematic descriptive view illustrating an out-burst structure, comprising an iron-zinc alloy, formed in the conventional alloying treatment for manufacturing an alloying-treated iron-zinc alloy dip-plated steel sheet.
Figure 8:
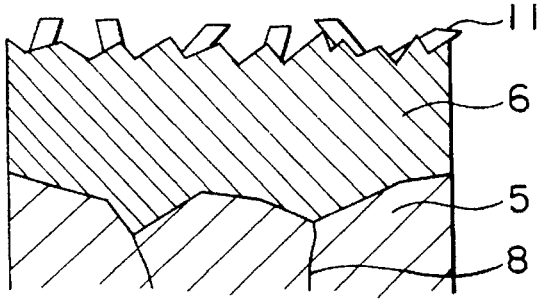
FIG. 8 is a schematic descriptive view illustrating an iron-zinc alloy layer formed by the growth of an out-burst structure comprising an iron-zinc alloy in the conventional alloying treatment for manufacturing an alloying-treated iron-zinc alloy dip-plated steel sheet.

FIG. 5 is a schematic descriptive view illustrating an initial reaction in which an iron-aluminum alloy layer is formed in a conventional zinc alloy dip-plating treatment for manufacturing an alloying-treated iron-zinc alloy dip-plated steel sheet; FIG. 6 is a schematic descriptive view illustrating columnar crystals comprising a ζ-phase formed on an iron-aluminum alloy layer in a conventional alloying treatment; FIG. 7 is a schematic descriptive view illustrating an out-burst structure, comprising an iron-zinc alloy, formed in the conventional alloying treatment; and FIG. 8 is a schematic descriptive view illustrating an iron-zinc alloy layer formed by the growth of an out-burst structure comprising an iron-zinc alloy in the conventional alloying treatment.

As shown in FIG. 5, immediately after dipping a cold-rolled steel sheet 5 into a zinc dip-plating bath containing aluminum, a thin iron-aluminum alloy layer 10 is produced on the interface between the steel sheet 5 and a zinc dip-plating layer 9 to inhibit the growth of an iron-zinc alloy. Then, at the very beginning of the initial stage of the alloying treatment, as shown in FIG. 6, columnar crystals 11 comprising a ζ-phase are produced on the iron-aluminum alloy layer 10, and grow then. At the same time, zinc diffuses through the iron-aluminum alloy layer 10 into crystal grain boundaries 8, and an iron-zinc alloy is produced along the crystal grain boundaries 8.

Then, as shown in FIG. 7, a change in volume is produced under the effect of the production of an iron-zinc alloy along the crystal grain boundaries 8, which in turn causes a mechanical breakage of the thin iron-aluminum alloy layer 10. Pieces 10' of the thus broken iron-aluminum alloy layer 10 are peeled off from the interface between the steel sheet 5 and the zinc dip-plating layer 9, and are pushed out into the zinc dip-plating layer 9. Iron and zinc come into contact with each other in each of portions where the thin iron-aluminum alloy layer 10 has disappeared, and an alloying reaction immediately takes place between iron and zinc, thus forming an out-burst structure 6' (this reaction being hereinafter referred to as the "out-burst reaction"). According as the alloying reaction proceeds further, the out-burst structure 6' grows laterally, and the entire plating layer gradually becomes iron-zinc alloy layer, whereby, as shown in FIG. 8, the entire surface of the steel sheet 5 is covered with an alloying-treated iron-zinc alloy dip-plating layer 6.

When manufacturing an alloying-treated iron-zinc alloy dip-plated steel sheet, it has been a conventional practice to add aluminum in a slight amount to a zinc dip-plating bath to form, as shown in FIG. 5, a thin iron-aluminum alloy layer 10 on the surface of the steel sheet 5, thereby controlling the alloying reaction rate between iron and zinc.

As a result of a detailed study on an inhibiting phenomenon of an alloying reaction between iron and zinc by means of the iron-aluminum alloy layer and an out-burst reaction, it was further found that an out-burst reaction took place remarkably within a temperature region of from 480° to 600° C., and particularly, within a temperature region of from 480° to 540° C., an out-burst reaction occurred the most actively, and that numerous fine concavities were formed on the alloying-treated iron-zinc alloy dip-plating layer by appropriately combining the inhibiting phenomenon of the alloying reaction between iron and zinc by means of the iron-aluminum, and the out-burst reaction.

Furthermore, in view of improvement of press-formability brought about by keeping the press oil in the above-mentioned numerous fine concavities, it was clarified that an alloying-treated iron-zinc alloy dip-plated steel sheet excellent in press-formability could be manufactured by achieving optimization of the size and the number of numerous fine concavities.

Now, a zinc dip-plating treatment and an alloying treatment in the method of the third invention for manufacturing an alloying-treated iron-zinc alloy dip-plated steel sheet are described below with reference to FIGS. 9 to 12.

Figure 9:
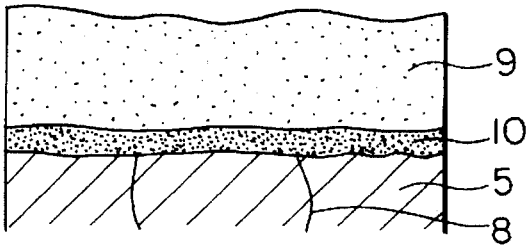
FIG. 9 is a schematic descriptive view illustrating an initial reaction in which an iron-aluminum alloy layer is formed in a zinc dip-plating treatment according to the method of the third invention for manufacturing an alloying-treated iron-zinc alloy dip-plated steel sheet.
Figure 10:
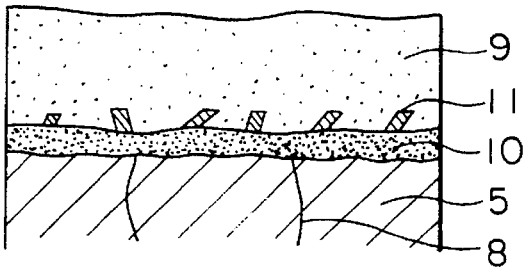
FIG. 10 is a schematic descriptive view illustrating columnar crystals comprising a ζ-phase formed on the iron-aluminum alloy layer in an alloying treatment according to the method of the third invention for manufacturing an alloying-treated iron-zinc alloy dip-plated steel sheet.
Figure 11:
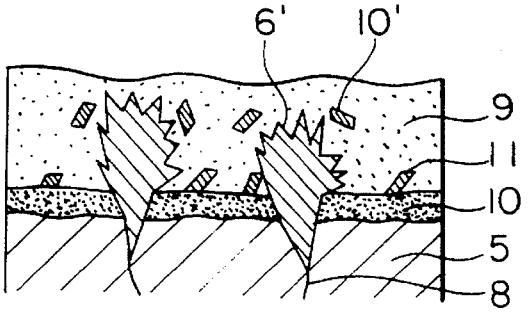
FIG. 11 is a schematic descriptive view illustrating an out-burst structure, comprising an iron-zinc alloy, formed in the alloying treatment according to the method of the third invention for manufacturing an alloying-treated iron-zinc alloy dip-plated steel sheet.
Figure 12:
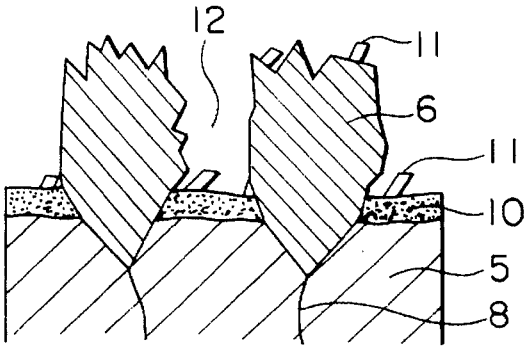
FIG. 12 is a schematic descriptive view illustrating one of fine concavities formed in the alloying treatment according to the method of the third invention for manufacturing an alloying-treated iron-zinc alloy dip-plated steel sheet.

FIG. 9 is a schematic descriptive view illustrating an initial reaction in which an iron-aluminum alloy layer is formed in a zinc dip-plating treatment according to the method of the third invention for manufacturing an alloying-treated iron-zinc alloy dip-plated steel sheet; FIG. 10 is a schematic descriptive view illustrating columnar crystals comprising a ζ-phase formed on the iron-aluminum alloy layer in an alloying treatment according to the method of the third invention; FIG. 11 is a schematic descriptive view illustrating an out-burst structure, comprising an iron-zinc alloy, formed in the alloying treatment according to the method of the third invention; and FIG. 12 is a schematic descriptive view illustrating one of fine concavities formed in the alloying treatment according to the method of the third invention.

In the method of the third invention, a zinc dip-plating treatment is accomplished by dipping a cold-rolled steel sheet into a zinc dip-plating bath having a chemical composition comprising zinc, aluminum in an amount within a range of from 0.05 to 0.30 wt. %, and incidental impurities, so that an initial reaction, in which an iron-aluminum alloy layer is formed, takes place in a temperature region of from 500° to 600° C. As a result, the alloying reaction rate between aluminum and the steel sheet in the zinc dip-plating bath is accelerated, and a thick iron-aluminum alloy layer 10 is formed on an interface between the cold-rolled steel sheet 5 and the zinc dip-plating layer 9 as shown in FIG. 9.

Then, the steel sheet 5 having the iron-aluminum alloy layer 10 on the surface thereof and the zinc dip-plating layer 9 formed thereon, is subjected to an alloying treatment in an alloying furnace at a temperature within a range of from 480° to 600° C. At the very beginning of the initial stage of alloying treatment, columnar crystals 11 comprising a ζ-phase are produced and grow then on the iron-aluminum alloy layer 10 as shown in FIG. 10. At the same time, zinc diffuses through the iron-aluminum alloy layer 10 into crystal grain boundaries 8 of the steel sheet 5, and an iron-zinc alloy is produced along the crystal grain boundaries 8.

Then, as shown in FIG. 11, a change in volume is produced under the effect of the production of an iron-zinc alloy along the crystal grain boundaries 8, which in turn causes a mechanical breakage of the thick iron-aluminum alloy layer 10. Pieces 10' of the thus broken iron-aluminum alloy layer 10 are peeled off from the interface between the steel sheet 5 and the zinc dip-plating layer 9, and are pushed out into the zinc dip-plating layer 9. Iron and zinc come into contact with each other in each of portions where the thick iron-aluminum alloy layer 10 has disappeared, and an alloying reaction immediately takes place between iron and zinc, thus forming an out-burst structure 6'.

After the completion of the out-burst reaction as described above, the alloying reaction between iron and zinc proceeds. In the method of the third invention, since the thick iron-aluminum alloy layer 10 is formed over a large area, the lateral growth of the out-burst structure 6' is inhibited. As a result, the out-burst structure 6' grows outside in a direction at right angles to the surface of the steel sheet 5. In each of regions where the iron-aluminum alloy layer 10 remains, a fine concavity 12 is formed as shown in FIG. 12, by consuming zinc in each of the regions where the iron-aluminum alloy layer 10 remains, for forming the iron-zinc alloy along with the growth of the out-burst structure 6'.

In the alloying-treated iron-zinc alloy dip-plated steel sheet thus obtained, most of the numerous fine concavities have a depth of at least 2 μm, the number of fine concavities having a depth of at least 2 μm is within a range of from 200 to 8,200 per $mm^2$ of the alloying-treated iron-zinc alloy dip-plating layer, and the total opening area per a unit area of the fine concavities having a depth of at least 2 μm is within a range of from 10 to 70% of the unit area.

Now, the following paragraphs describe the reasons why the zinc dip-plating treatment condition and the alloying treatment condition are limited as described above in the method of the third invention for manufacturing an alloying-treated iron-zinc alloy dip-plated steel sheet excellent in press-formability.

With an aluminum content of under 0.05 wt. % in the zinc dip-plating bath in the zinc dip-plating treatment, even when the initial reaction, in which an iron-aluminum alloy layer is formed, takes place within a temperature range of from 500° to 600° C. in the zinc dip-plating bath, the thus produced iron-aluminum alloy layer is too thin to inhibit the lateral growth of the out-burst structure, thus making it impossible to form numerous fine concavities. With an aluminum content of over 0.30 wt. %, on the other hand, the inhibiting effect of the alloying reaction between iron and zinc brought about by the iron-aluminum layer, is so strong that the application of the alloying treatment under any conditions cannot cause an alloying reaction between iron and zinc. The aluminum content in the zinc dip-plating bath in the zinc dip-plating treatment should therefore be limited within a range of from 0.05 to 0.30 wt. %.

With a temperature at which the initial reaction for forming the iron-aluminum layer in the zinc dip-plating treatment of under 500° C., the reaction rate between aluminum and the steel sheet in the zinc dip-plating bath is low, resulting in the production of an extremely thin iron-aluminum alloy layer. As a result, the lateral growth of the out-burst structure cannot be inhibited, and therefore, numerous fine concavities cannot be formed. When the temperature at which the above-mentioned initial reaction takes place is over 600° C., on the other hand, the very high reaction rate between aluminum and the steel sheet in the zinc dip-plating bath, while producing a sufficiently thick iron-aluminum alloy layer, causes simultaneously sudden increase in the reaction rate between zinc and the steel sheet. As a result, it is impossible to inhibit the growth of the iron-zinc alloy layer, and therefore, to form numerous fine concavities. The temperature at which the initial reaction, in which the iron-aluminum alloy layer is formed, takes place should therefore be limited within a range of from 500° to 600° C.

Conceivable means to cause the above-mentioned initial reaction at a temperature within a range of from 500° to 600° C., include dipping a steel sheet having a temperature within a range of from 500° to 600° C. into a zinc dip-plating bath; dipping a steel sheet into a zinc dip-plating bath having a temperature within a range of from 500° to 600° C.; or dipping a steel sheet having a temperature within a range of from 500° to 600° C. into a zinc dip-plating bath having a temperature within a range of from 500° to 600° C. However, when dipping a steel sheet having a temperature within a range of from 500° to 600° C. into a zinc dip-plating bath, temperature of the steel sheet becomes the same as that of the bath having a large heat capacity immediately after the occurrence of the initial reaction at an appropriate temperature. When the steel sheet has a small thickness, the appropriate initial reaction time is shorter.

When the steel sheet is dipped into a zinc dip-plating bath having a temperature within a range of from 500° to 600° C., temperature of the steel sheet immediately becomes the same as that of the bath having a large heat capacity. It is therefore possible to cause the initial reaction at an appropriate temperature. However, when the steel sheet has a large thickness, temperature may come off the appropriate range for the initial reaction at the very beginning of the initial reaction because the steel sheet has a relatively large heat capacity. It is therefore desirable to dip a steel sheet having a temperature within a range of from 500° to 600° C. into a zinc dip-plating bath having a temperature within a range of from 500° to 600° C. It is not necessary that the entire bath has a temperature within a range of from 500° to 600° C., but it suffices that a portion where the initial reaction takes place, i.e., the proximity to the portion where the steel sheet passes therethrough, has a temperature within a range of from 500° to 600° C.

With an alloying treatment temperature of under 480° C., columnar crystals comprising a ζ-phase grow prior to the occurrence of the out-burst reaction, so that numerous fine concavities cannot be formed. With an alloying treatment temperature of over 600° C., on the other hand, the alloying reaction between iron and zinc becomes stronger, so that the inhibiting effect of the alloying reaction between iron and zinc brought about by the iron-aluminum alloy layer, becomes relatively weaker. As a result, the lateral growth of the out-burst structure cannot be inhibited, thus making it impossible to form numerous fine concavities. Since the alloying treatment temperature is high, furthermore, part of zinc evaporates, and the structure near the interface between the alloying-treated iron-zinc alloy dip-plating layer and the steel sheet transforms into a brittle Γ-phase, resulting in a serious decrease in powdering resistance. The most active out-burst reaction takes place at a temperature near 500° C. The alloying treatment temperature should therefore be limited within a range of from 480° to 600° C., and more preferably, within a range of from 480° to 540° C.

Now, the method of the fourth invention for manufacturing an alloying-treated iron-zinc alloy dip-plated steel sheet excellent in press-formability is described below.

The "Iron and Steel", Vol. 72 (1986) page 989 reports that the formation of the out-burst structure is inhibited when carbon is dissolved in the form of solid-solution into steel. According to this report, solid-solution carbon in steel segregates on the crystal grain boundaries of steel. Since carbon segregating on the crystal grain boundaries inhibits diffusion of zinc into the crystal grain boundaries, there is only a slight production of iron-zinc alloy on the crystal grain boundaries. Consequently, a change in volume is not caused by the production of an iron-zinc alloy. It is therefore estimated that an iron-aluminum alloy layer is firmly present and inhibits the formation of an out-burst structure. Nitrogen and boron, which have a strong tendency of segregating on the crystal grain boundaries of steel are also estimated to display a function similar to that of carbon.

The relationship between the out-burst reaction and the crystal grain boundaries of a steel sheet was studied in detail. The following findings were obtained as a result:

(1) An out-burst reaction remarkably takes place within a temperature region of from 480° to 600° C., and most actively occurs within a temperature region of from 480° to 540° C.

(2) When using, as a steel sheet, a cold-rolled steel sheet, into which at least one element selected from the group consisting of carbon, nitrogen and boron is dissolved in the form of solid-solution in an amount within a range of from 1 to 20 ppm, there are present, in the cold-rolled steel sheet, crystal grain boundaries where an out-burst reaction takes place and crystal grain boundaries where no out-burst reaction takes place.

As a result of further studies carried out on the basis of the above-mentioned findings, the following additional findings were obtained. More specifically, in a method for manufacturing an alloying-treated iron-zinc alloy dip-plated steel sheet, which comprises the steps of:

subjecting a hot-rolled steel sheet to a cold-rolling treatment to prepare a cold-rolled steel sheet; passing said cold-rolled steel sheet through a zinc dip-plating bath having a chemical composition comprising zinc, aluminum and incidental impurities to apply a zinc dip-plating treatment to the cold-rolled steel sheet, thereby forming a zinc dip-plating layer on at least one surface of the cold-rolled steel sheet; subjecting the cold-rolled steel sheet having the zinc dip-plating layer thus formed on the surface thereof to an alloying treatment at a prescribed temperature, thereby forming an alloying-treated iron-zinc alloy dip-plating layer on that at least one surface of the cold-rolled steel sheet, the alloying-treated iron-zinc alloy dip-plating layer having numerous fine concavities; and then subjecting the cold-rolled steel sheet having the alloying-treated iron-zinc alloy dip-plating layer having the numerous fine concavities thus formed on the surface thereof to a temper rolling;

it is possible to manufacture an alloying-treated iron-zinc alloy dip-plated steel sheet excellent in press-formability, provided with an alloying-treated iron-zinc alloy dip-plating layer having numerous fine concavities, by:

(1) using, as the cold-rolled steel sheet, a cold-rolled steel sheet into which at least one element selected from the group consisting of carbon, nitrogen and boron is dissolved in the form of solid-solution in an amount within a range of from 1 to 20 ppm;

(2) limiting the content of aluminum in the zinc dip-plating bath within a range of from 0.05 to 0.30 wt. %; and (3) limiting the prescribed temperature in the alloying treatment within a range of from 480° to 600° C., and more preferably, within a range of from 480° to 540° C.

Now, a zinc dip-plating treatment and an alloying treatment in the method of the fourth invention for manufacturing an alloying-treated iron-zinc alloy dip-plated steel sheet are described below with reference to FIGS. 13 to 16.

Figure 13:
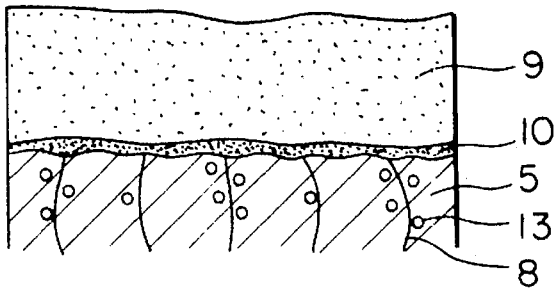
FIG. 13 is a schematic descriptive view illustrating an initial reaction in which an iron-aluminum alloy layer is formed in a zinc dip-plating treatment according to the method of the fourth invention for manufacturing an alloying-treated iron-zinc alloy dip-plated steel sheet.
Figure 14:
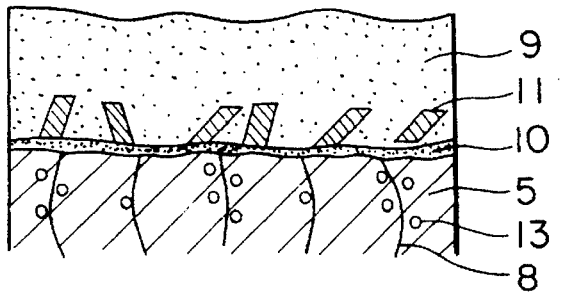
FIG. 14 is a schematic descriptive view illustrating columnar crystals comprising a ζ-phase formed on the iron-aluminum alloy layer in an alloying treatment according to the method of the fourth invention for manufacturing an alloying-treated iron-zinc alloy dip-plated steel sheet.
Figure 15:
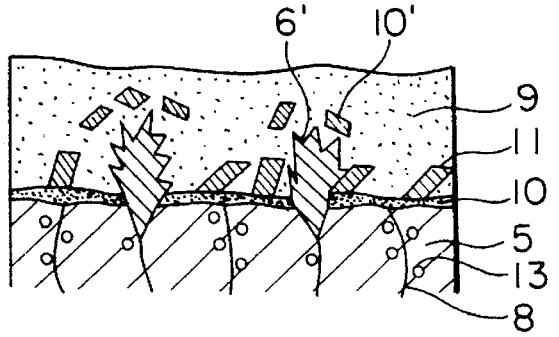
FIG. 15 is a schematic descriptive view illustrating an out-burst structure, comprising an iron-zinc alloy, formed in the alloying treatment according to the method of the fourth invention for manufacturing an alloying-treated iron-zinc alloy dip-plated steel sheet.
Figure 16:
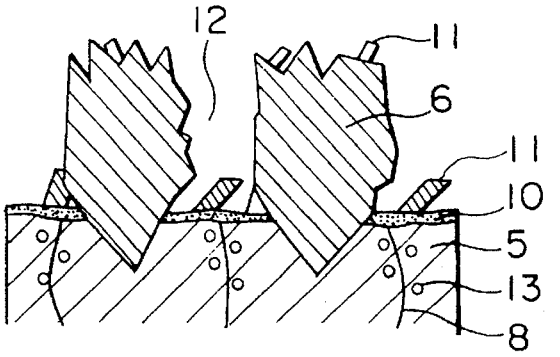
FIG. 16 is a schematic descriptive view illustrating one of fine concavities formed in the alloying treatment according to the method of the fourth invention for manufacturing an alloying-treated iron-zinc alloy dip-plated steel sheet.

FIG. 13 is a schematic descriptive view illustrating an initial reaction in which an iron-aluminum alloy layer is formed in a zinc dip-plating treatment according to the method of the fourth invention for manufacturing an alloying-treated iron-zinc alloy dip-plated steel sheet; FIG. 14 is a schematic descriptive view illustrating columnar crystals comprising a ζ-phase, formed on the iron-aluminum alloy layer in an alloying treatment according to the method of the fourth invention; FIG. 15 is a schematic descriptive view illustrating an out-burst structure, comprising an iron-zinc alloy, formed in the alloying treatment according to the method of the fourth invention; and FIG. 16 is a schematic descriptive view illustrating one of fine concavities formed in the alloying treatment according to the method of the fourth invention.

The method of the fourth invention comprises the steps of using a cold-rolled steel sheet into which at least one element selected from the group consisting of carbon, nitrogen and boron is dissolved in the form of solid-solution in an amount within a range of from 1 to 20 ppm; annealing the cold-rolled steel sheet; then subjecting the annealed steel sheet to a zinc dip-plating treatment in a zinc dip-plating bath having a composition comprising zinc, aluminum within a range of from 0.05 to 0.30 wt. %, and incidental impurities; and then subjecting the zinc dip-plated cold-rolled steel sheet to an alloying treatment at a temperature within a range of from 480° to 600° C., and more preferably, within a range of from 480° to 540° C.

As shown in FIG. 13, an iron-aluminum alloy layer 10 is produced on the surface of the steel sheet 5 also in the zinc dip-plating treatment according to the method of the fourth invention for manufacturing an alloying-treated iron-zinc alloy dip-plated steel sheet, as in the zinc dip-plating treatment according to the conventional method for manufacturing an alloying-treated iron-zinc alloy dip-plated steel sheet as shown in FIG. 5. Then, columnar crystals 11 comprising a ζ-phase are produced and grow then on the iron-aluminum alloy layer 10 also in the initial stage of the alloying treatment according to the method of the fourth invention for manufacturing an alloying-treated iron-zinc alloy dip-plated steel sheet, as in the initial stage of the alloying treatment according to the conventional method for manufacturing an alloying-treated iron-zinc alloy dip-plated steel sheet as shown in FIG. 6.

When the alloying treatment is continued further after the production of the columnar crystals 11 comprising the ζ-phase, out-burst structures 6' are formed only on specific crystal grain boundaries 13, on which slight amounts of carbon, nitrogen and boron segregate as shown in FIG. 15, and the out-burst structures 6' grow outside in a direction at right angles to the surface of the steel sheet 5.

After the completion of the out-burst reaction as described above, the alloying reaction between iron and zinc proceeds. In the method of the fourth invention, since the thick iron-aluminum alloy layer 10 is formed over a large area, the lateral growth of the out-burst structure 6' is inhibited. As a result, the out-burst structure 6' grows outside in a direction at right angles to the surface of the steel sheet 5. In each of regions where the iron-aluminum alloy layer 10 remains, a fine concavity 12 is formed as shown in FIG. 16, by consuming zinc in each of the regions, where the iron-aluminum alloy layer 10 remains, for forming the iron-zinc alloy along with the growth of the out-burst structure 6'.

The crystal grain boundaries 13 on which the out-burst structure 6' is formed vary with an amount of at least one element selected from the group consisting of carbon, nitrogen and boron which are dissolved in the form of solid-solution into steel. More specifically, according as the amount of solid-solution of at least one element selected from the group consisting of carbon, nitrogen and boron increases, the frequency of occurrence of the out-burst reaction decreases, and as a result, a diameter of the numerous fine concavities 12 becomes larger. In other words, it is possible to control the diameter of the numerous fine concavities 12 by adjusting the amount of solid-solution of at least one element selected from the group consisting of carbon, nitrogen and boron in steel, thereby permitting manufacture of an alloying-treated zinc dip-plated steel sheet having numerous fine concavities on the alloying-treated iron-zinc alloy dip-plating layer thereof.

In the alloying-treated iron-zinc alloy dip-plated steel sheet, most of the numerous fine concavities have a depth of at least 2 μm, the number of fine concavities having a depth of at least 2 μm is within a range of from 200 to 8,200 per $mm^2$ of the alloying-treated iron-zinc alloy dip-plating layer, and the total opening area per a unit area of the fine concavities having a depth of at least 2 μm is within a range of from 10 to 70% of the unit area.

Now, the following paragraphs describe the reasons why the zinc dip-plating treatment condition and the alloying treatment condition are limited as described above in the method of the fourth invention for manufacturing an alloying-treated iron-zinc alloy dip-plated steel sheet excellent in press-formability.

When the amount of at least one element selected from the group consisting of carbon, nitrogen and boron, which are dissolved in the form of solid-solution into the cold-rolled steel sheet is under 1 ppm, it is impossible to inhibit the occurrence of an out-burst reaction on the specific crystal grain boundaries and the lateral growth of the out-burst structure, thus making it impossible to form numerous fine concavities. When the amount of the above-mentioned at least one element is over 20 ppm, on the other hand, there is a quality deterioration of the cold-rolled steel sheet. The amount of at least one element selected from the group consisting of carbon, nitrogen and boron, which are dissolved into the cold-rolled steel sheet in the form of solid-solution, should therefore be limited within a range of from 1 to 20 ppm.

The amount of solid-solution of at least one element selected from the group consisting of carbon, nitrogen and boron in the steel sheet can be adjusted by adjusting the amount of added carbon, nitrogen, boron, titanium and/or niobium to molten steel in the steelmaking stage, or by altering the hot-rolling condition or the annealing condition on a continuous zinc dip-plating line. Furthermore, it is possible to adjust the amount of solid-solution of carbon, nitrogen and/or boron in steel, by, immediately before introducing the steel sheet into the continuous zinc dip-plating line, covering the surface of the steel sheet with an iron-carbon alloy layer, an iron-nitrogen alloy layer, an iron-boron alloy layer or the like, and causing carbon, nitrogen and/or boron in the above-mentioned layers to dissolve in the form of solid-solution into steel during the subsequent annealing step. The purpose of causing at least one element selected from the group consisting of carbon, nitrogen and boron to dissolve in the form of solid solution into the steel sheet, is to control the out-burst reaction. It suffices therefore that at least one element selected from the group consisting of carbon, nitrogen and boron is dissolved in the form of solid-solution into the steel sheet upon subjecting the steel sheet to a zinc dip-plating treatment, and the dissolving method is not limited to a particular one.

The reasons of limiting the aluminum content in the zinc dip-plating bath and the alloying treatment temperature in the method of the fourth invention, are the same as those in the above-mentioned method of the third invention. The description of these reasons of limitation is therefore omitted here. While, in the method of the third invention, the temperature region, within which the initial reaction for forming the iron-aluminum alloy layer takes place in the alloying treatment, is limited within a range of from 500° to 600° C. in the zinc dip-plating treatment, it is not necessary, in the method of the fourth invention, to limit the temperature region for the initial reaction within a particular region.

Now, a zinc dip-plating treatment and an alloying treatment in the method of the fifth invention for manufacturing an alloying-treated iron-zinc alloy dip-plated steel sheet are described. Phenomena in the zinc dip-plating treatment and the alloying treatment in the method of the fifth invention are the same as those shown in FIGS. 9 to 12 in the zinc dip-plating treatment and the alloying treatment in the method of the third invention. The zinc dip-plating treatment and the alloying treatment in the method of the fifth invention are therefore described with reference to FIGS. 9 to 12.

In the method of the fifth invention, the zinc dip-plating treatment is accomplished by passing a cold-rolled steel sheet through a zinc dip-plating bath having a chemical composition comprising zinc, aluminum in an amount within a range of from 0.10 to 0.25 wt. %, and incidental impurities. As a result, the alloying reaction rate between aluminum and the steel sheet in the zinc dip-plating bath is accelerated, and a thick iron-aluminum alloy layer 10 is formed on the interface between the cold-rolled steel sheet 5 and the zinc plating layer 9 as shown in FIG. 9.

Then, the steel sheet 5 having the iron-aluminum alloy layer 10 formed on the surface thereof and the zinc dip-plating layer 9 formed thereon, is subjected to an alloying treatment in an alloying furnace at a temperature T (°C.) satisfying the following formula:

$$440+400\times[\text{Al wt. \%}]\leqq T\leqq 500+400\ [\text{Al wt. \%}]$$

where, [Al wt. %] is the aluminum content in the zinc dip-plating bath.

At the very beginning of the initial stage of the alloying treatment, columnar crystals 11 comprising a ζ-phase are produced and grow then on the iron-aluminum alloy layer 10 as shown in FIG. 10. At the same time, zinc diffuses through the iron-aluminum alloy layer 10 into grain boundaries 8 of the steel sheet 5, and an iron-zinc alloy is produced on the grain boundaries 8.

Then, as shown in FIG. 11, a change in volume is produced under the effect of the production of an iron-zinc alloy along the crystal grain boundaries 8, which in turn causes a mechanical breakage of the thick iron-aluminum alloy layer 10. Pieces 10' of the thus broken iron-aluminum alloy layer 10 are peeled off from the interface between the steel sheet 5 and the zinc dip-plating layer 9, and are pushed out into the zinc dip-plating layer 9. Iron and zinc come into contact with each other in each of portions where the thick iron-aluminum alloy layer 10 has disappeared, and an alloying reaction immediately takes place between iron and zinc, thus forming an out-burst structure 6'.

After the completion of the out-burst reaction as described above, the alloying reaction between iron and zinc proceeds. In the method of the fifth invention, since the thick iron-aluminum alloy layer 10 is formed over a large area, the lateral growth of the out-burst structure 6' is inhibited. As a result, the out-burst structure 6' grows outside in a direction at right angles to the surface of the steel sheet 5. In each of regions where the iron-aluminum layer 10 remains, a fine concavity 12 is formed as shown in FIG. 12, by consuming zinc in each of the regions where the iron-aluminum alloy layer 10 remains, for forming the iron-zinc alloy along with the growth of the out-burst structure 6'.

In the alloying-treated iron-zinc alloy dip-plated steel sheet thus obtained, most of the numerous fine concavities have a depth of at least 2 μm, the number of fine concavities having a depth of at least 2 μm is within a range of from 200 to 8,200 per $mm^2$ of the alloying-treated iron-zinc alloy dip-plating layer, and the total opening area per a unit area of the fine concavities having a depth of at least 2 μm is within a range of from 10 to 70% of the unit area.

Now, the following paragraphs describe the reasons why the zinc dip-plating treatment condition and the alloying treatment condition are limited as described above in the method of the fifth invention for manufacturing an alloying-treated iron-zinc alloy dip-plated steel sheet excellent in press-formability are described below.

With an aluminum content of under 0.10 wt. % in the zinc dip-plating bath in the zinc dip-plating treatment, the thus produced iron-aluminum alloy layer is too thin to inhibit the lateral growth of the out-burst structure, thus making it impossible to form numerous fine concavities. With an aluminum content of over 0.25 wt. %, on the other hand, the inhibiting effect of the alloying reaction between iron and zinc brought about by the iron-aluminum alloy layer, is so strong as to require a long period of time before the completion of the alloying treatment, thus leading to a decreased productivity. The aluminum content in the zinc dip-plating bath in the zinc dip-plating treatment should therefore be limited within a range of from 0.10 to 0.25 wt. %.

The alloying treatment in the method of the fifth invention is accomplished at a temperature T (°C.) satisfying the following formula:

$$440+400\times[\text{Al wt. \%}]\leqq T\leqq 500+400\times[\text{Al wt. \%}]$$

where, [Al wt. %] is the aluminum content in the zinc dip-plating bath.

The reasons thereof are described below. The out-burst reaction actively takes place at a temperature within a range of from 480° to 540° C. as described above. Productivity may decrease, or numerous fine concavities may not be formed appropriately, depending upon the balance with the aluminum content in the zinc dip-plating bath.

Figure 27:
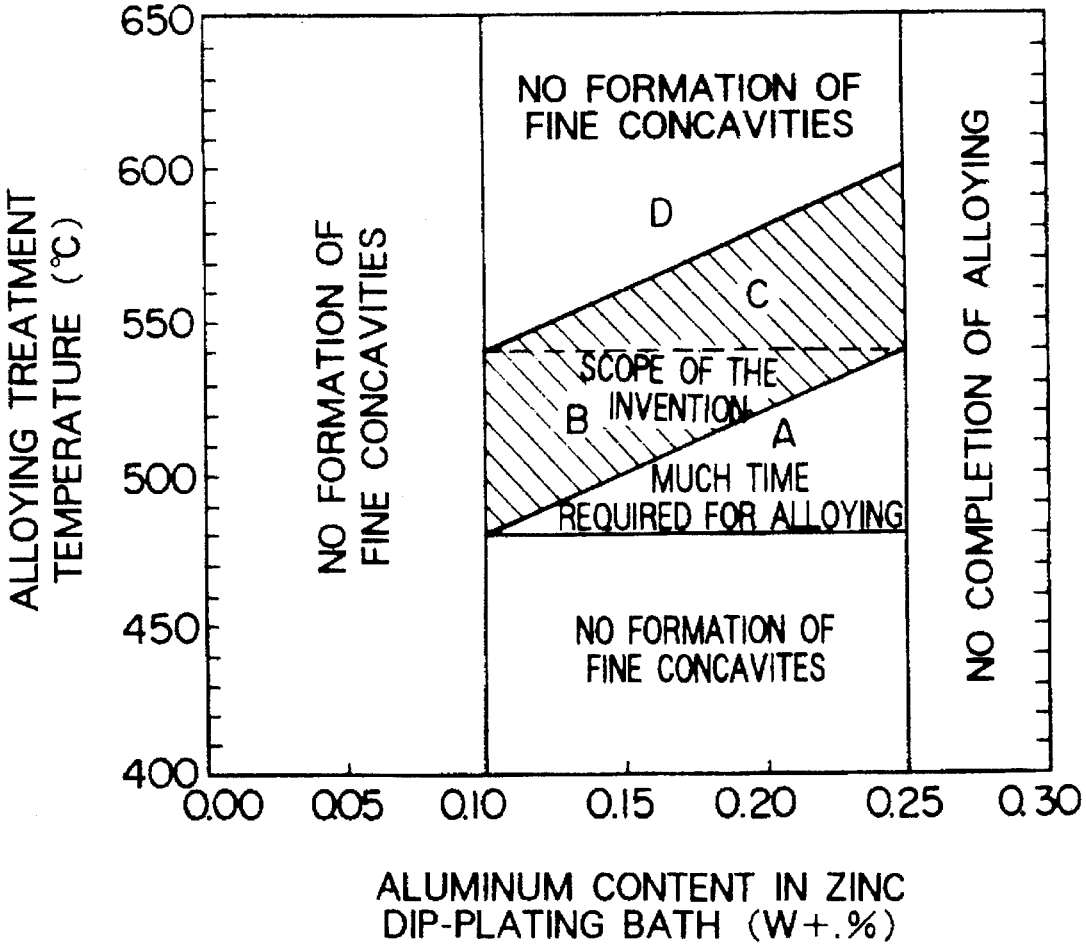
FIG. 27 is a graph illustrating a relationship between an alloying treatment temperature and an aluminum content in a zinc dip-plating bath in the alloying treatment according to the method of the fifth invention.

FIG. 27 is a graph illustrating a relationship between an alloying treatment temperature and an aluminum content in a zinc dip-plating bath in the alloying treatment according to the method of the fifth invention. As shown in FIG. 27, with an alloying treatment temperature T (°C.) of under 480° C., columnar crystals comprising a ζ-phase grow, and the alloying reaction between iron and zinc proceeds without the occurrence of the out-burst reaction, thus making it impossible to appropriately form numerous fine concavities.

When an alloying treatment temperature T (°C.) satisfies the following formula:

$$480\leqq T<440+400\times[\text{Al wt. \%}]$$

where, [Al wt. %] is the aluminum content in the zinc dip-plating bath, i.e., when the alloying treatment temperature T (°C.) and the aluminum content in the zinc dip-plating bath are within a region indicated by "A" in FIG. 27, the out-burst reaction actively takes place and numerous fine concavities are formed. However, because of a slightly low alloying treatment temperature, the inhibiting effect of the alloying reaction between iron and zinc brought about by the iron-aluminum alloy layer becomes relatively stronger. A longer period of time is required before the completion of the alloying treatment, thus resulting in a lower productivity.

When an alloying treatment temperature T (°C.) satisfies the following formula:

$$440+400\ [\text{Al wt. \%}]\leqq T\leqq 540$$

where, [Al wt. %] is the aluminum content in the zinc dip-plating bath, i.e., when the alloying treatment temperature T (°C.) and the aluminum content in the zinc dip-plating bath are within a region indicated by "B" in FIG. 27, numerous fine concavities are appropriately formed.

When an alloying treatment temperature T (°C.) satisfies the following formula:

$$540\leqq T\leqq 500+400\times[\text{Al wt. \%}]$$

Where, [Al wt. %] is the aluminum content in the zinc dip-plating bath, i.e., when the alloying treatment temperature T (°C.) and the aluminum content in the zinc dip-plating bath are within a region indicated by "C" in FIG. 27, although the out-burst reaction is less active, the high alloying treatment temperature permits a proper display of the inhibiting effect of the alloying reaction between iron and zinc brought about by the iron-aluminum alloy layer, resulting in appropriate formation of numerous fine concavities.

When an alloying treatment temperature T (°C.) satisfies the following formula:

$$500+400\times[\text{Al wt. \%}]<T$$

where, [Al wt. %] is the aluminum content in the zinc dip-plating bath, i.e., when the alloying treatment temperature T (°C.) and the aluminum content in the zinc dip-plating bath are within a region indicated by "D" in FIG. 27, the inhibiting effect of the alloying reaction between iron and zinc brought about by the iron-aluminum alloy layer, becomes relatively weaker because of a less active out-burst reaction and a slightly higher alloying treatment temperature, and as a result, numerous fine concavities cannot appropriately be formed. Since the alloying treatment temperature is high, furthermore, part of zinc evaporates, and the structure near the interface between the alloy-treated iron-zinc alloy dip-plating layer and the steel sheet transforms into a brittle Γ-phase, with a result of a remarkably decreased powdering resistance, thus making it impossible to manufacture an alloying-treated iron-zinc alloy dip-plated steel sheet satisfactory in quality.

In the method of the fifth invention, therefore, the alloying treatment temperature should be limited within the above-mentioned range. While, in the method of the third invention, the temperature region, within which the initial reaction for forming the iron-aluminum alloy layer takes place in the zinc dip-plating treatment, is limited within a range of from 500° to 600° C., it is not necessary, in the method of the fifth invention, to limit the temperature region for the initial reaction within a particular region.

In the methods of the third to fifth inventions, numerous fine concavities are formed through the utilization of the alloying reaction as described above. Therefore, unlike the conventional technique in which press-formability of an alloying-treated iron-zinc alloy dip-plated steel sheet is improved by subjecting same to a temper-rolling with the use of laser-textured dull rolls, the alloying-treated iron-zinc alloy dip-plating layer is never damaged. It is therefore possible to impart an excellent powdering resistance to the alloying-treated iron-zinc alloy dip-plated steel sheet. Furthermore, the press oil is satisfactorily kept in the numerous fine concavities formed on the surface of the alloying-treated iron-zinc alloy dip-plating layer, and as a result, numerous microscopic pools for the press oil can be independently formed on the friction interface between the die and the alloying-treated iron-zinc alloy dip-plated steel sheet. Since the press oil received in the numerous microscopic pools on the friction interface bears only part of the contact surface pressure even under a high contact surface pressure between the die and the alloying-treated iron-zinc alloy dip-plated steel sheet, it is possible to avoid the direct contact between the die and the steel sheet, thus enabling to obtain an excellent press-formability. According to the methods of the third to the fifth inventions, as described above, it is possible to manufacture an alloying-treated iron-zinc alloy dip-plated steel sheet excellent not only in press-formability but also in powdering resistance.

Further studies were carried out on the relationship between the manufacturing conditions of an alloying-treated iron-zinc alloy dip-plated steel sheet such as the cold-rolling condition, the chemical composition of the zinc dip-plating bath, the alloying treatment condition and the temper-rolling condition, on the one hand, and the characteristics such as image clarity after painting, press-formability and powdering resistance of the alloying-treated iron-zinc alloy dip-plated steel sheet, on the other hand.

First, the relationship between a surface roughness of the alloying-treated iron-zinc alloy dip-plated steel sheet, i.e., a center-line mean roughness (Ra) and a filtered center-line waviness (Wca), on the one hand, and image clarity after painting of the alloying-treated iron-zinc alloy dip-plated steel sheet, on the other hand, was investigated in accordance with the following method. More particularly, each of various alloying-treated iron-zinc alloy dip-plated steel sheets having surface roughness different from each other, was subjected to a three-coat painting comprising an electropainting step applied for achieving a paint film thickness of 20 μm, an intermediate-painting step applied for achieving a paint film thickness of 35 μm, and a top-painting step applied for achieving a paint film thickness of 35 μm. Image clarity after painting of each of the alloying-treated iron-zinc alloy dip-plated steel sheets thus subjected to the above-mentioned three-coat painting, was measured with the use of an "NSIC-type image clarity measuring instrument" made by Suga Test Instrument Co., Ltd. to determine an assessment value of image clarity after painting (hereinafter referred to as the "NSIC-value").

Figure 17:
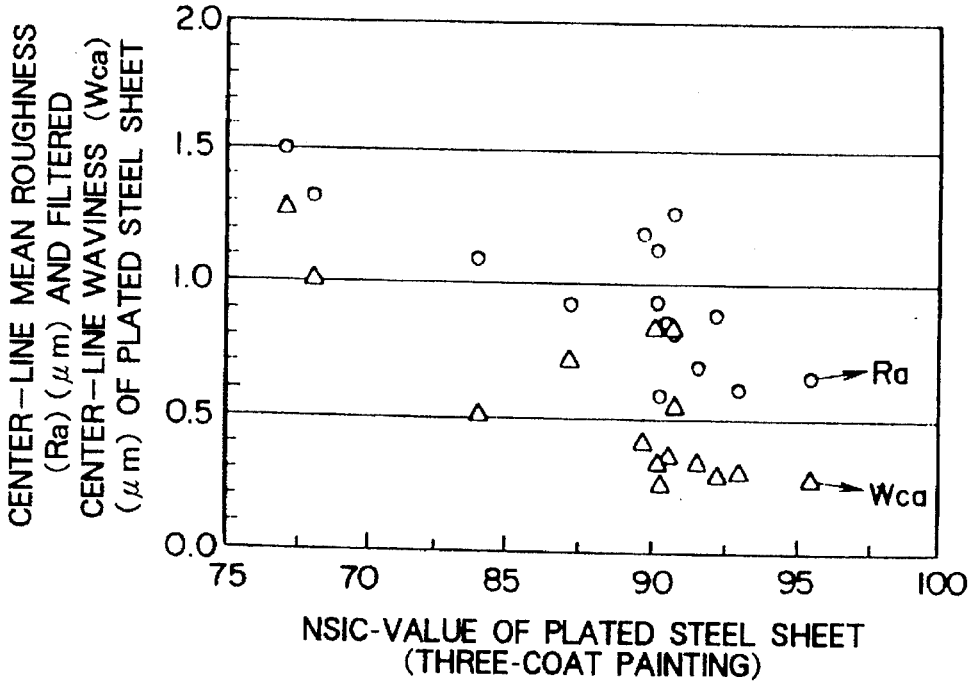
FIG. 17 is a graph illustrating a relationship between an assessment value of image clarity after painting (hereinafter referred to as the "NSIC-value" [an abbreviation of "Nippon Paint Suga Test Instrument Image Clarity"]), a center-line mean roughness (Ra) and a filtered center-line waviness (Wca) of an alloying-treated iron-zinc alloy dip-plated steel sheet.

The results of the investigation are shown in FIG. 17. FIG. 17 is a graph illustrating a relationship between the NSIC-value, the center-line mean roughness (Ra) and the filtered center-line waviness (Wca) of the alloying-treated iron-zinc alloy dip-plated steel sheet. FIG. 17 revealed that there was only a slight correlation between the center-line roughness (Ra), the filtered center-line waviness (Wca) and image clarity after painting of the alloying-treated iron-zinc alloy dip-plated steel sheet.

For each of the alloying-treated iron-zinc alloy dip-plated steel sheets after each step of the above-mentioned electropainting step, intermediate-painting step and top-painting step, the center-line mean roughness (Ra) and the filtered center-line waviness (Wca) were measured. The results showed that, for any of the alloying-treated iron-zinc alloy dip-plated steel sheets, the center-line mean roughness (Ra) and the filtered center-line waviness (Wca) converged into certain values at the time of the intermediate-painting step. This revealed that it was impossible to explain changes in image clarity after painting of the alloying-treated iron-zinc alloy dip-plated steel sheet on the basis of the center-line mean roughness (Ra) and the filtered center-line waviness (Wca) of the alloying-treated iron-zinc alloy dip-plated steel sheet.

Figure 18:
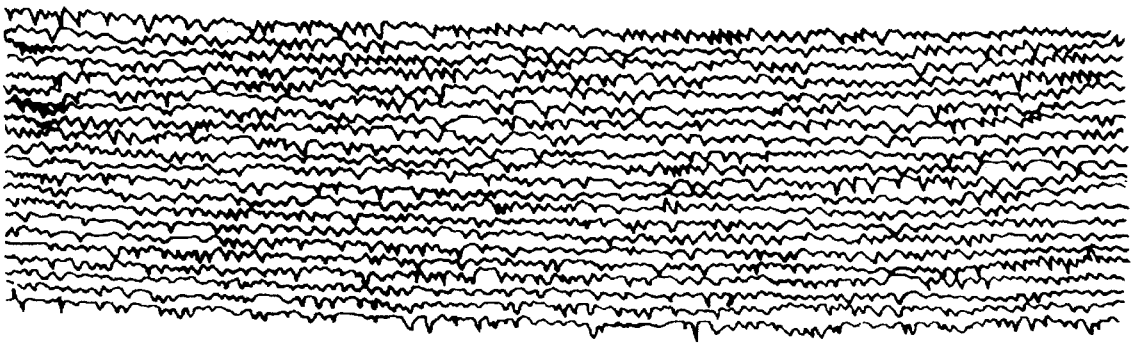
FIG. 18 is a schematic descriptive view illustrating 21 profile curves sampled with the use of a three-dimensional stylus profilometer when analyzing a wavelength of a surface profile of an alloying-treated iron-zinc alloy dip-plated steel sheet.

Subsequently, a wavelength of the surface profile of the alloying-treated iron-zinc alloy dip-plated steel sheet was analyzed, and a relationship between a wavelength component and image clarity after painting was investigated in accordance with a method described below. First, 21 profile curves for a measuring length of 8 mm in the X-axis direction were sampled at a pitch of 50 μm in the Y-axis direction by means of a three-dimensional stylus profilometer. Three-dimensional surface profiles obtained by drawing the 21 profile curves thus sampled at 20 magnifications for X-axis, 40 magnifications for Y-axis, and 1,000 magnifications for Z-axis are shown in FIG. 18.

Figure 19:
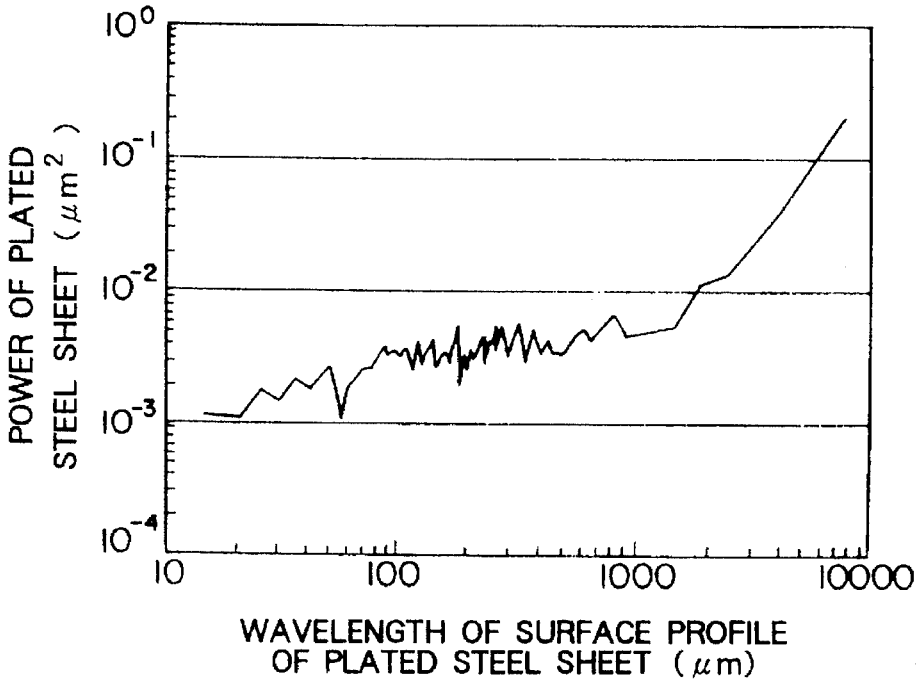
FIG. 19 is a graph illustrating a relationship between a wavelength of a surface profile and a power thereof, obtained through a wavelength analysis, in amplitude spectra of an alloying-treated iron-zinc alloy dip-plated steel sheet.

Then, with 1024 data points for each profile curve, the profile curve was subjected to the leveling treatment by the application of the least square method to eliminate a gradient of each profile curve. Then, an irregular waveform of the surface profile of the alloying-treated iron-zinc alloy dip-plated steel sheet, i.e., a waveform showing an irregular fluctuation of height relative to the X-axis, was subjected to the Fourier transformation to decompose the waveform into the square-sum of waveheights for individual wavelengths to calculate a waveheight distribution. The thus obtained waveheight distributions for the 21 profile curves were linearly added and averaged to determine a single waveheight distribution. The square-sum of the waveheights of each wavelength was presented as a power. An amplitude spectrum was obtained by connecting these powers by a straight line. FIG. 19 is a graph illustrating a relationship between a wavelength of a surface profile and a power thereof, obtained through a wavelength analysis, in amplitude spectra of an alloying-treated iron-zinc alloy dip-plated steel sheet.

Figure 20:
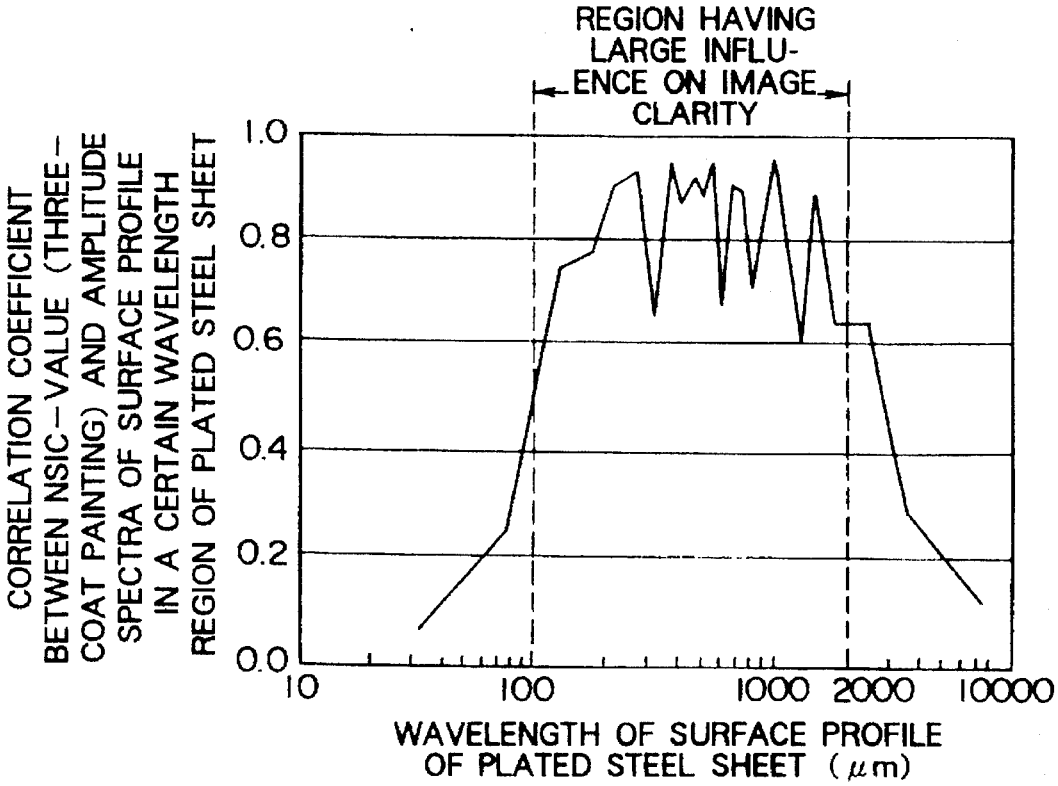
FIG. 20 is a graph illustrating a relationship between a correlation coefficient between an NSIC-value and amplitude spectra of a surface profile in a certain wavelength region of an alloying-treated iron-zinc alloy dip-plated steel sheet, on the one hand, and a wavelength of a surface profile of the alloying-treated iron-zinc alloy dip-plated steel sheet, on the other hand.

A correlation coefficient between the power for each wavelength of the alloying-treated iron-zinc alloy dip-plated steel sheet and the NSIC-value of the three-coat painted alloying-treated iron-zinc alloy dip-plated steel sheet was determined from the results of the wavelength analysis carried out as described above, and correlation coefficients for the individual wavelengths were plotted. FIG. 20 is a graph illustrating a relationship between a correlation coefficient between an NSIC-value and amplitude spectra of a surface profile in a certain wavelength region of an alloying-treated iron-zinc alloy dip-plated steel sheet, on the one hand, and a wavelength of a surface profile of the alloying-treated iron-zinc alloy dip-plated steel sheet, on the other hand. As shown in FIG. 20, there is a close correlation between image clarity after painting and the power within a wavelength region of from 100 to 2,000 μm, and it was revealed that the surface profile within a wavelength region of from 100 to 2,000 μm exerted an adverse effect on image clarity after painting. Giving attention to the fact that elimination of the surface profile within the wavelength region of from 100 to 2,000 μm is effective for improving image clarity after painting, further studies were carried out.

A relationship between a wavelength of a surface profile and a power thereof was investigated, for each of cold-rolled steel sheets subjected to a cold-rolling treatment using, at least at a final roll stand in a cold-rolling mill, rolls of which a surface profile was adjusted so that a center-line mean roughness (Ra) was within a range of from 0.1 to 0.8 μm, and an integral value of amplitude spectra in a wavelength region of from 100 to 2,000 μm, which amplitude spectra were obtained through the Fourier transformation of a profile curve of the cold-rolled steel sheet after the cold-rolling treatment, was up to 200 $\mu m^3$, and for each of a plurality of alloying-treated iron-zinc alloy dip-plated steel sheets manufactured under different conditions using the above-mentioned cold-rolled steel sheets. The results are shown in FIG. 21.

Figure 21:
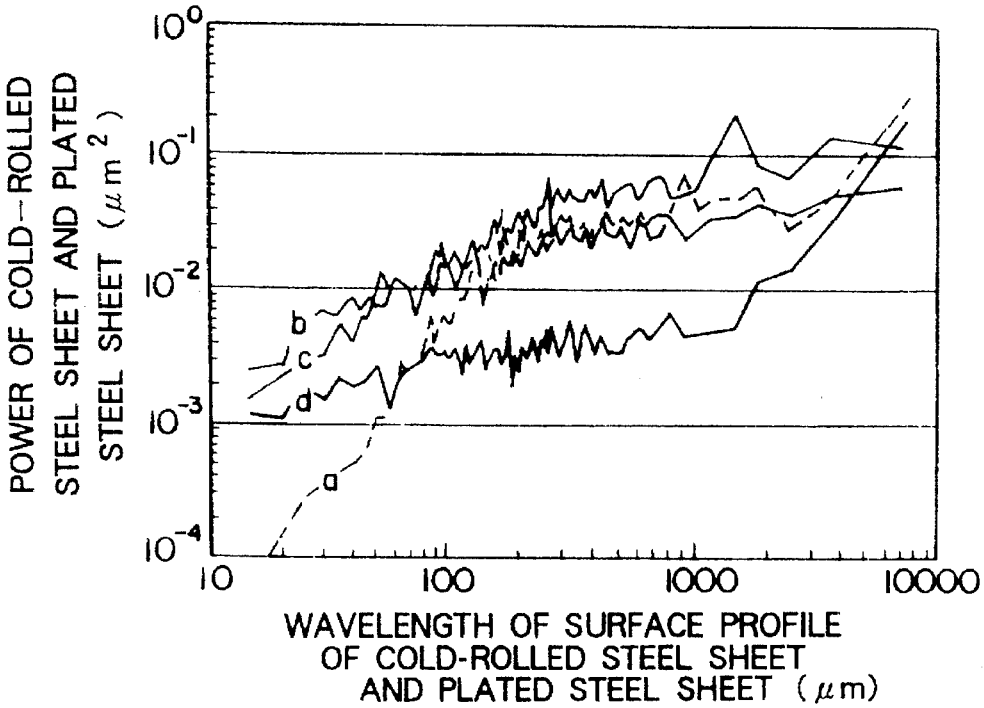
FIG. 21 is a graph illustrating a relationship between a wavelength of a surface profile and a power thereof, for each of cold-rolled steel sheets subjected to a cold-rolling treatment using, at least at a final roll stand in a cold-rolling mill, rolls of which a surface profile is adjusted so that a center-line mean roughness (Ra) is within a range of from 0.1 to 0.8 μm, and an integral value of amplitude spectra in a wavelength region of from 100 to 2,000 μm, which amplitude spectra are obtained through the Fourier transformation of a profile curve of the cold-rolled steel sheet after the cold-rolling treatment, is up to 200 $\mu m^3$, and for each of a plurality of alloying-treated iron-zinc alloy dip-plated steel sheets manufactured under different conditions using the above-mentioned cold-rolled steel sheets.

In FIG. 21, "a" indicates an amplitude spectrum of a cold-rolled steel sheet; "b" indicates an amplitude spectrum of an alloying-treated iron-zinc alloy dip-plated steel sheet not subjected to a temper-rolling; "c" indicates an amplitude spectrum of an alloying-treated iron-zinc alloy dip-plated steel sheet subjected to a temper-rolling with the use of ordinary rolls; and "d" indicates an amplitude spectrum of an alloying-treated iron-zinc alloy dip-plated steel sheet subjected to a temper-rolling with the use of rolls of which a surface profile is adjusted so that a center-line mean roughness (Ra) is up to 0.5 μm, and an integral value of amplitude spectra in a wavelength region of from 100 to 2,000 μm, which amplitude spectra are obtained through the Fourier transformation of a profile curve of the cold-rolled steel sheet after the temper-rolling treatment, is up to 200 $\mu m^3$. The integral value of the amplitude spectrum "a" in the wavelength region of from 100 to 2,000 μm was 98 $\mu m^3$, the integral value of the amplitude spectrum "b" in the above-mentioned wavelength region was 160 $\mu m^3$, the integral value of the amplitude spectrum "c" in the above-mentioned wavelength region was 100 $\mu m^3$, and the integral value of the amplitude spectrum "d" in the above-mentioned wavelength region was 50 $\mu m^3$.

A relationship between a wavelength of a surface profile and a power thereof was investigated, for each of cold-rolled steel sheets subjected to a cold-rolling treatment using, at least at a final roll stand in a cold-rolling mill, rolls of which a surface profile was adjusted so that a center-line mean roughness (Ra) was within a range of from 0.1 to 0.8 μm, and an integral value of amplitude spectra in a wavelength region of from 100 to 2,000 μm, which amplitude spectra were obtained through the Fourier transformation of a profile curve of the cold-rolled steel sheet after the cold-rolling treatment, was up to 500 $\mu m^3$, and for each of a plurality of alloying-treated iron-zinc alloy dip-plated steel sheets manufactured under different conditions using the above-mentioned cold-rolled steel sheets. The results are shown in FIG. 22.

Figure 22:
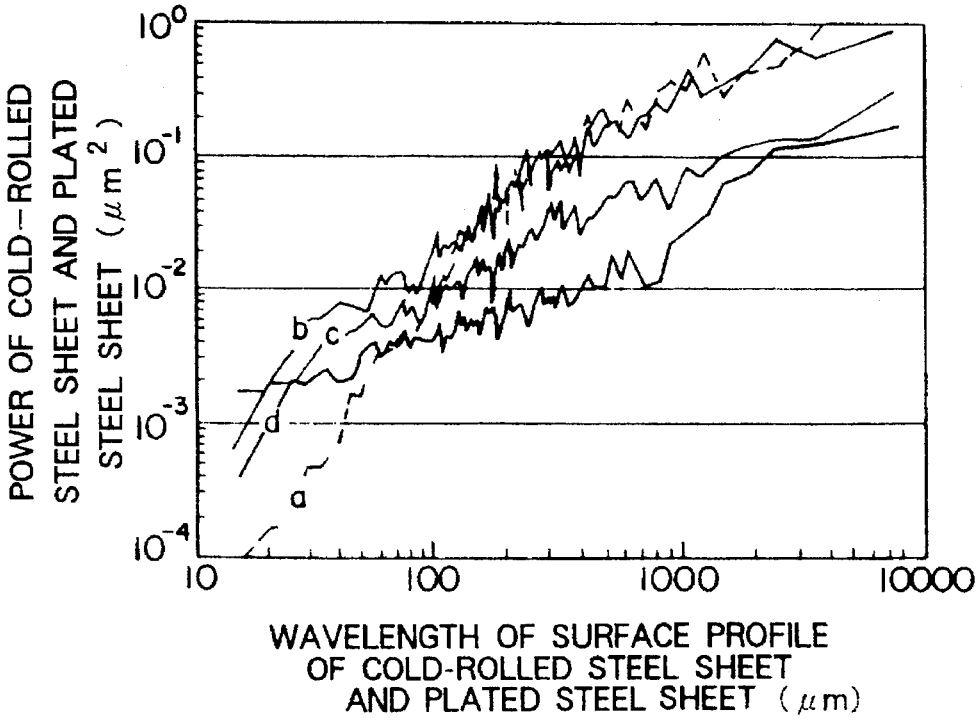
FIG. 22 is a graph illustrating a relationship between a wavelength of a surface profile and a power thereof, for each of cold-rolled steel sheets subjected to a cold-rolling treatment using, at least at a final roll stand in a cold-rolling mill, rolls of which a surface profile is adjusted so that a center-line mean roughness (Ra) is within a range of from 0.1 to 0.8 μm, and an integral value of amplitude spectra in a wavelength region of from 100 to 2,000 μm, which amplitude spectra are obtained through the Fourier transformation of a profile curve of the cold-rolled steel sheet after the cold-rolling treatment, is up to 500 $\mu m^3$, and for each of a plurality of alloying-treated iron-zinc alloy dip-plated steel sheets manufactured under different conditions using the above-mentioned cold-rolled steel sheets.

In FIG. 22, "a" indicates an amplitude spectrum of a cold-rolled steel sheet; "b" indicates an amplitude spectrum of an alloying-treated iron-zinc alloy dip-plated steel sheet not subjected to a temper-rolling; "c" indicates an amplitude spectrum of an alloying-treated iron-zinc alloy dip-plated steel sheet subjected to a temper-rolling with the use of ordinary rolls; and "d" indicates an amplitude spectrum of an alloying-treated iron-zinc alloy dip-plated steel sheet subjected to a temper-rolling with the use of rolls of which a surface profile is adjusted so that a center-line mean roughness (Ra) is up to 0.5 μm, and an integral value of amplitude spectra in a wavelength region of from 100 to 2,000 μm, which amplitude spectra are obtained through the Fourier transformation of a profile curve of the cold-rolled steel sheet after the temper-rolling treatment, is up to 100 $\mu m^3$. The integral value of the amplitude spectrum "a" in the wavelength region of from 100 to 2,000 μm was 485 $\mu m^3$, the integral value of the amplitude spectrum "b" in the above-mentioned wavelength region was 523 $\mu m^3$, the integral value of the amplitude spectrum "c" in the above-mentioned wavelength region was 250 $\mu m^3$, and the integral value of the amplitude spectrum "d" in the above-mentioned wavelength region was 70 $\mu m^3$.

Findings obtained from FIGS. 21 and 22 were as follows:

(1) It is possible to impart an excellent image clarity after painting to an alloying-treated iron-zinc alloy dip-plated steel sheet, by applying a zinc dip-plating treatment and an alloying treatment followed by an temper-rolling treatment to a cold-rolled steel sheet which is subjected to a cold-rolling treatment using, at least at a final roll stand in a cold-rolling mill, rolls of which a surface profile is adjusted so that a center-line mean roughness (Ra) is within a range of from 0.1 to 0.8 μm, and an integral value of amplitude spectra in a wavelength region of from 100 to 2,000 μm, which amplitude spectra are obtained through the Fourier transformation of a profile curve of the cold-rolled steel sheet after the cold-rolling treatment, is up to 200 $\mu m^3$; and (2) It is possible to impart a further excellent image clarity after painting to an alloying-treated iron-zinc alloy dip-plated steel sheet, by applying a zinc dip-plating treatment and an alloying treatment followed by a temper-rolling treatment to a cold-rolled steel sheet which is subjected to a cold-rolling treatment using, at least at a final roll stand in a cold-rolling mill, rolls of which a surface profile is adjusted so that a center-line mean roughness (Ra) is within a range of from 0.1 to 0.8 μm, and an integral value of amplitude spectra in a wavelength region of from 100 to 2,000 μm, which amplitude spectra are obtained through the Fourier transformation of a profile curve of the cold-rolled steel sheet after the cold-rolling treatment, is up to 500 $\mu m^3$, the above-mentioned temper-rolling treatment being carried out using rolls of which a surface profile is adjusted so that a center-line mean roughness (Ra) is up to 0.5 μm, and an integral value of amplitude spectra in a wavelength region of from 100 to 2,000 μm, which amplitude spectra are obtained through the Fourier transformation of a profile curve of the alloying-treated iron-zinc alloy dip-plated steel sheet after the temper-rolling treatment, is up to 200 $\mu m^3$.

Figure 23:
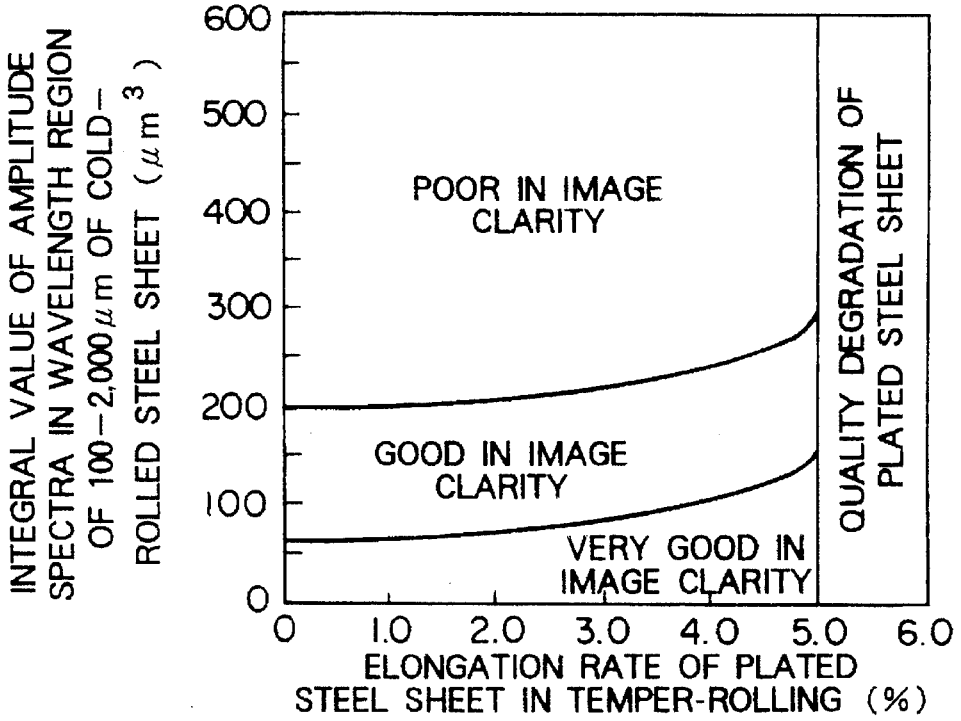
FIG. 23 is a graph illustrating, in an alloying-treated iron-zinc alloy dip-plated steel sheet manufactured by a conventional method including a conventional temper-rolling treatment using ordinary temper-rolling rolls, a relationship between an elongation rate of the plated steel sheet brought about by the temper-rolling treatment, on the one hand, and an integral value of amplitude spectra in a wavelength region of from 100 to 2,000 μm of the cold-rolled steel sheet, on the other hand.

FIG. 23 is a graph illustrating, in an alloying-treated iron-zinc alloy dip-plated steel sheet manufactured by a conventional manufacturing method including a conventional temper-rolling treatment using ordinary temper-rolling rolls, a relationship between an elongation rate of the plated steel sheet brought about by the temper-rolling treatment, on the one hand, and an integral value of amplitude spectra in a wavelength region of from 100 to 2,000 μm of the cold-rolled steel sheet, on the other hand. As shown in FIG. 23, when a conventional temper-rolling is carried out using ordinary temper-rolling rolls, a satisfactory image clarity after painting is available by using, as a substrate sheet for plating, a cold-rolled steel sheet subjected to a cold-rolling treatment so that a integral value of the amplitude spectra in the wavelength region of from 100 to 2,000 μm is up to 200 $\mu m^3$.

Figure 24:
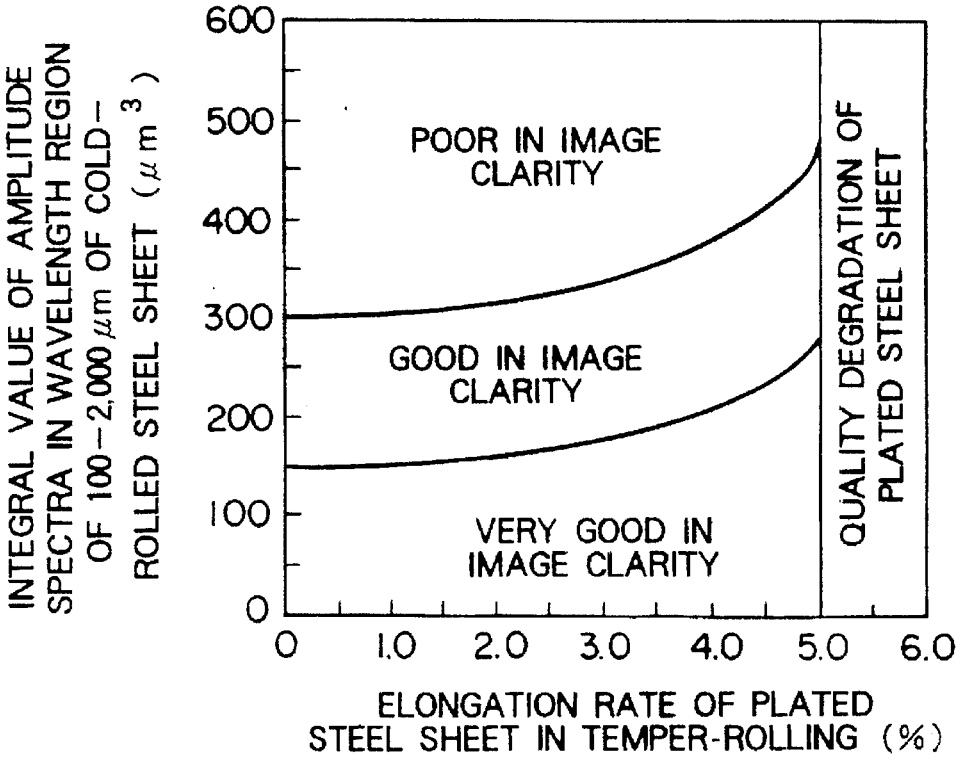
FIG. 24 is a graph illustrating, in alloying-treated iron-zinc alloy dip-plated steel sheets manufactured by any one of the methods of the third to fifth inventions, which include a temper-rolling treatment using the specific rolls, a relationship between an elongation rate of the plated steel sheet brought about by the temper-rolling treatment, on the one hand, and an integral value of amplitude spectra in a wavelength region of from 100 to 2,000 μm of the cold-rolled steel sheet, on the other hand.

FIG. 24 is a graph illustrating, in an alloying-treated iron-zinc alloy dip-plated steel sheet manufactured by any of the methods of the third to fifth inventions, which include a temper-rolling treatment using special rolls of which a surface profile is adjusted so that a center-line mean roughness (Ra) is up to 0.5 μm, and an integral value of amplitude spectra in a wavelength region of from 100 to 2,000 μm, which amplitude spectra are obtained through the Fourier transformation of a profile curve of the alloying-treated iron-zinc alloy dip-plated steel sheet after the temper-rolling treatment, is up to 200 $\mu m^3$, a relationship between an elongation rate of the plated steel sheet brought about by the temper-rolling treatment, on the one hand, and an integral value of the amplitude spectra in a wavelength region of from 100 to 2,000 $\mu m^3$ of the cold-rolled steel sheet, on the other hand. As shown in FIG. 24, it is possible to obtain a satisfactory image clarity after painting, by using, as a substrate sheet for plating, a cold-rolled steel sheet subjected to a temper-rolling treatment so that an integral value of amplitude spectra in a wavelength region of from 100 to 2,000 μm is up to 500 $\mu m^3$ relative to the elongation rate of up to 5.0% of the steel sheet in the temper-rolling treatment. Since the range of manufacturing conditions of alloying-treated zinc dip-plated steel sheets excellent in image clarity after painting becomes wider in this case, there is available an improved productivity.

Figure 25:
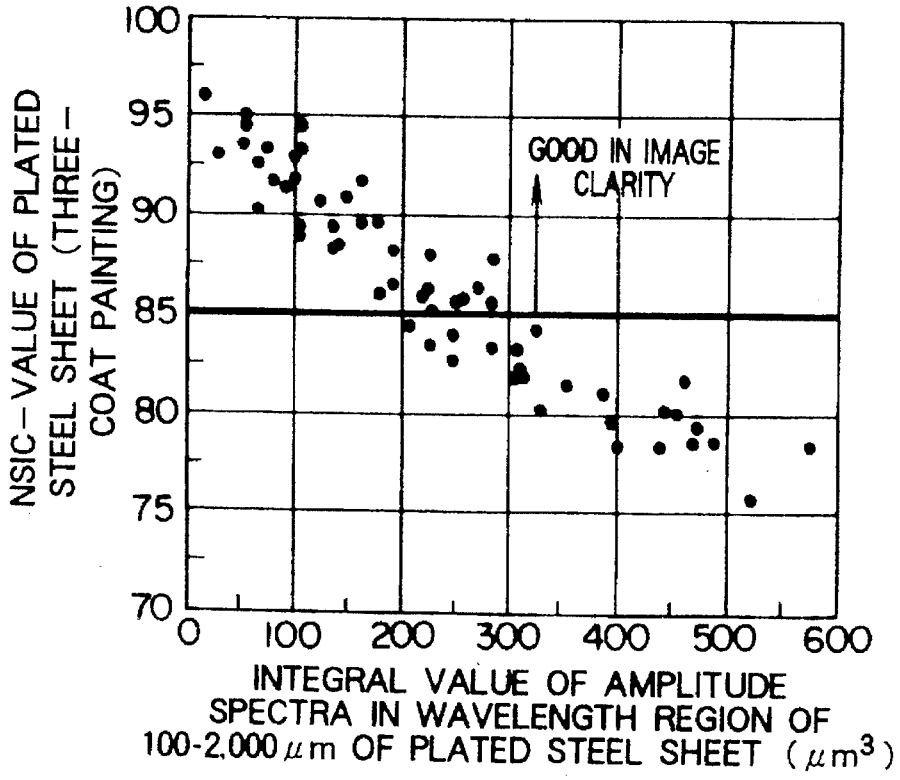
FIG. 25 is a graph illustrating a relationship between an integral value of amplitude spectra in a wavelength region of from 100 to 2,000 μm of an alloying-treated iron-zinc alloy dip-plated steel sheet and an NSIC-value thereof.

FIG. 25 is a graph illustrating a relationship between an integral value of amplitude spectra in a wavelength region of from 100 to 2,000 μm of an alloying-treated iron-zinc alloy dip-plated steel sheet and an NSIC-value thereof. As shown in FIG. 25, when an integral value of amplitude spectra in a wavelength region of from 100 to 2,000 μm of an alloying-treated iron-zinc alloy dip-plated steel sheet is up to 200 $\mu m^3$, the NSIC-value becomes at least 85, suggesting image clarity after painting on a satisfactory level.

Figure 26:
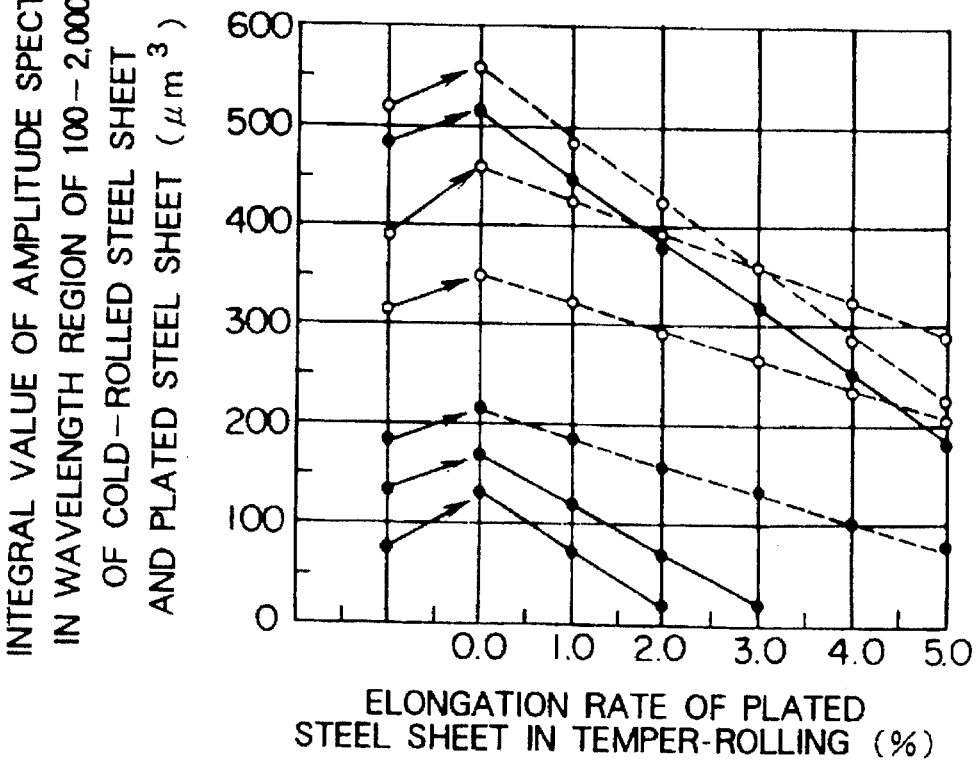
FIG. 26 is a graph illustrating a relationship between an integral value of amplitude spectra in a wavelength region of from 100 to 2,000 μm for each of a cold-rolled steel sheet and an alloying-treated iron-zinc alloy dip-plated steel sheet, on the one hand, and an elongation rate of a plated steel sheet brought about by a temper-rolling treatment.

FIG. 26 is a graph illustrating a relationship between an integral value of amplitude spectra in a wavelength region of from 100 to 2,000 μm for each of a cold-rolled steel sheet and an alloying-treated iron-zinc alloy dip-plated steel sheet, on the one hand, and an elongation rate of a plated steel sheet brought about by a temper-rolling treatment, on the other hand. In FIG. 26, the vertical line indicated as "cold-rolled steel sheet" on the abscissa represents an integral value of amplitude spectra in a wavelength region of from 100 to 2,000 μm of the cold-rolled steel sheet, and the vertical line indicated as "elongation rate: 0.0" on the abscissa represents an integral value of amplitude spectra in the above-mentioned wavelength region of the alloying-treated iron-zinc alloy dip-plated steel sheet before the temper-rolling treatment. The vertical line indicated as "elongation rate: 1.0 to 5.0" on the abscissa represents an integral value of amplitude spectra in the above-mentioned wavelength region of the alloying-treated iron-zinc alloy dip-plated steel sheet as temper-rolled with respective elongation rates. The mark "●" indicates an example within the scope of the present invention, and the mark "○" indicates an example for comparison outside the scope of the present invention. The dotted line indicates a case of using ordinary temper-rolling rolls, and the solid line, a case of using special temper-rolling rolls according to the present invention.

As shown in FIG. 26, in order to achieve an integral value of amplitude spectra of up to 200 $\mu m^3$ in a wavelength region of from 100 to 2,000 μm of the alloying-treated iron-zinc alloy dip-plated steel sheet through the temper-rolling treatment with an elongation rate of up to 5.0%, it is necessary to achieve an integral value of amplitude spectra of up to 500 $\mu m^3$ in a wavelength region of from 100 to 2,000 μm of the cold-rolled steel sheet, relative to the elongation rate during the temper-rolling.

In the methods of the third to fifth inventions, it is possible to manufacture an alloying-treated iron-zinc alloy dip-plated steel sheet having an alloying-treated iron-zinc alloy dip-plating layer provided with numerous fine concavities satisfying the following conditions, by combining the above-mentioned special conditions regarding the cold-rolling treatment and the temper-rolling treatment and the above-mentioned special conditions regarding the zinc dip-plating treatment and the alloying treatment:

(1) most of the numerous fine concavities have a depth of at least 2 μm;

(2) the number of fine concavities having a depth of at least 2 μm is within a range of from 200 to 8,200 per $mm^2$ of the alloying-treated iron-zinc alloy dip-plating layer; and (3) the fine concavities having a depth of at least 2 μm further satisfy the following conditions:

a bearing length ratio tp (2 μm) is within a range of from 30 to 90%, the bearing length ratio tp (2 μm) being expressed, when cutting a profile curve over a prescribed length thereof by means of a straight line parallel to a mean line and located below the highest peak in the profile curve by 2 μm, by a ratio in percentage of a total length of cut portions thus determined of the alloying-treated iron-zinc alloy dip-plating layer having a surface profile which corresponds to the profile curve, relative to the prescribed length of the profile curve.

Now, the reasons of limiting the cold-rolling treatment conditions and the temper-rolling treatment conditions as described above in the methods of the third to fifth inventions are described below.

A center-line mean roughness (Ra) of under 0.1 of rolls at least at the final roll stand of a cold-rolling mill is not desirable because of easy occurrence of flaws caused by the rolls in an annealing furnace. On the other hand, a center-line mean roughness (Ra) of over 0.8 of the above-mentioned rolls is not desirable, because portions having a surface profile in a wavelength region of from 100 to 2,000 μm increase on the surface of an alloying-treated iron-zinc alloy dip-plated steel sheet. The center-line mean roughness (Ra) of the rolls at least at the final roll stand of the cold-rolling mill should therefore preferably be limited within a range of from 0.1 to 0.8 μm.

When an integral value of amplitude spectra in a wavelength region of from 100 to 2,000 of a cold-rolled steel sheet is over 200 $\mu m^3$, it is impossible to keep the integral value of amplitude spectra to up to 200 $\mu m^3$ in the wavelength region of from 100 to 2,000 μm of the alloying-treated iron-zinc alloy dip-plated steel sheet after the completion of the temper-rolling treatment, under certain conditions of the temper-rolling treatment which is carried out after the zinc dip-plating treatment, resulting in the impossibility of obtaining a satisfactory image clarity after painting. The integral value of amplitude spectra in the wavelength region of from 100 to 2,000 μm should therefore preferably be kept to up to 200 $\mu m^3$.

More specifically, in case where a cold-rolled steel sheet is subjected to a temper-rolling treatment at a prescribed elongation rate after forming thereon an alloying-treated iron-zinc alloy dip-plating layer, when an integral value of amplitude spectra in a wavelength region of from 100 to 2,000 μm of a cold-rolled steel sheet is over 500 $\mu m^3$, it is impossible to keep the integral value of amplitude spectra to up to 200 $\mu m^3$ in the wavelength region of from 100 to 2,000 μm of the alloying-treated iron-zinc alloy dip-plated steel sheet after the completion of the temper-rolling treatment, even when the temper-rolling treatment is appropriately carried out, thus making it impossible to obtain a satisfactory image clarity after painting. Therefore, the integral value of amplitude spectra in the wavelength region of from 100 to 2,000 μm of the cold-rolled steel sheet should preferably be kept to up to 500 $\mu m^3$.

A center-line mean roughness (Ra) of over 0.5 of rolls in the temper-rolling treatment is not desirable, because portions having a surface profile in a wavelength region of from 100 to 2,000 μm increase on the surface of an alloying-treated iron-zinc alloy dip-plated steel sheet. The center-line mean roughness (Ra) of the rolls in the temper-rolling treatment should therefore preferably be kept to up to 0.5 μm.

When an integral value of amplitude spectra in a wavelength region of from 100 to 2,000 μm of an alloying-treated iron-zinc alloy dip-plated steel sheet after the completion of the temper-rolling treatment is over 200 $\mu m^3$, image clarity after painting of the alloying-treated iron-zinc alloy dip-plated steel sheet is deteriorated. The integral value of amplitude spectra in the wavelength region of from 100 to 2,000 μm of the alloying-treated iron-zinc alloy dip-plated steel sheet after the completion of the temper-rolling treatment should therefore preferably be kept to up to 200 $\mu m^3$.

With an elongation rate of under 0.3% in the temper-rolling treatment, the integral value of amplitude spectra in the wavelength region of from 100 to 2,000 μm of the alloying-treated iron-zinc alloy dip-plated steel sheet cannot be kept to up to 200 $\mu m^3$, making it impossible to impart an excellent image clarity after painting to the alloying-treated iron-zinc alloy dip-plated steel sheet. With an elongation rate of over 5.0%, on the other hand, the quality of the alloying-treated iron-zinc alloy dip-plated steel sheet is deteriorated under the effect of working-hardening. Therefore, the elongation rate in the temper-rolling treatment should preferably be limited within a range of from 0.3 to 5.0%.

Now, the alloying-treated iron-zinc alloy dip-plated steel sheet of the first invention is described further in detail by means of examples while comparing with examples for comparison.

EXAMPLE 1 OF THE FIRST INVENTION

Various alloying-treated iron-zinc dip-plated steel sheets within the scope of the present invention, of which the plating weight was adjusted to 60 $g/m^2$ per surface of the steel sheet were manufactured by means of a continuous zinc dip-plating line with the use of a plurality of cold-rolled steel sheets having a thickness of 0.8 mm. More specifically, each of the cold-rolled steel sheets was annealed in a continuous zinc dip-plating line, and the thus annealed cold-rolled steel sheet was passed through a zinc dip-plating bath having a chemical composition comprising zinc, 0.17 wt. % aluminum and incidental impurities, to subject the cold-rolled steel sheet to a zinc dip-plating treatment, thereby forming a zinc dip-plating layer on each of the both surfaces of the cold-rolled steel sheet. Then, the cold-rolled steel sheet having zinc dip-plating layers formed on the both surfaces thereof, was subjected to an alloying treatment at a temperature of 510° C. in an alloying furnace, thereby forming an alloying-treated iron-zinc alloy dip-plating layer on each of the both surfaces of the cold-rolled steel sheet. The thus formed alloying-treated iron-zinc alloy dip-plating layer had numerous fine concavities having a depth of at least 2 μm. The number of fine concavities having a depth of at least 2 μm per $mm^2$ of the alloying-treated iron-zinc alloy dip-plating layer, was caused to change by using cold-rolled steel sheets having different crystal grain sizes. In this Example 1, the crystal grain size was adjusted by changing the chemical composition and the annealing conditions of the cold-rolled steel sheet. Adjustment of the crystal grain size may cause a variation of quality of the cold-rolled steel sheet. When a change in quality of the cold-rolled steel sheet is to be avoided, it suffices to, during the passage of the cold-rolled steel sheet through the continuous zinc dip-plating line, anneal the steel sheet after giving a strain on the surface portion of the steel sheet in the annealing furnace. This permits adjustment of the size of crystal grains of only the outermost surface portion of the steel sheet and enables to keep a constant crystal grain size in the interior of the steel sheet, thus making it possible to manufacture steel sheets which are uniform in quality but different in crystal grain size of the surface portion.

Samples within the scope of the present invention (hereinafter referred to as the "samples of the invention") Nos. 4 to 10 and 12 to 14 were prepared from the thus manufactured plurality of alloying-treated iron-zinc alloy dip-plated steel sheets. For comparison purposes, samples outside the scope of the present invention (hereinafter referred to as the "samples for comparison") Nos. 1 to 3, 11, 15 and 16 were prepared from alloying-treated iron-zinc alloy dip-plated steel sheets outside the scope of the present invention. The samples for comparison Nos. 1 to 3 were prepared from alloying-treated iron-zinc alloy dip-plated steel sheets manufactured in accordance with the above-mentioned prior art 3, and the sample for comparison No. 16 was prepared from an alloying-treated iron-zinc alloy dip-plated steel sheet manufactured in accordance with the above-mentioned prior art 4.

Then, for each of the samples of the invention Nos. 4 to 10 and 12 to 14, and the samples for comparison Nos. 1 to 3, 11, 15 and 16, press-formability and powdering resistance were investigated in accordance with test methods as described below.

Figure 28:
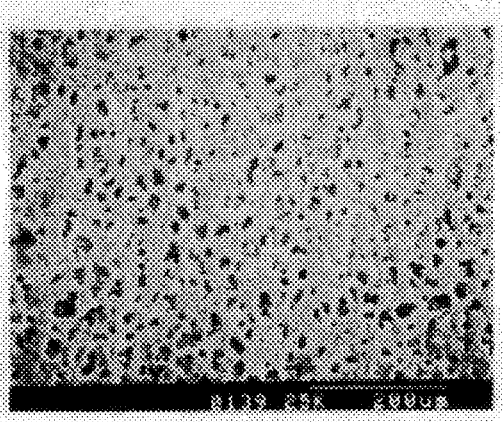
FIG. 28 is a scanning-type electron micro-photograph of a surface structure of an alloying-treated iron-zinc alloy dip-plated steel sheet of a first embodiment of the first invention.
Figure 29:
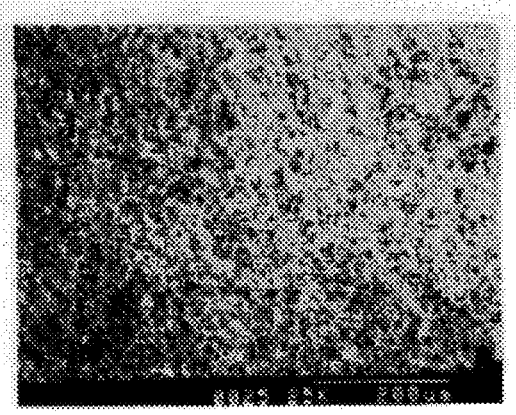
FIG. 29 (PRIOR ART)
FIG. 29 is a scanning-type electron micro-photograph of a surface structure of a conventional alloying-treated iron-zinc alloy dip-plated steel sheet.

The surface of each sample was observed with the use of a scanning-type electron microscope to investigate the forming of numerous fine concavities in the alloying-treated iron-zinc alloy dip-plating layer. FIG. 28 is a scanning-type electron microphotograph of the surface structure of the sample of the invention No. 4 as a typical example of the alloying-treated iron-zinc alloy dip-plated steel sheet of the first embodiment of the first invention, and FIG. 29 is a scanning-type electron microphotograph of the surface structure of the sample for comparison No. 1 as a typical example of the conventional alloying-treated iron-zinc alloy dip-plated steel sheet. As is clear from FIGS. 28 and 29, numerous fine concavities having a depth of at least 2 μm, which were not present on the alloying-treated iron-zinc alloy dip-plating layer of the conventional alloying-treated iron-zinc alloy dip-plated steel sheet, were formed on the alloying-treated iron-zinc alloy dip-plating layer of the sample of the invention No. 4.

The number of fine concavities having a depth of at least 2 μm was determined, by observing the surface of each sample with the use of a scanning-type electron microscope, measuring the number of concavities in an area of 25 $mm^2$ in a photograph enlarged to 100 magnifications, and converting the measured number into the number in an area of 1 $mm^2$. For each sample, the number of fine concavities having a depth of at least 2 μm per $mm^2$ of the alloying-treated iron-zinc alloy dip-plating layer, the ratio in percentage of the total opening area per a unit area of fine concavities having a depth of at least 2 μm relative to the unit area (hereinafter referred to as the "area ratio of concavities"), and the average area of fine concavities having a depth of at least 2 μm are shown in Table 1.

TABLE 1

| Sample No. | Number of concavities per mm² | Area ratio of concavities (%) | Average area of concavities (μm²) | Press-formability: Coefficient of friction | Press-formability: Evaluation | Evaluation of powdering resistance | Bearing length ratio tp (80%) (%) | Remarks |
|---|---|---|---|---|---|---|---|---|
| 1 | 36 | 13 | 3670 | 0.168 | Poor | Poor | 93 | Sample for comparison (Prior art 3) |
| 2 | 64 | 40 | 6250 | 0.165 | Poor | Poor | 92 | Sample for comparison (Prior art 3) |
| 3 | 128 | 40 | 3100 | 0.161 | Poor | Poor | 92 | Sample for comparison (Prior art 3) |
| 4 | 201 | 40 | 1990 | 0.149 | Good | Good | 92 | Sample of the invention |
| 5 | 400 | 40 | 1000 | 0.148 | Good | Good | 95 | Sample of the invention |
| 6 | 512 | 40 | 774 | 0.146 | Good | Good | 95 | Sample of the invention |
| 7 | 1024 | 40 | 385 | 0.144 | Good | Good | 91 | Sample of the invention |
| 8 | 2048 | 40 | 194 | 0.144 | Good | Good | 92 | Sample of the invention |
| 9 | 4096 | 40 | 90 | 0.145 | Good | Good | 92 | Sample of the invention |
| 10 | 8192 | 40 | 50 | 0.148 | Good | Good | 92 | Sample of the invention |
| 11 | 1024 | 90 | 865 | 0.142 | Good | Poor | 92 | Sample for comparison |
| 12 | 1024 | 70 | 670 | 0.143 | Good | Good | 93 | Sample of the invention |
| 13 | 1024 | 40 | 385 | 0.144 | Good | Good | 95 | Sample of the invention |
| 14 | 1024 | 10 | 102 | 0.146 | Good | Good | 92 | Sample of the invention |
| 15 | 1024 | 5 | 48 | 0.158 | Poor | Good | 92 | Sample for comparison |
| 16 | 400 | 5 | 200 | 0.158 | Poor | Good | 92 | Sample for comparison (Prior art 4) |

Figure 30:
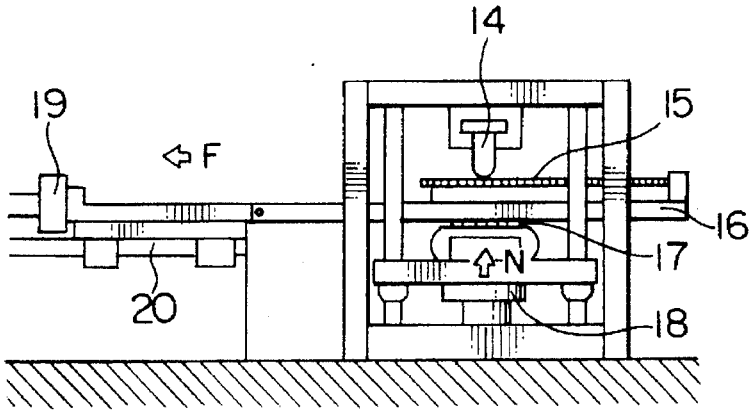
FIG. 30 is a schematic front view illustrating a frictional coefficient measurer used for evaluating press-formability.

Press-formability was tested in accordance with the following method. More specifically, a coefficient of friction of the surface of the alloying-treated iron-zinc alloy dip-plated steel sheet for evaluating press-formability, was measured with the use of a frictional coefficient measurer as shown in FIG. 30. A bead 14 used in this test comprised tool steel specified in SKD 11 of the Japanese Industrial Standard (JIS). There was a contact area of 3 mm×10 mm between the bead 14 and a sample 15 (i.e., each of the samples of the invention Nos. 4 to 10 and 12 to 14, and the samples for comparison Nos. 1 to 3, 11, 15 and 16). The sample 15 applied with a lubricant oil on the both surfaces thereof was fixed on a test stand 16 on rollers 17. While pressing the bead 14 against the sample 15 under a pressing load (N) of 400 kg, the test stand 16 was moved along a rail 20 to pull the sample 15 together with the test stand 16 at a rate of 1 m/minute. A pulling load (F) and the pressing load (N) at this moment were measured with the use of load cells 18 and 19. A coefficient of friction (F/N) of the sample 15 was calculated on the basis of the pulling load (F) and the pressing load (N) thus measured. The lubricant oil applied onto the surface of the sample 15 was "NOX RUST 530F" manufactured by Nihon Perkerizing Co., Ltd. The criteria for evaluation of press-formability were as follows:

Value of coefficient of friction (F/N) of under 0.150: good press-formability

Value of coefficient of friction (F/N) of at least 0.150: poor press-formability.

Figure 31:
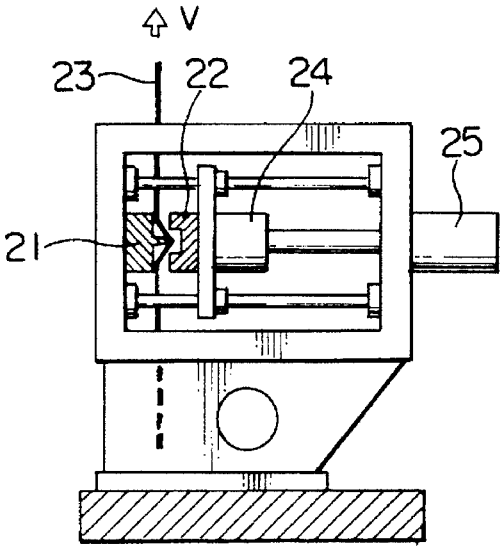
FIG. 31 is a schematic front view illustrating a draw-bead tester used for evaluating powdering resistance.
Figure 32:
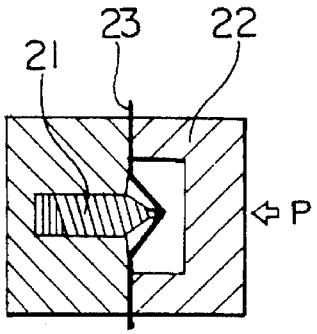
FIG. 32 is a partially enlarged schematic front view of the draw-bead tester shown in FIG. 31.

Powdering resistance was tested in accordance with the following method. More specifically, powdering resistance, which serves as an index of peeling property of an alloying-treated iron-zinc alloy dip-plating layer, was evaluated as follows, using a draw-bead tester as shown in FIGS. 31 and 32. First, an alloying-treated iron-zinc alloy dip-plating layer on a surface not to be measured of a sample 23 (i.e., each of the samples of the invention Nos. 4 to 10 and 12 to 14, and the samples for comparison Nos. 1 to 3, 11, 15 and 16) having a width of 30 mm and a length of 120 mm, was removed through dissolution by a diluted hydrochloric acid. Then, the sample 23 was degreased, and the weight of the sample 23 was measured. Then, a lubricant oil was applied onto the both surfaces of the sample 23, which was then inserted into a gap between a bead 21 and a female die 22 of the draw-bead tester. Then, the female die 22 was pressed through the sample 23 against the bead 21 under a pressure (P) of 500 kgf/cm² by operating a hydraulic device 25. A pressing pressure (P) was measured with the use of a load cell 24. The sample 23 thus placed between the bead 21 and the female die 22 was then pulled out from the draw-bead tester at a pulling speed (V) of 200 mm/minute to squeeze same. The lubricant oil applied onto the surfaces of the sample 15 was "NOX RUST 530F" made by Nihon Parkerizing Co., Ltd. Then, the sample 23 was degreased. An adhesive tape was stuck onto a surface to be measured, and then the adhesive tape was peeled off from the surface to be measured. Then, the sample 23 was degreased again and weighed. Powdering resistance was determined from the difference in weight between before and after the test. The criteria for evaluation of powdering resistance were as follows:

Amount of powdering of under 5 g/m²: good powdering resistance

Amount of powdering of at least 5 g/m²: poor powdering resistance.

The results of the above-mentioned tests of press-formability and powdering resistance are shown also in Table 1.

As is clear from Table 1, the samples for comparison Nos. 1 to 3 were poor in press-formability because the number of fine concavities having a depth of at least 2 μm was small outside the scope of the present invention, and the coefficient of friction was larger as compared with the samples of the invention. Since the samples for comparison Nos. 1 to 3 were manufactured by temper-rolling an alloying-treated iron-zinc alloy dip-plated steel sheet with the use of dull rolls of which the surface roughness had been adjusted, the alloying-treated iron-zinc alloy dip-plating layers of the samples for comparison Nos. 1 to 3 had flaws caused during the temper-rolling. Therefore, in the samples for comparison Nos. 1 to 3, the alloying-treated iron-zinc alloy dip-plating layer tended to easily be peeled off, and consequently, the samples for comparison Nos. 1 to 3 were poor in powdering resistance.

The sample for comparison No. 11, which had a large area ratio of concavities outside the scope of the present invention, showed a small coefficient of friction, resulting in a good press-formability, but a poor powdering resistance.

The samples for comparison Nos. 15 and 16, which had a small area ratio of concavities outside the scope of the present invention, showed a coefficient of friction larger than that of the samples of the invention, resulting in a poor press-formability.

In contrast, the samples of the invention Nos. 4 to 10 and 12 to 14 were good in press-formability and powdering resistance.

EXAMPLE 2 OF FIRST INVENTION

Various alloying-treated iron-zinc alloy dip-plated steel sheets within the scope of the present invention were manufactured by adding, to the manufacturing conditions in the above-mentioned Example 1 of the first invention, the following conditions regarding the numerous fine concavities having a depth of at least 2 μm, that:

a bearing length ratio tp (80%) is up to 90%, the bearing length ratio tp (80%) being expressed, when cutting a roughness curve having a cutoff value of 0.8 mm over a prescribed length thereof by means of a straight line parallel to a mean line and located below the highest peak by 80% of a vertical distance between the highest peak and the lowest trough in the roughness curve, by a ratio in percentage of a total length of cut portions thus determined of the alloying-treated iron-zinc alloy dip-plating layer having a surface profile which corresponds to the roughness curve, relative to the prescribed length of the roughness curve.

Samples of the invention Nos. 17 to 28 were prepared from the thus manufactured alloying-treated iron-zinc alloy dip-plated steel sheets. Then, a test of the above-mentioned press-formability was carried out on each of the samples of the invention Nos. 17 to 28. The test results are shown in Table 2.

Determination of the bearing length ratio tp (80%) was accomplished by measuring a roughness curve (a cutoff value of 0.8 mm) of surfaces of the samples with the use of a stylus profilometer "SURFCOM 570A" made by Tokyo Seimitsu Co., Ltd.

For all the samples, values of the bearing length ratio tp (80%), the number of fine concavities having a depth of at least 2 μm per $mm^2$ of the alloying-treated iron-zinc alloy dip-plating layer, and the area ratio of concavities are also shown in Table 2. For information, values of the bearing length ratio tp (80%) of each of the samples in the Example 1 of the first invention are also shown in Table 1.

As is clear from Table 2, the samples of the invention Nos. 18, 20, 22, 24, 26 and 28 manufactured so that the fine concavities having a depth of at least 2 μm satisfied the above-mentioned conditions regarding the bearing length ratio tp (80%), had a very good press-formability.

Now, the alloying-treated iron-zinc alloy dip-plated steel sheet of the second invention is described below further in detail by means of examples while comparing with examples for comparison.

EXAMPLE 1 OF THE SECOND INVENTION

Various alloying-treated iron-zinc alloy dip-plated steel sheets within the scope of the present invention were manufactured in accordance with the same method as in the above-mentioned Example 1 of the first invention.

Then, the thus manufactured plurality of alloying-treated iron-zinc alloy dip-plated steel sheets were subjected to a temper-rolling treatment at an elongation rate of at least 1.0%, with the use of skin-pass rolls for bright-finishing having roll surfaces adjusted to have a center-line mean roughness (Ra) of 0.2 μm. During the above-mentioned temper-rolling treatment, the value of bearing length ratio tp (2 μm) was changed by altering the elongation rate. The bearing length ratio tp (2 μm) was determined by measuring a profile curve of the surface of the plated steel sheet with the use of a stylus profilometer "SURCOM 570A" made by Tokyo Seimitsu Co., Ltd, as in the Example 2 of the first invention.

TABLE 2

| Sample of the invention No. | Number of concavities per $mm^2$ | Area ratio of concavities (%) | Bearing length ratio tp (80%) (%) | Press-formability | |
|---|---|---|---|---|---|
| | | | | Coefficient of friction | Evaluation |
| 17 | 201 | 50 | 95 | 0.149 | Good |
| 18 | 201 | 50 | 80 | 0.142 | Very good |
| 19 | 512 | 50 | 95 | 0.146 | Good |
| 20 | 512 | 50 | 70 | 0.142 | Very good |
| 21 | 2048 | 50 | 95 | 0.146 | Good |
| 22 | 2048 | 50 | 80 | 0.140 | Very good |
| 23 | 8192 | 70 | 95 | 0.144 | Good |
| 24 | 8192 | 70 | 80 | 0.140 | Very good |
| 25 | 1024 | 40 | 95 | 0.145 | Good |
| 26 | 1024 | 40 | 70 | 0.139 | Very good |
| 27 | 1024 | 10 | 95 | 0.148 | Good |
| 28 | 1024 | 10 | 90 | 0.142 | Very good |

The criteria for evaluation of press-formability were as follows:

Value of coefficient of friction (F/N) of up to 0.142: Very good press-formability Value of coefficient of friction (F/N) of from over 0.142 to under 0.150: Good press-formability Value of coefficient of friction (F/N) of at least 0.150: Poor press-formability.

Samples within the scope of the present invention (hereinafter referred to as the "samples of the invention") Nos. 32 to 38 and 40 to 42 were prepared from the plurality of alloying-treated iron-zinc alloy dip-plated steel sheets thus subjected to the temper-rolling treatment. For comparison purposes, samples outside the scope of the present invention (hereinafter referred to as the "samples for comparison") Nos. 29 to 31, 39, 43 and 44 were prepared from alloying-treated iron-zinc alloy dip plated steel sheets outside the scope of the present invention. The samples for comparison Nos. 29 to 31 were prepared from the alloying-treated iron-zinc alloy dip-plated steel sheets manufactured in accordance with the above-mentioned prior art 3, and the sample for comparison No. 44 was prepared from the alloying-treated iron-zinc alloy dip-plated steel sheet manufactured in accordance with the above-mentioned prior art 4.

Then, for each of the samples of the invention Nos. 32 to 38 and 40 to 42, and the samples for comparison Nos. 29 to 31, 39, 43 and 44, press-formability, powdering resistance and image clarity after painting were investigated in accordance with test methods as described below.

The number of fine concavities having a depth of at least 2 μm formed on the alloying-treated iron-zinc alloy dip-plating layer of each sample was determined in accordance with the same method as in the Example 1 of the first invention. As in the Example 1 of the first invention, it was confirmed that numerous fine concavities having a depth of at least 2 μm, which were not present on the alloying-treated iron-zinc alloy dip-plating layer of a conventional alloying-treated iron-zinc dip-plated steel sheet, were formed on the alloying-treated iron-zinc alloy dip-plating layer of the Example 1 of the second invention. For each sample, the number of fine concavities having a depth of at least 2 μm per $mm^2$ of the alloying-treated iron-zinc alloy dip-plating layer, the average area of fine concavities having a depth of at least 2 μm, and the bearing length ratio tp (2 μm) are shown in Table 3.

Image clarity after painting was tested in accordance with the following method. More specifically, each sample was subjected to a chemical treatment with the use of a chemical treatment liquid "PB-L3080" made by Nihon Perkerizing Co., Ltd., and then to a three-coat painting which comprised an electropainting step, an intermediate-painting step, and a top-painting step with the use of paints "E1-2000" for the electropainting, "TP-37 GRAY" for the intermediate-painting and "TM-13(RC)" for the top-painting, made by Kansai Paint Co., Ltd. For each of the thus painted samples, an evaluation value of image clarity after painting, i.e., an NSIC-value, was measured with the use of an "NSIC-type image clarity measurement instrument" made by Suga Test Instrument Co., Ltd. A black polished glass has an NSIC-value of 100, and an NSIC-value closer to 100 corresponds to a better image clarity after painting. The results of the test of image clarity after painting are shown also in Table 3.

As is clear from Table 3, the samples for comparison Nos. 29 to 31 were poor in press-formability because the number of fine concavities having a depth of at least 2 μm was small outside the scope of the present invention, and the coefficient of friction was larger as compared with the samples of the invention. In addition, the samples for comparison Nos. 29 to 31 had a smaller NSIC-value as compared with that of the samples of the invention, resulting in a poor image clarity after painting. Furthermore, since the samples for comparison Nos. 29 to 31 were manufactured by temper-rolling the alloying-treated iron-zinc alloy dip-plated steel sheets with the use of the dull rolls of which the surface roughness had

TABLE 3

| Sample No. | Number of cavities per $mm^2$ | Bearing length ratio (2 μm) (%) | Average area of concavities ($\mu m^2$) | Press-formability: Coefficient of friction | Press-formability: Evaluation | Image clarity after painting: NSIC-value | Image clarity after painting: Evaluation | Evaluation of powdering resistance | Remarks |
|---|---|---|---|---|---|---|---|---|---|
| 29 | 36 | 85 | 3603 | 0.168 | Poor | 70 | Poor | Poor | Sample for comparison (Prior art 3) |
| 30 | 64 | 60 | 6250 | 0.165 | Poor | 75 | Poor | Poor | Sample for comparison (Prior art 3) |
| 31 | 128 | 60 | 3100 | 0.161 | Poor | 80 | Poor | Poor | Sample for comparison (Prior art 3) |
| 32 | 201 | 60 | 1990 | 0.149 | Good | 91 | Good | Good | Sample of the invention |
| 33 | 400 | 60 | 1000 | 0.148 | Good | 93 | Good | Good | Sample of the invention |
| 34 | 512 | 60 | 774 | 0.146 | Good | 91 | Good | Good | Sample of the invention |
| 35 | 1024 | 60 | 385 | 0.144 | Good | 92 | Good | Good | Sample of the invention |
| 36 | 2048 | 60 | 194 | 0.144 | Good | 90 | Good | Good | Sample of the invention |
| 37 | 4096 | 60 | 90 | 0.145 | Good | 94 | Good | Good | Sample of the invention |
| 38 | 8192 | 60 | 50 | 0.148 | Good | 97 | Good | Good | Sample of the invention |
| 39 | 1024 | 10 | 865 | 0.142 | Good | 75 | Poor | Good | Sample for comparison |
| 40 | 1024 | 30 | 670 | 0.143 | Good | 90 | Good | Good | Sample of the invention |
| 41 | 1024 | 60 | 385 | 0.144 | Good | 94 | Good | Good | Sample of the invention |
| 42 | 1024 | 90 | 102 | 0.146 | Good | 97 | Good | Good | Sample of the invention |
| 43 | 1024 | 95 | 48 | 0.158 | Poor | 97 | Good | Good | Sample for comparison |
| 44 | 400 | 20 | 2000 | 0.158 | Poor | 65 | Poor | Good | Sample for comparison (Prior art 4) |

Press-formability was tested in accordance with the same method as in the Example 1 of the first invention. The criteria for evaluation of press-formability were also the same as those in the Example 1 of the first invention. The results of the press-formability test are shown also in Table 3.

Powdering resistance was tested in accordance with the same method as in the Example 1 of the first invention. The criteria for evaluation of powdering resistance were also the same as those in the Example 1 of the first invention. The results of the powdering resistance test are shown also in Table 3.

been adjusted, the alloying-treated iron-zinc alloy dip-plating layers of the samples for comparison Nos. 29 to 31 had flaws caused during the temper-rolling. In the samples for comparison Nos. 29 to 31, the alloying-treated iron-zinc alloy dip-plating layer tended to easily be peeled off, and consequently, the samples for comparison Nos. 29 to 31 were poor in powdering resistance.

The sample for comparison No. 39, which had a small bearing length ratio tp (2 μm) outside the scope of the present invention, showed a smaller NSIC-value as compared with that of the samples of the invention, resulting in a poor image clarity after painting.

The sample for comparison No. 43, which had a large bearing length ratio tp (2 μm) outside the scope of the present invention, showed a larger coefficient of friction as compared with that of the samples of the invention, resulting in a poor press-formability.

The sample for comparison No. 44, which had a small bearing length ratio tp (2 μm) outside the scope of the present invention, showed in a larger coefficient of friction as compared with that of the samples of the invention, resulting in a poor press-formability. In addition, the sample for comparison No. 44 had a smaller NSIC-value as compared with that of the samples of the invention, and as a result, showed a poor image clarity after painting.

In contrast, all the samples of the invention Nos. 32 to 38 and 40 to 42 were good in all of press-formability, powdering resistance and image clarity after painting.

EXAMPLE 2 OF THE SECOND INVENTION

Various alloying-treated iron-zinc alloy dip-plated steel sheets within the scope of the present invention were manufactured by adding, to the manufacturing conditions in the above-mentioned Example 1 of the second invention, the following conditions regarding the numerous fine concavities having a depth of at least 2 μm, that:

a bearing length ratio tp (80%) is up to 90%, the bearing length ratio tp (80%) being expressed, when cutting a profile curve over a prescribed length thereof by means of a straight line parallel to a mean line and located below the highest peak by 80% of a vertical distance between the highest peak and the lowest trough in the profile curve, by a ratio in percentage of a total length of cut portions thus determined of the alloying-treated iron-zinc alloy dip-plating layer having a surface profile which corresponds to the profile curve, relative to the prescribed length of the profile curve.

Samples of the invention Nos. 45 to 56 were prepared from the thus manufactured alloying-treated iron-zinc alloy dip-plated steel sheets. Then, tests on the above-mentioned press-formability and image clarity after painting were carried out for each of the samples of the invention Nos. 45 to 56. The test results are shown in Table 4.

TABLE 4

| Sample of the invention No. | Number of concavities per mm² | Bearing length raatio tp (2 μm) (%) | Bearing length ratio tp (80%) (%) | Image clarity after painting | | Press-formability | |
|---|---|---|---|---|---|---|---|
| | | | | NSIC-value | Evaluation | Coefficient of friction | Evaluation |
| 45 | 201 | 50 | 95 | 92 | Good | 0.149 | Good |
| 46 | 201 | 50 | 80 | 90 | Good | 0.142 | Very good |
| 47 | 512 | 50 | 95 | 92 | Good | 0.146 | Good |
| 48 | 512 | 50 | 70 | 91 | Good | 0.142 | Very good |
| 49 | 2048 | 50 | 95 | 93 | Good | 0.146 | Good |
| 50 | 2048 | 50 | 80 | 91 | Good | 0.140 | Very good |
| 51 | 8192 | 30 | 95 | 92 | Good | 0.144 | Good |
| 52 | 8192 | 30 | 80 | 90 | Good | 0.140 | Very good |
| 53 | 1024 | 60 | 95 | 94 | Good | 0.145 | Good |
| 54 | 1024 | 60 | 70 | 90 | Good | 0.139 | Very good |
| 55 | 1024 | 90 | 95 | 90 | Good | 0.148 | Good |
| 56 | 1024 | 90 | 90 | 90 | Good | 0.142 | Very good |

The criteria for evaluation of press-formability were as follows:

Value of coefficient of friction (F/N) of up to 0.142: Very good press-formability Value of coefficient of friction (F/N) of from over 0.142 to under 0.150: Good press-formability Value of coefficient of friction (F/N) of at least 0.150: Poor press-formability.

Determination of the bearing length ratio tp (2 μm) and the bearing length ratio tp (80%) was accomplished by measuring a profile curve of the surfaces of the samples with the use of a stylus profilometer "SURFCOM 570A" made by Tokyo Seimitsu Co., Ltd. as in the Example 2 of the first invention.

For all the samples, values of the number of fine concavities having a depth of at least 2 μm per mm² of the alloying-treated iron-zinc alloy dip-plating layer, the bearing length ratio tp (2 μm) and the bearing length ratio tp (80%) are also shown in Table 4.

As is clear from Table 4, the samples of the invention Nos. 46, 48, 50, 52, 54 and 56, which were manufactured so that the fine concavities having a depth of at least 2 μm satisfied the above-mentioned conditions regarding the bearing length ratio tp (80%), had a very good press-formability, and all the samples of the invention Nos. 45 to 56 were good in image clarity after painting.

Now, the method of the third invention for manufacturing an alloying-treated iron-zinc alloy dip-plated steel sheet of the present invention, is described below further in detail by means of examples while comparing with examples for comparison.

EXAMPLE 1 OF THE THIRD INVENTION

Various alloying-treated iron-zinc alloy dip-plated steel sheets having a prescribed plating weight and within the scope of the present invention, were manufactured by means of a continuous zinc dip-plating line, with the use of a plurality of IF steel (abbreviation of "interstitial atoms free steel")-based cold-rolled steel sheets having a thickness of 0.8 mm. More specifically, each of the above-mentioned plurality of cold-rolled steel sheets was subjected to a zinc dip-plating treatment, an alloying treatment and a temper-rolling treatment in accordance with the conditions within the scope of the third invention while changing the conditions of these treatments. The thus manufactured alloying-treated iron-zinc alloy dip-plated steel sheets comprised a plurality of plated steel sheets each having a plating weight of 30 g/m² per surface of the steel sheet, a plurality of plated steel sheets each having a plating weight of 45 g/m² per surface of the steel sheet, and a plurality of plated steel sheets each having a plating weight of 60 g/m² per surface of the steel sheet. A plurality of samples within the scope of the present invention (hereinafter referred to as the "samples of the invention") were prepared from the thus manufactured plurality of alloying-treated iron-zinc alloy dip-plated steel sheets each having an alloying-treated iron-zinc alloy dip-plating layer formed on each of the both surfaces thereof.

For comparison purposes, various alloying-treated iron-zinc alloy dip-plated steel sheets outside the scope of the present invention, were manufactured by subjecting a plurality of cold-rolled steel sheets to a zinc dip-plating treatment, an alloying treatment and a temper-rolling treatment under conditions in which at least one of the zinc dip-plating treatment condition and the alloying treatment condition was outside the scope of the present invention. The thus manufactured alloying-treated iron-zinc alloy dip-plated steel sheets comprised a plurality of plated steel sheets each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples outside the scope of the present invention (hereinafter referred to as the "samples for comparison") were prepared from the thus manufactured plurality of alloying-treated iron-zinc alloy dip-plated steel sheets each having an alloying-treated iron-zinc alloy dip-plating layer formed on each of the both surfaces thereof.

For each of the samples of the invention and the samples for comparison, the plating weight, the aluminum content in the zinc dip-plating bath, the temperature of the cold-rolled steel sheet and the bath temperature in the zinc dip-plating treatment; the initial reaction temperature and the alloying treatment temperature in the alloying treatment; and the elongation rate in the temper-rolling treatment, are shown in Tables 5 to 8.

TABLE 5

| Sample No. | Plating weight (g/m$^2$) | Al concentration in bath (wt. %) | Initial reaction temp. (°C.) | Sheet temp. (°C.) | Bath temp. (°C.) | Alloying temp. (°C.) | Elongation rate of temper-rolling (%) | Press-formability: Coefficient of friction | Press-formability: Evaluation | Powdering resistance: Amount of peel-off (g/m$^2$) | Powdering resistance: Evaluation | Image clarity after painting: NSIC-value | Image clarity after painting: Evaluation | Remarks |
|---|---|---|---|---|---|---|---|---|---|---|---|---|---|---|
| 57 | 45 | 0.04 | 550 | 550 | 550 | 510 | 0.7 | 0.180 | Poor | 8.0 | Poor | 90.0 | Good | Sample for comparison |
| 58 | 45 | 0.06 | 460 | 460 | 460 | 510 | 0.7 | 0.178 | Poor | 4.8 | Good | 87.0 | Good | Sample for comparison |
| 59 | 45 | 0.06 | 510 | 510 | 510 | 510 | 0.0 | 0.149 | Good | 4.8 | Good | 75.0 | Poor | Sample for comparison |
| 60 | 45 | 0.06 | 510 | 510 | 510 | 510 | 0.7 | 0.145 | Good | 4.8 | Good | 90.0 | Good | Sample of the invention |
| 61 | 45 | 0.06 | 570 | 570 | 570 | 510 | 0.7 | 0.145 | Good | 4.8 | Good | 90.0 | Good | Sample of the invention |
| 62 | 45 | 0.06 | 610 | 610 | 610 | 510 | 0.7 | 0.155 | Poor | 4.9 | Good | 90.0 | Good | Sample for comparison |
| 63 | 45 | 0.09 | 460 | 460 | 460 | 510 | 0.7 | 0.175 | Poor | 4.5 | Good | 88.0 | Good | Sample for comparison |
| 64 | 45 | 0.09 | 510 | 510 | 510 | 510 | 0.0 | 0.148 | Good | 4.8 | Good | 74.0 | Poor | Sample for comparison |
| 65 | 45 | 0.09 | 510 | 510 | 510 | 510 | 0.7 | 0.144 | Good | 4.8 | Good | 90.0 | Good | Sample of the invention |
| 66 | 45 | 0.09 | 570 | 570 | 570 | 510 | 0.7 | 0.143 | Good | 4.8 | Good | 90.0 | Good | Sample of the invention |
| 67 | 45 | 0.09 | 610 | 610 | 610 | 510 | 0.7 | 0.162 | Poor | 4.8 | Good | 90.0 | Good | Sample for comparison |
| 68 | 45 | 0.12 | 460 | 460 | 460 | 510 | 0.7 | 0.165 | Poor | 4.5 | Good | 88.0 | Good | Sample for comparison |
| 69 | 45 | 0.12 | 510 | 510 | 510 | 510 | 0.0 | 0.148 | Good | 4.3 | Good | 76.0 | Poor | Sample for comparison |
| 70 | 45 | 0.12 | 510 | 510 | 510 | 510 | 0.7 | 0.144 | Good | 4.3 | Good | 91.0 | Good | Sample of the invention |
| 71 | 45 | 0.12 | 510 | 510 | 460 | 510 | 0.7 | 0.148 | Good | 4.1 | Good | 91.0 | Good | Sample of the invention |
| 72 | 45 | 0.12 | 510 | 460 | 510 | 510 | 0.7 | 0.145 | Good | 4.2 | Good | 91.0 | Good | Sample of the invention |
| 73 | 45 | 0.12 | 570 | 570 | 570 | 510 | 0.7 | 0.142 | Good | 4.3 | Good | 91.0 | Good | Sample of the invention |
| 74 | 45 | 0.12 | 570 | 570 | 460 | 510 | 0.7 | 0.145 | Good | 4.1 | Good | 91.0 | Good | Sample of the invention |
| 75 | 45 | 0.12 | 570 | 460 | 570 | 510 | 0.7 | 0.143 | Good | 4.2 | Good | 91.0 | Good | Sample of the invention |
| 76 | 45 | 0.12 | 610 | 610 | 610 | 510 | 0.7 | 0.161 | Poor | 4.8 | Good | 90.0 | Good | Sample for comparison |

TABLE 6

| Sample No. | Plating weight (g/m²) | Al concentration in bath (wt. %) | Initial reaction temp. (°C.) | Sheet temp. (°C.) | Bath temp. (°C.) | Alloying temp. (°C.) | Elongation rate of temper-rolling (%) | Press-formability: Coefficient of friction | Press-formability: Evaluation | Powdering resistance: Amount of peel-off (g/m²) | Powdering resistance: Evaluation | Image clarity after painting: NSIC-value | Image clarity after painting: Evaluation | Remarks |
|---|---|---|---|---|---|---|---|---|---|---|---|---|---|---|
| 77 | 45 | 0.12 | 510 | 510 | 510 | 470 | 0.7 | 0.175 | Poor | 4.1 | Good | 91.0 | Good | Sample for comparison |
| 78 | 45 | 0.12 | 510 | 510 | 510 | 550 | 0.7 | 0.144 | Good | 4.4 | Good | 91.0 | Good | Sample of the invention |
| 79 | 45 | 0.12 | 510 | 510 | 510 | 590 | 0.7 | 0.143 | Good | 4.7 | Good | 91.0 | Good | Sample of the invention |
| 80 | 45 | 0.12 | 510 | 510 | 510 | 610 | 0.7 | 0.143 | Good | 6.5 | Poor | 91.0 | Good | Sample for comparison |
| 81 | 45 | 0.15 | 460 | 460 | 460 | 510 | 0.7 | 0.155 | Poor | 4.5 | Good | 89.0 | Good | Sample for comparison |
| 82 | 45 | 0.15 | 510 | 510 | 510 | 510 | 0.0 | 0.147 | Good | 4.5 | Good | 75.0 | Poor | Sample for comparison |
| 83 | 45 | 0.15 | 510 | 510 | 510 | 510 | 0.7 | 0.144 | Good | 4.3 | Good | 90.0 | Good | Sample of the invention |
| 84 | 45 | 0.15 | 570 | 570 | 570 | 510 | 0.7 | 0.141 | Good | 4.1 | Good | 90.0 | Good | Sample of the invention |
| 85 | 45 | 0.15 | 610 | 610 | 610 | 510 | 0.7 | 0.160 | Poor | 4.8 | Good | 90.0 | Good | Sample for comparison |
| 86 | 45 | 0.15 | 510 | 510 | 510 | 470 | 0.7 | 0.162 | Poor | 4.1 | Good | 90.0 | Good | Sample for comparison |
| 87 | 45 | 0.15 | 510 | 510 | 510 | 550 | 0.7 | 0.144 | Good | 4.2 | Good | 91.0 | Good | Sample of the invention |
| 88 | 45 | 0.15 | 510 | 510 | 510 | 590 | 0.7 | 0.143 | Good | 4.5 | Good | 90.0 | Good | Sample of the invention |
| 89 | 45 | 0.15 | 510 | 510 | 510 | 610 | 0.7 | 0.143 | Good | 6.5 | Poor | 91.0 | Good | Sample for comparison |
| 90 | 45 | 0.20 | 460 | 460 | 460 | 510 | 0.7 | 0.175 | Poor | 4.3 | Good | 88.0 | Good | Sample for comparison |
| 91 | 45 | 0.20 | 510 | 510 | 510 | 510 | 0.0 | 0.148 | Good | 3.8 | Good | 74.0 | Poor | Sample for comparison |
| 92 | 45 | 0.20 | 510 | 510 | 510 | 510 | 0.7 | 0.144 | Good | 3.6 | Good | 90.0 | Good | Sample of the invention |
| 93 | 45 | 0.20 | 570 | 570 | 570 | 510 | 0.7 | 0.143 | Good | 3.8 | Good | 90.0 | Good | Sample of the invention |
| 94 | 45 | 0.20 | 610 | 610 | 610 | 510 | 0.7 | 0.158 | Poor | 4.4 | Good | 90.0 | Good | Sample for comparison |
| 95 | 45 | 0.30 | 460 | 460 | 460 | 510 | 0.7 | 0.175 | Poor | 4.1 | Good | 88.0 | Good | Sample for comparison |
| 96 | 45 | 0.30 | 510 | 510 | 510 | 510 | 0.0 | 0.148 | Good | 3.8 | Good | 74.0 | Poor | Sample for comparison |

TABLE 7

| Sample No. | Plating weight (g/m²) | Al concentration in bath (wt. %) | Initial reaction temp. (°C.) | Sheet temp. (°C.) | Bath temp. (°C.) | Alloying temp. (°C.) | Elongation rate of temper-rolling (%) | Press-formability: Coefficient of friction | Press-formability: Evaluation | Powdering resistance: Amount of peel-off (g/m²) | Powdering resistance: Evaluation | Image clarity after painting: NSIC-value | Image clarity after painting: Evaluation | Remarks |
|---|---|---|---|---|---|---|---|---|---|---|---|---|---|---|
| 97 | 45 | 0.30 | 510 | 510 | 510 | 510 | 0.7 | 0.144 | Good | 3.7 | Good | 90.0 | Good | Sample of the invention |
| 98 | 45 | 0.30 | 570 | 570 | 570 | 510 | 0.7 | 0.143 | Good | 3.6 | Good | 90.0 | Good | Sample of the invention |
| 99 | 45 | 0.30 | 610 | 610 | 610 | 510 | 0.7 | 0.158 | Poor | 4.2 | Good | 90.0 | Good | Sample for comparison |
| 100 | 45 | 0.32 | 550 | 550 | 550 | 510 | 0.7 | — | — | — | — | — | — | Sample for comparison (no alloying reaction) |
| 101 | 45 | 0.12 | 460 | 460 | 460 | 510 | 0.7 | 0.143 | Good | 8.5 | Poor | 85.0 | Good | Sample for comparison (laser-textured dull-roll used) |
| 102 | 30 | 0.12 | 460 | 460 | 460 | 510 | 0.7 | 0.152 | Poor | 4.2 | Good | 90.0 | Good | Sample for comparison |
| 103 | 30 | 0.12 | 510 | 510 | 510 | 510 | 0.0 | 0.146 | Good | 4.1 | Good | 75.0 | Poor | Sample for comparison |
| 104 | 30 | 0.12 | 510 | 510 | 510 | 510 | 0.7 | 0.142 | Good | 3.8 | Good | 91.0 | Good | Sample of the invention |
| 105 | 30 | 0.12 | 570 | 570 | 570 | 510 | 0.7 | 0,141 | Good | 3.9 | Good | 92.0 | Good | Sample of the invention |
| 106 | 30 | 0.12 | 610 | 610 | 610 | 510 | 0.7 | 0.160 | Poor | 4.2 | Good | 90.0 | Good | Sample for comparison |
| 107 | 30 | 0.12 | 510 | 510 | 510 | 470 | 0.7 | 0.161 | Poor | 3.8 | Good | 90.0 | Good | Sample for comparison |
| 108 | 30 | 0.12 | 510 | 510 | 510 | 550 | 0.7 | 0.142 | Good | 3.9 | Good | 90.0 | Good | Sample of the invention |
| 109 | 30 | 0.12 | 510 | 510 | 510 | 590 | 0.7 | 0.141 | Good | 4.3 | Good | 90.0 | Good | Sample of the invention |
| 110 | 30 | 0.12 | 510 | 510 | 510 | 610 | 0.7 | 0.141 | Good | 6.1 | Poor | 90.0 | Good | Sample for comparison |
| 111 | 60 | 0.12 | 460 | 460 | 460 | 510 | 0.7 | 0.158 | Poor | 4.9 | Good | 89.0 | Good | Sample for comparison |
| 112 | 60 | 0.12 | 510 | 510 | 510 | 510 | 0.0 | 0.148 | Good | 4.8 | Good | 75.0 | Poor | Sample for comparison |
| 113 | 60 | 0.12 | 510 | 510 | 510 | 510 | 0.7 | 0.146 | Good | 4.7 | Good | 90.0 | Good | Sample of the invention |
| 114 | 60 | 0.12 | 570 | 570 | 570 | 510 | 0.7 | 0.144 | Good | 4.5 | Good | 91.0 | Good | Sample of the invention |
| 115 | 60 | 0.12 | 610 | 610 | 610 | 510 | 0.7 | 0.164 | Poor | 4.6 | Good | 90.0 | Good | Sample for comparison |

TABLE 8

| Sample No. | Plating weight (g/m²) | Al concentration in bath (wt. %) | Initial reaction temp. (°C.) | Sheet temp. (°C.) | Bath temp. (°C.) | Alloying temp. (°C.) | Elongation rate of temper-rolling (%) | Press-formability: Coefficient of friction | Press-formability: Evaluation | Powdering resistance: Amount of peel-off (g/m²) | Powdering resistance: Evaluation | Image clarity after painting: NSIC-value | Image clarity after painting: Evaluation | Remarks |
|---|---|---|---|---|---|---|---|---|---|---|---|---|---|---|
| 116 | 60 | 0.12 | 510 | 510 | 510 | 470 | 0.7 | 0.164 | Poor | 4.6 | Good | 91.0 | Good | Sample for comparison |
| 117 | 60 | 0.12 | 510 | 510 | 510 | 550 | 0.7 | 0.146 | Good | 4.6 | Good | 91.0 | Good | Sample of the invention |
| 118 | 60 | 0.12 | 510 | 510 | 510 | 590 | 0.7 | 0.145 | Good | 4.7 | Good | 91.0 | Good | Sample of the invention |
| 119 | 60 | 0.12 | 510 | 510 | 510 | 610 | 0.7 | 0.145 | Good | 8.5 | Poor | 91.0 | Good | Sample for comparison |

For each of the samples of the invention and the samples for comparison, press-formability, powdering resistance and image clarity after painting were investigated in accordance with the following test methods:

Press-formability was tested in accordance with the same method as in the Example 1 of the first invention. The criteria for evaluation of press-formability were as follows:

Value of coefficient of friction (F/N) of up to 0.142: Very good press-formability Value of coefficient of friction (F/N) of over 0.142 to under 0.150: Good press-formability Value of coefficient of friction (F/N) of at least 0.150: Poor press-formability.

The test results of press-formability are shown also in Tables 5 to 8.

Powdering resistance was tested in accordance with the same method as in the Example 1 of the first invention. The criteria for evaluation of powdering resistance were also the same as in the Example 1 of the first invention. The test results of powdering resistance are shown also in Tables 5 to 8.

Image clarity after painting was tested in accordance with the same method as in the Example 1 of the second invention. The criteria for evaluation of image clarity after painting were also the same as in the Example 1 of the second invention. The test results of image clarity after painting are shown also in Tables 5 to 8.

As is clear from Tables 5 to 8, the sample for comparison No. 57, in which the aluminum content in the zinc dip-plating bath was small outside the scope of the present invention, was poor in press-formability and powdering resistance. In the sample for comparison No. 100, no alloying reaction took place between iron and zinc because the aluminum content in the zinc dip-plating bath was large outside the scope of the present invention. The samples for comparison Nos. 58, 63, 68, 81, 90, 95, 102 and 111, in which the initial reaction temperature was low outside the scope of the present invention, and the samples for comparison Nos. 62, 67, 76, 85, 94, 99, 106 and 115, in which the initial reaction temperature was high outside the scope of the present invention, were poor in press-formability.

The samples for comparison Nos. 77, 86, 107 and 116, in which the alloying treatment temperature was low outside the scope of the present invention, were poor in press-formability. The samples for comparison Nos. 80, 89, 110 and 119, in which the alloying treatment temperature was high outside the scope of the present invention, were poor in powdering resistance. The samples for comparison Nos. 59, 64, 69, 82, 91, 96, 103 and 112, having an elongation rate of 0%, i.e., which were not subjected to a temper-rolling treatment, were poor in image clarity after painting. The sample for comparison No. 101 was poor in powdering resistance because the plated steel sheet was temper-rolled with the use of the laser-textured dull rolls, and as a result, the plating layer was damaged.

In contrast, all the samples of the invention Nos. 60, 61, 65, 66, 70 to 75, 78, 79, 83, 84, 87, 88, 92, 93, 97, 98, 104, 105, 108, 109, 113, 114, 117 and 118, in which the aluminum content in the zinc dip-plating bath, the initial reaction temperature, the alloying temperature and the elongation rate were all within the scope of the present invention, were good in all of press-formability, powdering resistance, and image clarity after painting.

EXAMPLE 2 OF THE THIRD INVENTION

A plurality of cold-rolled steel sheets were prepared by subjecting a plurality of IF steel-based hot-rolled steel sheets having a thickness of 0.8 mm to a cold-rolling treatment in accordance with the cold-rolling conditions within the scope of the present invention. Then, various alloying-treated iron-zinc alloy dip-plated steel sheets within the scope of the present invention, were manufactured by subjecting each of the thus prepared cold-rolled steel sheets to a zinc dip-plating treatment, an alloying treatment and a temper-rolling treatment in this order, while changing the conditions of these treatments within the scope of the present invention. The thus manufactured alloying-treated iron-zinc alloy dip-plated steel sheets comprised a plurality of plated steel sheets each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples within the scope of the present invention (hereinafter referred to as the "samples of the invention") were prepared from the thus manufactured plurality of alloying-treated iron-zinc alloy dip-plated steel sheets each having an alloying-treated iron-zinc alloy dip-plating layer formed on each of the both surfaces thereof.

For comparison purposes, various alloying-treated iron-zinc alloy dip-plated steel sheets outside the scope of the present invention, were manufactured by subjecting a plurality of hot-rolled steel sheets to a cold-rolling treatment, a zinc dip-plating treatment, an alloying treatment and a temper-rolling treatment under conditions in which at least one of the cold-rolling treatment condition, the zinc dip-plating treatment condition, the alloying treatment condition and the temper-rolling treatment condition was outside the scope of the present invention. The thus manufactured alloying-treated iron-zinc alloy dip-plated steel sheets comprised a plurality of plated steel sheets each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples outside the scope of the present invention (hereinafter referred to as the "samples for comparison") were prepared from the thus manufactured plurality of alloying-treated iron-zinc alloy dip-plated steel sheets each having an alloying-treated iron-zinc alloy dip-plating layer formed on each of the both surfaces thereof.

For each of the samples of the invention and the samples for comparison, the center-line mean roughness (Ra) of the cold-rolling rolls in the cold-rolling treatment, and the integral value of amplitude spectra in a wavelength region of from 100 to 2,000 μm, which amplitude spectra were obtained through the Fourier transformation of the profile curve of the cold-rolled steel sheet; the plating weight, the aluminum content in the zinc dip-plating bath, the temperature of the cold-rolled steel sheet, and the bath temperature in the zinc dip-plating treatment; the initial reaction temperature and the alloying treatment temperature in the alloying treatment; and the center-line mean roughness (Ra) of the temper-rolling rolls, the elongation rate in the temper-rolling treatment, and the integral value of amplitude spectra in a wavelength region of from 100 to 2,000 μm, which amplitude spectra were obtained through the Fourier transformation of the profile curve of the temper-rolled alloying-treated iron-zinc alloy dip-plated steel sheet in the temper-rolling treatment, are shown in Tables 9 to 11.

TABLE 9

| Sample No. | Plating weight ($g/m^2$) | Al concentration in bath (wt. %) | Initial reaction temp. (°C.) | Sheet temp. (°C.) | Bath temp. (°C.) | Alloying temp. (°C.) | Ra of cold-rolling roll (μm) | Integral of amplitude spectra of cold-rolled sheet ($\mu m^3$) | Ra of temper-rolling roll (μm) |
|---|---|---|---|---|---|---|---|---|---|
| 120 | 45 | 0.14 | 550 | 550 | 550 | 510 | 0.08 | 200 | 0.3 |
| 121 | 45 | 0.14 | 550 | 550 | 550 | 510 | 0.1 | 210 | 0.3 |
| 122 | 45 | 0.14 | 550 | 550 | 550 | 510 | 0.3 | 180 | 0.3 |
| 123 | 45 | 0.14 | 550 | 550 | 550 | 510 | 0.5 | 230 | 0.3 |
| 124 | 45 | 0.14 | 550 | 550 | 550 | 510 | 0.8 | 300 | 0.3 |
| 125 | 45 | 0.14 | 550 | 550 | 550 | 510 | 0.9 | 400 | 0.3 |
| 126 | 45 | 0.14 | 550 | 550 | 550 | 510 | 0.5 | 550 | 0.3 |
| 127 | 45 | 0.14 | 550 | 550 | 550 | 510 | 0.5 | 212 | 0.3 |
| 128 | 45 | 0.14 | 550 | 550 | 550 | 510 | 0.5 | 212 | 0.3 |
| 129 | 45 | 0.14 | 550 | 550 | 550 | 510 | 0.5 | 212 | 0.3 |
| 130 | 45 | 0.14 | 550 | 550 | 550 | 510 | 0.5 | 212 | 0.3 |

| Sample No. | Integral of amplitude spectra of temper-rolled sheet ($\mu m^3$) | Elongation rate of temper-rolling (%) | Press-formability | | Powdering resistance | | Image clarity after painting | | Remarks |
|---|---|---|---|---|---|---|---|---|---|
| | | | Coefficient of friction | Evaluation | Amount of peeloff ($g/m^2$) | Evaluation | NSIC-value | Evaluation | |
| 120 | 80 | 0.7 | 0.142 | Good | 3.2 | Good | 92.1 | Good | Sample of the invention (roll defects produced) |
| 121 | 144 | 0.7 | 0.143 | Good | 3.6 | Good | 91.5 | Good | Sample of the invention |
| 122 | 130 | 0.7 | 0.144 | Good | 3.6 | Good | 93.0 | Good | Sample of the invention |
| 123 | 140 | 0.7 | 0.143 | Good | 3.4 | Good | 92.6 | Good | Sample of the invention |
| 124 | 176 | 0.7 | 0.142 | Good | 3.3 | Good | 91.5 | Good | Sample of the invention |
| 125 | 246 | 0.7 | 0.146 | Good | 3.1 | Good | 75.3 | Fair | Sample of the invention |
| 126 | 252 | 5.0 | 0.148 | Good | 3.2 | Good | 78.0 | Fair | Sample of the invention |
| 127 | 240 | 0.0 | 0.143 | Good | 3.5 | Good | 79.0 | Fair | Sample of the invention |
| 128 | 170 | 0.3 | 0.143 | Good | 3.5 | Good | 90.0 | Good | Sample of the invention |
| 129 | 80 | 0.7 | 0.144 | Good | 3.6 | Good | 92.0 | Good | Sample of the invention |
| 130 | 80 | 0.7 | 0.144 | Good | 3.6 | Good | 92.0 | Good | Sample of the invention |

TABLE 10

| Sample No. | Plating weight ($g/m^2$) | Al concentration in bath (wt. %) | Initial reaction temp. (°C.) | Sheet temp. (°C.) | Bath temp. (°C.) | Alloying temp. (°C.) | Ra of cold-rolling roll (μm) | Integral of amplitude spectra of cold-rolled sheet ($\mu m^3$) | Ra of temper-rolling roll (μm) |
|---|---|---|---|---|---|---|---|---|---|
| 131 | 60 | 0.14 | 550 | 550 | 550 | 510 | 0.5 | 212 | 0.3 |
| 132 | 45 | 0.14 | 550 | 550 | 550 | 510 | 0.5 | 230 | 0.3 |
| 133 | 45 | 0.14 | 550 | 550 | 550 | 510 | 0.5 | 210 | 0.3 |
| 134 | 45 | 0.14 | 550 | 550 | 550 | 510 | 0.5 | 230 | 0.3 |
| 135 | 45 | 0.14 | 550 | 550 | 550 | 450 | 0.5 | 220 | 0.3 |
| 136 | 45 | 0.14 | 550 | 550 | 550 | 475 | 0.5 | 220 | 0.3 |
| 137 | 45 | 0.14 | 550 | 550 | 550 | 510 | 0.5 | 220 | 0.3 |
| 138 | 45 | 0.14 | 460 | 460 | 460 | 510 | 0.5 | 212 | 0.8 |
| 139 | 45 | 0.14 | 550 | 550 | 550 | 540 | 0.5 | 212 | 0.3 |
| 140 | 45 | 0.14 | 550 | 550 | 550 | 570 | 0.5 | 212 | 0.3 |

TABLE 10-continued

| Sample No. | Integral of amplitude spectra of temper-rolled sheet ($\mu m^3$) | Elongation rate of temper-rolling (%) | Press-formability: Coefficient of friction | Press-formability: Evaluation | Powdering resistance: Amount of peeloff ($g/m^2$) | Powdering resistance: Evaluation | Image clarity after painting: NSIC-value | Image clarity after painting: Evaluation | Remarks |
|---|---|---|---|---|---|---|---|---|---|
| 131 | 80 | 0.7 | 0.144 | Good | 3.6 | Good | 92.0 | Good | Sample of the invention |
| 132 | 50 | 3.0 | 0.141 | Good | 3.3 | Good | 93.0 | Good | Sample of the invention |
| 133 | 30 | 5.0 | 0.144 | Good | 3.1 | Good | 94.0 | Good | Sample of the invention |
| 134 | 20 | 6.0 | 0.140 | Good | 4.1 | Good | 96.0 | Good | Sample for comparison (degraded quality) |
| 135 | 144 | 0.7 | 0.165 | Poor | 3.2 | Good | 92.0 | Good | Sample for comparison |
| 136 | 150 | 0.7 | 0.155 | Poor | 3.2 | Good | 91.0 | Good | Sample for comparison |
| 137 | 130 | 0.7 | 0.140 | Good | 3.6 | Good | 92 0 | Good | Sample of the invention |
| 138 | 130 | 0.7 | 0.143 | Good | 8.5 | Poor | 91.5 | Good | Sample for comparison (laser-textured dull-roll used) |
| 139 | 100 | 0.7 | 0.139 | Good | 3.9 | Good | 91.5 | Good | Sample of the invention |
| 140 | 80 | 0.7 | 0.139 | Good | 4.2 | Good | 92.0 | Good | Sample of the invention |

TABLE 11

| Sample No. | Plating weight ($g/m^2$) | Al concentration in bath (wt. %) | Initial reaction temp. (°C.) | Sheet temp. (°C.) | Bath temp. (°C.) | Alloying temp. (°C.) | Ra of cold-rolling roll (μm) | Integral of amplitude spectra of cold-rolled sheet ($\mu m^3$) | Ra of temper-rolling roll (μm) |
|---|---|---|---|---|---|---|---|---|---|
| 141 | 45 | 0.14 | 550 | 550 | 550 | 600 | 0.5 | 220 | 0.3 |
| 142 | 45 | 0.14 | 550 | 550 | 550 | 620 | 0.5 | 220 | 0.3 |
| 143 | 45 | 0.04 | 550 | 550 | 550 | 540 | 0.5 | 212 | 0.3 |
| 144 | 45 | 0.08 | 550 | 550 | 550 | 540 | 0.5 | 223 | 0.3 |
| 145 | 45 | 0.12 | 550 | 550 | 550 | 540 | 0.5 | 223 | 0.3 |
| 146 | 45 | 0.16 | 550 | 550 | 550 | 540 | 0.5 | 232 | 0.3 |
| 147 | 45 | 0.20 | 550 | 550 | 550 | 540 | 0.5 | 212 | 0.3 |
| 148 | 45 | 0.30 | 550 | 550 | 550 | 540 | 0.5 | 250 | 0.3 |
| 149 | 45 | 0.32 | 550 | 550 | 550 | 540 | 0.5 | 220 | 0.3 |
| 150 | 45 | 0.14 | 550 | 550 | 550 | 510 | 0.5 | 220 | 0.6 |

| Sample No. | Integral of amplitude spectra of temper-rolled sheet ($\mu m^3$) | Elongation rate of temper-rolling (%) | Press-formability: Coefficient of friction | Press-formability: Evaluation | Powdering resistance: Amount of peeloff ($g/m^2$) | Powdering resistance: Evaluation | Image clarity after painting: NSIC-value | Image clarity after painting: Evaluation | Remarks |
|---|---|---|---|---|---|---|---|---|---|
| 141 | 50 | 0.7 | 0.145 | Good | 4.5 | Good | 92.0 | Good | Sample of the invention |
| 142 | 142 | 0.7 | 0.155 | Poor | 6.5 | Poor | 92.0 | Good | Sample for comparison |
| 143 | 130 | 0.7 | 0.185 | Poor | 7.2 | Poor | 92.0 | Good | Sample for comparison |
| 144 | 130 | 0.7 | 0.148 | Good | 3.6 | Good | 92.0 | Good | Sample of the invention |
| 145 | 130 | 0.7 | 0.142 | Good | 3.6 | Good | 92.0 | Good | Sample of the invention |
| 146 | 130 | 0.7 | 0.138 | Good | 3.6 | Good | 92.0 | Good | Sample of the invention |

TABLE 11-continued

| | | | | | | | | | |
|---|---|---|---|---|---|---|---|---|---|
| 147 | 130 | 0.7 | 0.138 | Good | 3.6 | Good | 92.0 | Good | Sample of the invention |
| 148 | 130 | 0.7 | 0.139 | Good | 3.6 | Good | 92.0 | Good | Sample of the invention |
| 149 | 130 | 0.7 | — | — | — | — | — | — | Sample for comparison (no alloying reaction) |
| 150 | 226 | 0.7 | 0.140 | Good | 3.6 | Good | 80.0 | Fair | Sample of the invention |

For each of the samples of the invention and the samples for comparison, press-formability, powdering resistance and image clarity after painting were investigated in accordance with the same manner as in the Example of the third invention. The test results are shown also in Tables 9 to 11.

As is clear from Tables 9 to 11, the sample of the invention No. 120 was good in all of press-formability, powdering resistance and image clarity after painting. However, because the center-line mean roughness (Ra) of the cold-rolling rolls was small in the manufacturing method of the sample of the invention No. 120, the sample of the invention No. 120 showed a slightly degraded quality of the cold-rolled steel sheet as a result of an easy occurrence of roll defects on the cold-rolling rolls. In the manufacture of the samples of the invention Nos. 125 to 127, the hot-rolled steel sheet was cold-rolled with the use of the rolls providing a high integral value of amplitude spectra of the cold-rolled steel sheet, and the alloying-treated iron-zinc alloy dip-plated steel sheet was temper-rolled with the use of the conventional rolls providing a high integral value of amplitude spectra of the temper-rolled alloying-treated iron-zinc alloy dip-plated steel sheet. Consequently, the samples of the invention Nos. 125 to 127 were somewhat poor in image clarity after painting.

The sample of the invention No. 134 was good in all of press-formability, powdering resistance and image clarity after painting, but a slight quality degradation was observed in the product because of the high elongation rate in the temper-rolling.

The samples for comparison Nos. 135 and 136 were poor in press-formability because the alloying temperature was low outside the scope of the present invention. The sample for comparison No. 138 was poor in powdering resistance because of the use of a cold-rolled steel sheet which was given a surface profile by the laser-textured dull rolls.

The sample for comparison No. 142 was poor in press-formability and powdering resistance because the alloying temperature was high outside the scope of the present invention. The sample for comparison No. 143 was poor in press-formability and powdering resistance because the aluminum content in the zinc dip-plating bath was small outside the scope of the present invention. The sample for comparison No. 149 had no alloying reaction between iron and zinc because the aluminum content in the zinc dip-plating bath was large outside the scope of the present invention.

The sample of the invention No. 150, while being good in press-formability and powdering resistance, was somewhat poor in image clarity after painting because of the large integral value of amplitude spectra of the temper-rolled alloying-treated iron-zinc alloy dip-plated steel sheet.

The samples of the invention Nos. 121 to 124, 128 to 133, 137, 139 to 141 and 144 to 148 of which the center-line mean roughness (Ra) of the rolls in the cold-rolling treatment, the integral value of amplitude spectra in a wavelength region of from 100 to 2,000 μm, which amplitude spectra were obtained through the Fourier transformation of the profile curve of the cold-rolled steel sheet, the aluminum content in the zinc dip-plating bath, the initial reaction temperature and the alloying treatment temperature in the alloying treatment, the center-line mean roughness (Ra) of the rolls in the temper-rolling treatment, the elongation rate and the integral value of amplitude spectra in a wavelength region of from 100 to 2,000 μm, which amplitude spectra were obtained through the Fourier transformation of the profile curve of the temper-rolled alloying-treated iron-zinc alloy dip-plated steel sheet were all within the scope of the present invention, were good in all of press-formability, powdering resistance and image clarity after painting.

Now, the fourth method for manufacturing an alloying-treated iron-zinc alloy dip-plated steel sheet of the present invention is described below further in detail by means of examples while comparing with examples for comparison.

EXAMPLE 1 OF THE FOURTH INVENTION

A plurality of steels having chemical compositions within the scope of the present invention (hereinafter referred to as the "steels of the invention") and a plurality of steels having chemical compositions outside the scope of the present invention (hereinafter referred to as the "steels for comparison"), as shown in Tables 12 and 13, were prepared by changing the amounts of boron, titanium, niobium, soluble aluminum and nitrogen, with various IF steels as bases.

TABLE 12

| Symbol of steel | Kind of steel | Division of steel | C | Si | Mn | P | S | Sol.Al | N | Nb | Ti | B | (Ti + Nb)*/C |
|---|---|---|---|---|---|---|---|---|---|---|---|---|---|
| A-1 | Ti—IF steel | Steel for comparison | 0.0018 | 0.02 | 0.13 | 0.009 | 0.009 | 0.046 | 0.0018 | 0.000 | 0.094 | 0.0000 | 10.3 |
| A-2 | Ti—IF + B steel | Steel of the invention | 0.0018 | 0.02 | 0.13 | 0.009 | 0.009 | 0.046 | 0.0018 | 0.000 | 0.094 | 0.0004 | 10.3 |
| A-3 | Ti—IF + B steel | Steel of the invention | 0.0018 | 0.02 | 0.13 | 0.009 | 0.009 | 0.046 | 0.0018 | 0.000 | 0.094 | 0.0011 | 10.3 |
| A-4 | Ti—IF + B steel | Steel of the invention | 0.0018 | 0.02 | 0.13 | 0.009 | 0.009 | 0.046 | 0.0018 | 0.000 | 0.094 | 0.0018 | 10.3 |
| A-5 | Ti—IF + B steel | Steel for comparison | 0.0018 | 0.02 | 0.13 | 0.009 | 0.009 | 0.046 | 0.0018 | 0.000 | 0.094 | 0.0023 | 10.3 |
| B-1 | Ti—IF steel | Steel for comparison | 0.0021 | 0.02 | 0.12 | 0.005 | 0.002 | 0.044 | 0.0029 | 0.000 | 0.056 | 0.0000 | 5.1 |
| B-2 | Ti—IF + B steel | Steel of the invention | 0.0021 | 0.02 | 0.12 | 0,005 | 0.002 | 0.044 | 0.0029 | 0.000 | 0.056 | 0.0004 | 5.1 |

TABLE 12-continued

| Symbol of steel | Kind of steel | Division of steel | C | Si | Mn | P | S | Sol.Al | N | Nb | Ti | B | (Ti + Nb)*/C |
|---|---|---|---|---|---|---|---|---|---|---|---|---|---|
| B-3 | Ti—IF + B steel | Steel of the invention | 0.0021 | 0.02 | 0.12 | 0.005 | 0.002 | 0.044 | 0.0029 | 0.000 | 0.056 | 0.0011 | 5.1 |
| B-4 | Ti—IF + B steel | Steel of the invention | 0.0021 | 0.02 | 0.12 | 0.005 | 0.002 | 0.044 | 0.0029 | 0.000 | 0.056 | 0.0018 | 5.1 |
| B-5 | Ti—IF + B steel | Steel for comparison | 0.0021 | 0.02 | 0.12 | 0.005 | 0.002 | 0.044 | 0.0029 | 0.000 | 0.056 | 0.0023 | 5.1 |
| C-1 | Ti, Nb—IF steel | Steel for comparison | 0.0028 | 0.02 | 0.16 | 0.007 | 0.002 | 0.045 | 0.0025 | 0.014 | 0.027 | 0.0000 | 2.0 |
| C-2 | Ti, Nb—IF + B steel | Steel of the invention | 0.0028 | 0.02 | 0.16 | 0.007 | 0.002 | 0.045 | 0.0025 | 0.014 | 0.027 | 0.0004 | 2.0 |
| C-3 | Ti, Nb—IF + B steel | Steel of the invention | 0.0028 | 0.02 | 0.16 | 0.007 | 0.002 | 0.045 | 0.0025 | 0.014 | 0.027 | 0.0011 | 2.0 |
| C-4 | Ti, Nb—IF + B steel | Steel of the invention | 0.0028 | 0.02 | 0.16 | 0.007 | 0.002 | 0.045 | 0.0025 | 0.014 | 0.027 | 0.0018 | 2.0 |
| C-5 | Ti, Nb—IF + B steel | Steel for comparison | 0.0028 | 0.02 | 0.16 | 0.007 | 0.002 | 0.045 | 0.0025 | 0.014 | 0.027 | 0.0023 | 2.0 |
| D-1 | Ti—IF steel | Steel for comparison | 0.0023 | 0.02 | 0.13 | 0.007 | 0.002 | 0.045 | 0.0025 | 0.000 | 0.030 | 0.0000 | 2.0 |
| D-2 | Ti—IF steel | Steel of the invention | 0.0023 | 0.02 | 0.13 | 0.007 | 0.002 | 0.045 | 0.0025 | 0.000 | 0.023 | 0.0000 | 1.2 |
| D-3 | Ti, Nb—IF steel | Steel of the invention | 0.0023 | 0.02 | 0.13 | 0.007 | 0.002 | 0.045 | 0.0025 | 0.005 | 0.020 | 0.0000 | 1.2 |
| D-4 | Ti, Nb—IF steel | Steel of the invention | 0.0023 | 0.02 | 0.13 | 0.007 | 0.002 | 0.045 | 0.0025 | 0.010 | 0.017 | 0.0000 | 1.2 |
| D-5 | Ti, Nb + IF steel | Steel of the invention | 0.0023 | 0.02 | 0.13 | 0.007 | 0.002 | 0.045 | 0.0025 | 0.015 | 0.015 | 0.0000 | 1.2 |
| D-6 | Ti, Nb—IF steel | Steel of the invention | 0.0023 | 0.02 | 0.13 | 0.007 | 0.002 | 0.045 | 0.0025 | 0.020 | 0.012 | 0.0000 | 1.2 |
| D-7 | Nb—IF steel | Steel of the invention | 0.0023 | 0.02 | 0.13 | 0.007 | 0.002 | 0.045 | 0.0025 | 0.022 | 0.000 | 0.0000 | 1.2 |

Where, (Ti + Nb)*/C = 12{(Ti—1.5S—3.4N)/48 + Nb/93}/C

TABLE 13

| Symbol of steel | Kind of steel | Division of steel | C | Si | Mn | P | S | Sol.Al | N | Nb | Ti | B | (Ti + Nb)*/C |
|---|---|---|---|---|---|---|---|---|---|---|---|---|---|
| D-8 | Ti, Nb—IF steel | Sample of the invention | 0.0023 | 0.02 | 0.13 | 0.007 | 0.002 | 0.045 | 0.0025 | 0.000 | 0.020 | 0.0000 | 0.9 |
| D-9 | Ti, Nb—IF steel | Sample of the invention | 0.0023 | 0.02 | 0.13 | 0.007 | 0.002 | 0.045 | 0.0025 | 0.005 | 0.017 | 0.0000 | 0.9 |
| D-10 | Ti, Nb—IF steel | Sample of the invention | 0.0023 | 0.02 | 0.13 | 0.007 | 0.002 | 0.045 | 0.0025 | 0.010 | 0.015 | 0.0000 | 0.9 |
| D-11 | Ti, Nb—IF steel | Sample of the invention | 0.0023 | 0.02 | 0.13 | 0.007 | 0.002 | 0.045 | 0.0025 | 0.015 | 0.012 | 0.0000 | 0.9 |
| D-12 | Nb—IF steel | Sample of the invention | 0.0023 | 0.02 | 0.13 | 0.007 | 0.002 | 0.045 | 0.0025 | 0.016 | 0.000 | 0.0000 | 0.9 |
| E-1 | Ti—IF high tensile strength | Sample for comparison | 0.0023 | 0.15 | 0.60 | 0.020 | 0.002 | 0.045 | 0.0025 | 0.000 | 0.120 | 0.0000 | 11.8 |
| E-2 | Ti—IF high tensile steel + B | Sample of the invention | 0.0023 | 0.15 | 0.60 | 0.020 | 0.002 | 0.045 | 0.0025 | 0.000 | 0.120 | 0.0004 | 11.8 |
| E-3 | Ti—IF high tensile steel + B | Sample of the invention | 0.0023 | 0.15 | 0.60 | 0.020 | 0.002 | 0.045 | 0.0025 | 0.000 | 0.120 | 0.0011 | 11.8 |
| E-4 | Ti—IF high tensile steel + B | Sample of the invention | 0.0023 | 0.15 | 0.60 | 0.020 | 0.002 | 0.045 | 0.0025 | 0.000 | 0.120 | 0.0018 | 11.8 |
| E-5 | Ti—IF high tensile steel + B | Sample for comparison | 0.0023 | 0.15 | 0.60 | 0.020 | 0.002 | 0.045 | 0.0025 | 0.000 | 0.120 | 0.0023 | 11.8 |
| F-1 | Ti, Nb—IF high tensile steel | Sample for comparison | 0.0030 | 0.02 | 0.65 | 0.050 | 0.002 | 0.045 | 0.0025 | 0.010 | 0.070 | 0.0000 | 5.3 |
| F-2 | Ti, Nb—IF high tensile steel + B | Sample of the invention | 0.0030 | 0.02 | 0.65 | 0.050 | 0.002 | 0.045 | 0.0025 | 0.010 | 0.070 | 0.0004 | 5.3 |
| F-3 | Ti, Nb—IF high tensile steel + B | Sample of the invention | 0.0030 | 0.02 | 0.65 | 0.050 | 0.002 | 0.045 | 0.0025 | 0.010 | 0.070 | 0.0011 | 5.3 |
| F-4 | Ti, Nb—IF high tensile steel + B | Sample of the invention | 0.0030 | 0.02 | 0.65 | 0.050 | 0.002 | 0.045 | 0.0025 | 0.010 | 0.070 | 0.0018 | 5.3 |
| F-5 | Ti, Nb—IF high tensile steel + B | Sample for comparison | 0.0030 | 0.02 | 0.65 | 0.050 | 0.002 | 0.045 | 0.0025 | 0.010 | 0.070 | 0.0023 | 5.3 |
| G | Ti, Nb—IF high tensile steel | Sample of the invention | 0.0030 | 0.15 | 0.65 | 0.020 | 0.002 | 0.045 | 0.0025 | 0.010 | 0.000 | 0.0000 | 0.4 |
| H | Nb—IF high tensile steel | Sample of the invention | 0.0030 | 0.02 | 0.65 | 0.040 | 0.002 | 0.045 | 0.0025 | 0.010 | 0.000 | 0.0000 | 0.4 |
| 1-1 | Nb—IF steel | Sample for comparison | 0.0021 | 0.02 | 0.12 | 0.005 | 0.002 | 0.045 | 0.0025 | 0.030 | 0.000 | 0.0000 | 1.8 |
| 1-2 | Nb—IF + B steel | Sample of the invention | 0.0021 | 0.02 | 0.12 | 0.005 | 0.002 | 0.045 | 0.0025 | 0.030 | 0.000 | 0.0004 | 1.8 |
| 1-3 | Nb—IF + B steel | Sample of the invention | 0.0021 | 0.02 | 0.12 | 0.005 | 0.002 | 0.045 | 0.0025 | 0.030 | 0.000 | 0.0011 | 1.8 |
| 1-4 | Nb—IF + B steel | Sample of the invention | 0.0021 | 0.02 | 0.12 | 0.005 | 0.002 | 0.045 | 0.0025 | 0.030 | 0.000 | 0.0018 | 1.8 |
| 1-5 | Nb—IF + B steel | Sample for comparison | 0.0021 | 0.02 | 0.12 | 0.005 | 0.002 | 0.045 | 0.0025 | 0.030 | 0.000 | 0.0023 | 1.8 |
| 1-6 | Nb—IF steel | Sample of the invention | 0.0021 | 0.02 | 0.12 | 0.005 | 0.002 | 0.010 | 0.0100 | 0.030 | 0.000 | 0.0000 | 1.8 |

Where, (Ti + Nb)*/C = {(Ti—1.5S—3.4N)/48 + Nb/93}/C

Various alloying-treated iron-zinc alloy dip-plated steel sheets within the scope of the present invention, having a prescribed plating weight, were manufactured by means of a continuous zinc dip-plating line, with the use of a plurality of cold-rolled steel sheets, having a thickness of 0.8 mm and comprising the steels of the invention and the steels for comparison. More specifically, each of the above-mentioned cold-rolled steel sheets was subjected to a zinc dip-plating treatment, an alloying treatment and a temper-rolling treatment in accordance with the condition within the scope of the method of the fourth invention while changing the conditions of these treatments. The thus manufactured alloying-treated iron-zinc alloy dip-plated steel sheets comprised a plurality of plated steel sheets each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples within the scope of the present invention (hereinafter referred to as the "samples of the invention") were prepared from the thus manufactured plurality of alloying-treated iron-zinc alloy dip-plated steel sheets each having an alloying-treated iron-zinc alloy dip-plating layer formed on each of the both surfaces thereof.

For comparison purposes, various alloying-treated iron-zinc alloy dip-plated steel sheets outside the scope of the present invention were manufactured by subjecting a plurality of cold-rolled steel sheets to a zinc dip-plating treatment, an alloying treatment and a temper-rolling treatment under conditions in which at least one of the zinc dip-plating condition and the alloying treatment condition was outside the scope of the present invention. The thus manufactured alloying-treated iron-zinc alloy dip-plated steel sheets comprised a plurality of plated steel sheets each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples outside the scope of the present invention (hereinafter referred to as the "samples for comparison") were prepared from the thus manufactured plurality of alloying-treated iron-zinc alloy dip-plated steel sheets each having an alloying-treated iron-zinc alloy dip-plating layer on each of the both surfaces thereof.

For each of the samples of the invention and the samples for comparison, the kind of steel, the total amount of solid-solution of carbon (C), nitrogen (N) and boron (B) in the cold-rolled steel sheet, the plating weight in the zinc dip-plating treatment, the aluminum content in the zinc dip-plating bath, the initial reaction temperature and the alloying treatment temperature in the alloying treatment, and the elongation rate in the temper-rolling treatment, are shown in Tables 14 to 17.

TABLE 14

| Sample No. | Symbol of steel | Amount of solid-solution of C, N & B (ppm) | Plating weight (g/m$^2$) | Al concentration in bath (wt. %) | Alloying temp. (°C.) | Elongation rate of temper-rolling (%) | Press-formability: Coefficient of friction | Press-formability: Evaluation | Powdering resistance: Amount of peeloff (g/m$^2$) | Powdering resistance: Evaluation | Image clarity after painting: NSIC-valve | Image clarity after painting: Evaluation | Remarks |
|---|---|---|---|---|---|---|---|---|---|---|---|---|---|
| 151 | A-1 | 0 | 45 | 0.12 | 510 | 0.7 | 0.180 | Poor | 4.8 | Good | 90.0 | Good | Sample for comparison |
| 152 | A-2 | 4 | 45 | 0.12 | 510 | 0.7 | 0.148 | Good | 4.6 | Good | 90.0 | Good | Sample of the invention |
| 153 | A-3 | 11 | 45 | 0.12 | 510 | 0.7 | 0.146 | Good | 4.4 | Good | 90.0 | Good | Sample of the invention |
| 154 | A-4 | 18 | 45 | 0.12 | 510 | 0.7 | 0.144 | Good | 4.2 | Good | 90.0 | Good | Sample of the invention |
| 155 | A-5 | 23 | 45 | 0.12 | 510 | 0.7 | 0.142 | Good | 4.0 | Good | 90.0 | Good | Sample for comparison (quality degraded) |
| 156 | B-1 | 0 | 45 | 0.12 | 510 | 0.7 | 0.170 | Poor | 4.6 | Good | 90.0 | Good | Sample for comparison |
| 157 | B-2 | 5 | 45 | 0.12 | 510 | 0.7 | 0.147 | Good | 4.4 | Good | 90.0 | Good | Sample of the invention |
| 158 | B-3 | 12 | 45 | 0.12 | 510 | 0.7 | 0.145 | Good | 4.2 | Good | 90.0 | Good | Sample of the invention |
| 159 | B-4 | 19 | 45 | 0.12 | 510 | 0.7 | 0.143 | Good | 4.0 | Good | 90.0 | Good | Sample of the invention |
| 160 | B-5 | 24 | 45 | 0.12 | 510 | 0.7 | 0.141 | Good | 3.8 | Good | 90.0 | Good | Sample for comparison (quality degraded) |
| 161 | C-1 | 0 | 45 | 0.12 | 510 | 0.7 | 0.165 | Poor | 4.4 | Good | 90.0 | Good | Sample for comparison |
| 162 | C-2 | 6 | 45 | 0.12 | 510 | 0.7 | 0.146 | Good | 4.2 | Good | 90.0 | Good | Sample of the invention |
| 163 | C-3 | 13 | 45 | 0.12 | 510 | 0.7 | 0.144 | Good | 4.0 | Good | 90.0 | Good | Sample of the invention |
| 164 | C-4 | 20 | 45 | 0.12 | 510 | 0.7 | 0.142 | Good | 3.8 | Good | 90.0 | Good | Sample of the invention |
| 165 | C-5 | 25 | 45 | 0.12 | 510 | 0.7 | 0.140 | Good | 3.6 | Good | 90.0 | Good | Sample for comparison (quality degraded) |

TABLE 14-continued

| Sample No. | Symbol of steel | Amount of solid-solution of C, N & B (ppm) | Plating weight (g/m²) | Al concentration in bath (wt. %) | Alloying temp. (°C.) | Elongation rate of temper-rolling (%) | Press-formability: Coefficient of friction | Press-formability: Evaluation | Powdering resistance: Amount of peeloff (g/m²) | Powdering resistance: Evaluation | Image clarity after painting: NSIC-valve | Image clarity after painting: Evaluation | Remarks |
|---|---|---|---|---|---|---|---|---|---|---|---|---|---|
| 166 | D-1 | 0 | 45 | 0.12 | 510 | 0.7 | 0.165 | Poor | 4.4 | Good | 90.0 | Good | Sample for comparison |
| 167 | D-2 | 3 | 45 | 0.12 | 510 | 0.7 | 0.148 | Good | 4.2 | Good | 90.0 | Good | Sample of the invention |
| 168 | D-3 | 5 | 45 | 0.12 | 510 | 0.7 | 0.146 | Good | 4.0 | Good | 90.0 | Good | Sample of the invention |
| 169 | D-4 | 7 | 45 | 0.12 | 510 | 0.7 | 0.144 | Good | 3.8 | Good | 90.0 | Good | Sample of the invention |
| 170 | D-5 | 9 | 45 | 0.12 | 510 | 0.7 | 0.142 | Good | 3.8 | Good | 90.0 | Good | Sample of the invention |

TABLE 15

| Sample No. | Symbol of steel | Amount of solid-solution of C, N & B (ppm) | Plating weight (g/m²) | Al concentration in bath (wt. %) | Alloying temp. (°C.) | Elongation rate of temper-rolling (%) | Press-formability: Coefficient of friction | Press-formability: Evaluation | Powdering resistance: Amount of peeloff (g/m²) | Powdering resistance: Evaluation | Image clarity after painting: NSIC-valve | Image clarity after painting: Evaluation | Remarks |
|---|---|---|---|---|---|---|---|---|---|---|---|---|---|
| 171 | D-6 | 11 | 45 | 0.12 | 510 | 0.7 | 0.140 | Good | 3.6 | Good | 90.0 | Good | Sample of the invention |
| 172 | D-7 | 13 | 45 | 0.12 | 510 | 0.7 | 0.140 | Good | 3.6 | Good | 90.0 | Good | Sample of the invention |
| 173 | D-8 | 5 | 45 | 0.12 | 510 | 0.7 | 0.146 | Good | 4.2 | Good | 90.0 | Good | Sample of the invention |
| 174 | D-9 | 7 | 45 | 0.12 | 510 | 0.7 | 0.144 | Good | 4.0 | Good | 90.0 | Good | Sample of the invention |
| 175 | D-10 | 11 | 45 | 0.12 | 510 | 0.7 | 0.142 | Good | 3.8 | Good | 90.0 | Good | Sample of the invention |
| 176 | D-11 | 13 | 45 | 0.12 | 510 | 0.7 | 0.140 | Good | 3.6 | Good | 90.0 | Good | Sample of the invention |
| 177 | D-12 | 15 | 45 | 0.12 | 510 | 0.7 | 0.140 | Good | 3.4 | Good | 90.0 | Good | Sample of the invention |
| 178 | E-1 | 0 | 45 | 0.12 | 510 | 0.7 | 0.175 | Poor | 4.9 | Good | 90.0 | Good | Sample for comparison |
| 179 | E-2 | 4 | 45 | 0.12 | 510 | 0.7 | 0.149 | Good | 4.8 | Good | 90.0 | Good | Sample of the invention |
| 180 | E-3 | 11 | 45 | 0.12 | 510 | 0.7 | 0.147 | Good | 4.7 | Good | 90.0 | Good | Sample of the invention |
| 181 | E-4 | 18 | 45 | 0.12 | 510 | 0.7 | 0.145 | Good | 4.6 | Good | 90.0 | Good | Sample of the invention |
| 182 | E-5 | 23 | 45 | 0.12 | 510 | 0.7 | 0.143 | Good | 4.5 | Good | 90.0 | Good | Sample for comparison (quality degraded) |
| 183 | F-1 | 0 | 45 | 0.12 | 510 | 0.7 | 0.165 | Poor | 4.8 | Good | 90.0 | Good | Sample for comparison |
| 184 | F-2 | 4 | 45 | 0.12 | 510 | 0.7 | 0.148 | Good | 4.7 | Good | 90.0 | Good | Sample of the invention |
| 185 | F-3 | 11 | 45 | 0.12 | 510 | 0.7 | 0.146 | Good | 4.6 | Good | 90.0 | Good | Sample of the invention |
| 186 | F-4 | 18 | 45 | 0.12 | 510 | 0.7 | 0.144 | Good | 4.5 | Good | 90.0 | Good | Sample of the invention |
| 187 | F-5 | 23 | 45 | 0.12 | 510 | 0.7 | 0.142 | Good | 4.4 | Good | 90.0 | Good | Sample for comparison (quality degraded) |
| 188 | G | 15 | 45 | 0.12 | 510 | 0.7 | 0.147 | Good | 4.4 | Good | 90.0 | Good | Sample of the invention |
| 189 | H | 15 | 45 | 0.12 | 510 | 0.7 | 0.147 | Good | 4.4 | Good | 90.0 | Good | Sample of the invention |
| 190 | I-1 | 0 | 45 | 0.12 | 510 | 0.7 | 0.165 | Poor | 4.4 | Good | 90.0 | Good | Sample for comparison |

TABLE 16

| Sample No. | Symbol of steel | Amount of solid-solution of C, N & B (ppm) | Plating weight (g/m²) | Al concentration in bath (wt. %) | Alloying temp. (°C.) | Elongation rate of temper-rolling (%) | Press-formability: Coefficient of friction | Press-formability: Evaluation | Powdering resistance: Amount of peeloff (g/m²) | Powdering resistance: Evaluation | Image clarity after painting: NSIC-valve | Image clarity after painting: Evaluation | Remarks |
|---|---|---|---|---|---|---|---|---|---|---|---|---|---|
| 191 | I-2 | 4 | 45 | 0.12 | 510 | 0.7 | 0.148 | Good | 4.3 | Good | 90.0 | Good | Sample of the invention |
| 192 | I-3 | 11 | 45 | 0.12 | 510 | 0.7 | 0.146 | Good | 4.2 | Good | 90.0 | Good | Sample of the invention |
| 193 | I-4 | 18 | 45 | 0.12 | 510 | 0.7 | 0.144 | Good | 4.2 | Good | 90.0 | Good | Sample of the invention |
| 194 | I-5 | 23 | 45 | 0.12 | 510 | 0.7 | 0.142 | Good | 4.2 | Good | 90.0 | Good | Sample for comparison (quality degraded) |
| 195 | I-6 | 15 | 45 | 0.12 | 510 | 0.7 | 0.144 | Good | 4.2 | Good | 90.0 | Good | Sample of the invention |
| 196 | A-1 | 11 | 45 | 0.12 | 510 | 0.7 | 0.146 | Good | 4.4 | Good | 90.0 | Good | Sample of the invention (pre-plated with Fe—C) |
| 197 | A-1 | 11 | 45 | 0.12 | 510 | 0.7 | 0.146 | Good | 4.4 | Good | 90.0 | Good | Sample of the invention (pre-plated with Fe—N) |
| 198 | A-1 | 11 | 45 | 0.12 | 510 | 0.7 | 0.146 | Good | 4.4 | Good | 90.0 | Good | Sample of the invention (pre-plated with Fe—B) |
| 199 | A-1 | 11 | 45 | 0.12 | 510 | 0.7 | 0.146 | Good | 4.4 | Good | 90.0 | Good | Sample of the invention (nitrifying treated) |
| 200 | A-1 | 11 | 45 | 0.12 | 510 | 0.7 | 0.146 | Good | 4.4 | Good | 90.0 | Good | Sample of the invention (boric acid solution applied) |
| 201 | B-2 | 5 | 30 | 0.12 | 510 | 0.7 | 0.144 | Good | 3.1 | Good | 90.0 | Good | Sample of the invention |
| 202 | B-2 | 5 | 60 | 0.12 | 510 | 0.7 | 0.148 | Good | 4.8 | Good | 90.0 | Good | Sample of the invention |
| 203 | B-2 | 5 | 45 | 0.04 | 510 | 0.7 | 0.180 | Poor | 7.5 | Poor | 90.0 | Good | Sample for comparison |
| 204 | B-2 | 5 | 45 | 0.08 | 510 | 0.7 | 0.149 | Good | 4.8 | Good | 90.0 | Good | Sample of the invention |
| 205 | B-2 | 5 | 45 | 0.16 | 510 | 0.7 | 0.142 | Good | 4.0 | Good | 90.0 | Good | Sample of the invention |
| 206 | B-2 | 5 | 45 | 0.20 | 510 | 0.7 | 0.141 | Good | 3.8 | Good | 90.0 | Good | Sample of the invention |
| 207 | B-2 | 5 | 45 | 0.30 | 510 | 0.8 | 0.140 | Good | 3.7 | Good | 90.0 | Good | Sample of the invention |
| 208 | B-2 | 5 | 45 | 0.32 | 510 | 0.7 | — | — | — | — | — | — | Sample for comparison (no alloying reaction) |
| 209 | B-2 | 5 | 45 | 0.12 | 470 | 0.7 | 0.175 | Poor | 4.2 | Good | 90.0 | Good | Sample of the invention |
| 210 | B-2 | 5 | 45 | 0.12 | 470 | 0.7 | 0.145 | Good | 4.5 | Good | 90.0 | Good | Sample of the invention |

TABLE 17

| Sample No. | Symbol of steel | Amount of solid-solution of C, N & B (ppm) | Plating weight (g/m²) | Al concentration in bath (wt. %) | Alloying temp. (°C.) | Elongation rate of temper-rolling (%) | Press-formability: Coefficient of friction | Press-formability: Evaluation | Powdering resistance: Amount of peeloff (g/m²) | Powdering resistance: Evaluation | Image clarity after painting: NSIC-valve | Image clarity after painting: Evaluation | Remarks |
|---|---|---|---|---|---|---|---|---|---|---|---|---|---|
| 211 | B-2 | 5 | 45 | 0.12 | 590 | 0.7 | 0.144 | Good | 4.7 | Good | 90.0 | Good | Sample of the invention |
| 212 | B-2 | 5 | 45 | 0.12 | 620 | 0.7 | 0.160 | Poor | 8.1 | Poor | 90.0 | Good | Sample for comparison |
| 213 | B-2 | 5 | 45 | 0.12 | 510 | 0.0 | 0.146 | Good | 4.2 | Good | 75.0 | Poor | Sample for comparison |
| 214 | B-1 | 0 | 45 | 0.12 | 510 | 0.7 | 0.148 | Good | 8.5 | Poor | 90.0 | Good | Sample for comparison (laser-textured dull roll used) |
| 215 | C-2 | 6 | 30 | 0.12 | 510 | 0.7 | 0.142 | Good | 2.5 | Good | 90.0 | Good | Sample of the invention |
| 216 | C-2 | 6 | 60 | 0.12 | 510 | 0.7 | 0.148 | Good | 4.6 | Good | 90.0 | Good | Sample of the invention |
| 217 | C-2 | 6 | 45 | 0.04 | 510 | 0.7 | 0.180 | Poor | 7.3 | Poor | 90.0 | Good | Sample for comparison |
| 218 | C-2 | 6 | 45 | 0.08 | 510 | 0.7 | 0.148 | Good | 4.8 | Good | 90.0 | Good | Sample of the invention |
| 219 | C-2 | 6 | 45 | 0.16 | 510 | 0.7 | 0.143 | Good | 4.0 | Good | 90.0 | Good | Sample of the invention |
| 220 | C-2 | 6 | 45 | 0.20 | 510 | 0.7 | 0.142 | Good | 3.8 | Good | 90.0 | Good | Sample of the invention |
| 221 | C-2 | 6 | 45 | 0.30 | 510 | 0.7 | 0.143 | Good | 3.7 | Good | 90.0 | Good | Sample of the invention |
| 222 | C-2 | 6 | 45 | 0.32 | 510 | 0.7 | — | — | — | — | — | — | Sample for comparison (no alloying reaction) |
| 223 | C-2 | 6 | 45 | 0.12 | 470 | 0.7 | 0.178 | Poor | 4.2 | Good | 90.0 | Good | Sample for comparison |
| 224 | C-2 | 6 | 45 | 0.12 | 550 | 0.7 | 0.146 | Good | 4.2 | Good | 90.0 | Good | Sample of the invention |
| 225 | C-2 | 6 | 45 | 0.12 | 590 | 0.7 | 0.146 | Good | 4.2 | Good | 90.0 | Good | Sample of the invention |
| 226 | C-2 | 6 | 45 | 0.12 | 620 | 0.7 | 0.155 | Poor | 8.2 | Poor | 90.0 | Good | Sample for comparison |
| 227 | C-2 | 6 | 45 | 0.12 | 510 | 0.0 | 0.146 | Good | 4.2 | Good | 75.0 | Poor | Sample for comparison |
| 228 | C-1 | 0 | 45 | 0.12 | 510 | 0.7 | 0.148 | Good | 8.5 | Poor | 90.0 | Good | Sample for comparison (laser-textured dull roll used) |

For each of the samples of the invention and the samples for comparison, press-formability, powdering resistance and image clarity after painting were investigated in accordance with the same methods as those in the Example 1 of the third invention. The criteria for evaluation of press-formability, powdering resistance and image clarity after painting were the same as those in the Example 1 of the third invention. The test results are shown also in Tables 14 to 17.

As is clear from Tables 14 to 17, all the samples for comparison Nos. 151, 156, 161, 166, 178, 183 and 190 were poor in press-formability because the total amount of solid-solution of carbon (C), nitrogen (N) and boron (B) in the cold-rolled steel sheet was null. The samples for comparison Nos. 155, 160, 165, 182, 187 and 194 showed quality degradation because the total amount of solid-solution of carbon (C), nitrogen (N) and boron (B) in the cold-rolled steel sheet was large outside the scope of the present invention.

The samples for comparison Nos. 203 and 217 were poor in press-formability and powdering resistance because the aluminum content in the zinc dip-plating bath was low outside the scope of the present invention. In the samples for comparison Nos. 208 and 222, no alloying reaction took place between iron and zinc because the aluminum content in the zinc dip-plating bath was large outside the scope of the present invention. The sample for comparison No. 223 was poor in press-formability because the alloying treatment temperature was low outside the scope of the present invention. The samples for comparison Nos. 212 and 226 were poor in press-formability and powdering resistance because the alloying treatment temperature was high outside the scope of the present invention. The samples for comparison Nos. 213 and 227 were poor in image clarity after painting because the elongation rate in the temper-rolling was 0%, i.e., no temper-rolling treatment was applied. The samples for comparison Nos. 214 and 228 were poor in powdering resistance because each of the plated steel sheets was temper-rolled with the use of the laser-textured dull rolls, and as a result, the plating layer was damaged.

In contrast, all the samples of the invention Nos. 152 to 154, 157 to 159, 162 to 164, 167 to 177, 179 to 181, 184 to 186, 188, 189, 191 to 193, 195 to 202, 204 to 207, 209 to 211, 215, 216, 218 to 221, 224 and 225, in which the total amount of solid-solution of carbon (C), nitrogen (N) and boron (B) in the cold-rolled steel sheet, the aluminum content in the zinc dip-plating bath, the alloying treatment temperature and the elongation rate in the temper-rolling treatment were all within the scope of the present invention, were good in all of press-formability, powdering resistance and image clarity after painting.

EXAMPLE 2 OF THE FOURTH INVENTION

A plurality of cold-rolled steel sheets, having a thickness of 0.8 mm and comprising steels of the invention and steels for comparison, which steels had the same chemical compositions as those in the Example 1 of the fourth invention, were prepared while changing the center-line mean roughness (Ra) of the cold-rolling rolls in the cold-rolling treatment, and the integral value of amplitude spectra in a wavelength region of from 100 to 2,000 μm, which amplitude spectra were obtained through the Fourier transformation of the profile curve of the cold-rolled steel sheet, within the scope of the present invention.

Then, various alloying-treated iron-zinc alloy dip-plated steel sheets within the scope of the present invention were manufactured by subjecting each of the thus prepared cold-rolled steel sheets to a zinc dip-plating treatment, an alloying treatment and a temper-rolling treatment in this order, while changing the conditions of these treatment within the scope of the present invention. The thus manufactured alloying-treated iron-zinc alloy dip-plated steel sheets comprised a plurality of plated steel sheets each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples within the scope of the present invention (hereinafter referred to as the "samples of the invention") were prepared from the thus manufactured plurality of alloying-treated iron-zinc alloy dip-plated steel sheets each having an alloying-treated iron-zinc alloy dip-plating layer formed on each of the both surfaces thereof.

For comparison purposes, various alloying-treated iron-zinc alloy dip-plated steel sheets outside the scope of the present invention were manufactured by subjecting a plurality of hot-rolled steel sheets to a cold-rolling treatment, a zinc dip-plating treatment, an alloying treatment and a temper-rolling treatment under conditions in which at least one of the total amount of solid-solution of carbon (C), nitrogen (N) and boron (B) in the cold-rolled steel sheet, the cold-rolling treatment condition, the zinc dip-plating treatment condition, the alloying treatment condition and the temper-rolling treatment condition was outside the scope of the present invention. The thus manufactured alloying-treated iron-zinc alloy dip-plated steel sheets comprised a plurality of plated steel sheets each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples outside the scope of the present invention (hereinafter referred to as the "samples for comparison") were prepared from the thus manufactured plurality of alloying-treated iron-zinc alloy dip-plated steel sheets each having an alloying-treated iron-zinc alloy dip-plating layer formed on each of the both surfaces thereof.

For each of the samples of the invention and the samples for comparison, the kind of steel, the total amount of solid-solution of carbon (C), nitrogen (N) and boron (B) in the cold-rolled steel sheet, the center-line mean roughness (Ra) of the cold-rolling rolls in the cold-rolling treatment, the integral value of amplitude spectra in a wavelength region of from 100 to 2,000 μm, which amplitude spectra were obtained through the Fourier transformation of the profile curve of the cold-rolled steel sheet, the plating weight and the aluminum content in the zinc dip-plating bath in the zinc dip-plating treatment, the alloying treatment temperature in the alloying treatment, the center-line mean roughness (Ra) of the temper-rolling rolls in the temper-rolling treatment, the integral value of amplitude spectra in a wavelength region of from 100 to 2,000 μm, which amplitude spectra were obtained through the Fourier transformation of the profile curve of the alloying-treated iron-zinc alloy dip-plated steel sheet after the temper-rolling treatment, and the elongation rate in the temper-rolling treatment, are shown in Tables 18 and 19.

TABLE 18

| Sample No. | Symbol of steel | Amount of solid-solution of C, N & B (ppm) | Plating weight ($g/m^2$) | Al concentration in bath (wt. %) | Alloying temperature (°C.) | Ra of cold-rolling roll (μm) | Integral of amplitude spectra of cold-rolled sheet ($\mu m^3$) | Ra of temper-rolling roll (μm) | Integral of amplitude spectra of temper-rolled sheet ($\mu m^3$) | Elongation rate of temper-rolling (%) | Press-formability: Coefficient of friction | Press-formability: Evaluation | Powdering resistance: Amount of peeloff ($g/m^2$) | Powdering resistance: Evaluation | Image clarity after painting: NSIC-value | Image clarity after painting: Evaluation | Remarks |
|---|---|---|---|---|---|---|---|---|---|---|---|---|---|---|---|---|---|
| 229 | B-2 | 5 | 45 | 0.14 | 510 | 0.08 | 200 | 0.3 | 80 | 0.7 | 0.142 | Good | 3.2 | Good | 92.1 | Good | Sample of the invention (susceptible to roll defects) |
| 230 | B-2 | 5 | 45 | 0.14 | 510 | 0.1 | 210 | 0.3 | 144 | 0.7 | 0.143 | Good | 3.5 | Good | 91.5 | Good | Sample of the invention |
| 231 | B-2 | 5 | 45 | 0.14 | 510 | 0.3 | 180 | 0.3 | 130 | 0.7 | 0.144 | Good | 3.6 | Good | 93.0 | Good | Sample of the invention |
| 232 | B-2 | 5 | 45 | 0.14 | 510 | 0.5 | 230 | 0.3 | 140 | 0.7 | 0.143 | Good | 3.4 | Good | 92.6 | Good | Sample of the invention |
| 233 | B-2 | 5 | 45 | 0.14 | 510 | 0.8 | 300 | 0.3 | 176 | 0.7 | 0.142 | Good | 3.3 | Good | 91.5 | Good | Sample of the invention |
| 234 | B-2 | 5 | 45 | 0.14 | 510 | 0.9 | 400 | 0.3 | 246 | 0.7 | 0.146 | Good | 3.1 | Good | 75.3 | Fair | Sample of the invention |
| 235 | B-2 | 5 | 45 | 0.14 | 510 | 0.5 | 550 | 0.3 | 252 | 5.0 | 0.148 | Good | 3.2 | Good | 78.0 | Fair | Sample of the invention |
| 236 | B-2 | 5 | 45 | 0.14 | 510 | 0.5 | 212 | 0.3 | 240 | 0.0 | 0.143 | Good | 3.5 | Good | 79.0 | Fair | Sample of the invention |
| 237 | B-2 | 5 | 45 | 0.14 | 510 | 0.5 | 212 | 0.3 | 170 | 0.3 | 0.143 | Good | 3.5 | Good | 90.0 | Good | Sample of the invention |
| 238 | B-2 | 5 | 30 | 0.14 | 510 | 0.5 | 212 | 0.3 | 80 | 0.7 | 0.144 | Good | 3.6 | Good | 92.0 | Good | Sample of the invention |
| 239 | B-2 | 5 | 45 | 0.14 | 510 | 0.5 | 212 | 0.3 | 80 | 0.7 | 0.144 | Good | 3.6 | Good | 92.0 | Good | Sample of the invention |
| 240 | B-2 | 5 | 60 | 0.14 | 510 | 0.5 | 212 | 0.3 | 80 | 0.7 | 0.144 | Good | 3.6 | Good | 92.0 | Good | Sample of the invention |
| 241 | B-2 | 5 | 45 | 0.14 | 510 | 0.5 | 230 | 0.3 | 50 | 3.0 | 0.141 | Good | 3.3 | Good | 93.0 | Good | Sample of the invention |
| 242 | B-2 | 5 | 45 | 0.14 | 510 | 0.5 | 210 | 0.3 | 30 | 5.0 | 0.144 | Good | 3.1 | Good | 94.0 | Good | Sample of the invention |
| 243 | B-2 | 5 | 45 | 0.14 | 510 | 0.5 | 230 | 0.3 | 20 | 6.0 | 0.140 | Good | 4.1 | Good | 96.0 | Good | Sample for comparison (quality degraded) |
| 244 | B-2 | 5 | 45 | 0.14 | 450 | 0.5 | 220 | 0.3 | 144 | 0.7 | 0.165 | Poor | 3.2 | Good | 92.0 | Good | Sample for comparison |

TABLE 19

| Sample No. | Symbol of steel | Amount of solid-solution of C, N & B (ppm) | Plating weight ($g/m^2$) | Al concentration in bath (wt. %) | Alloying temperature (°C.) | Ra of cold-rolling roll (μm) | Integral of amplitude spectra of cold-rolled sheet ($\mu m^3$) | Ra of temper-rolling roll (μm) | Integral of amplitude spectra of temper-rolled sheet ($\mu m^3$) | Elongation rate of temper-rolling (%) | Press-formability: Coefficient of friction | Press-formability: Evaluation | Powdering resistance: Amount of peeloff ($g/m^2$) | Powdering resistance: Evaluation | Image clarity after painting: NSIC-value | Image clarity after painting: Evaluation | Remarks |
|---|---|---|---|---|---|---|---|---|---|---|---|---|---|---|---|---|---|
| 245 | B-2 | 5 | 45 | 0.14 | 475 | 0.5 | 220 | 0.3 | 150 | 0.7 | 0.155 | Poor | 3.2 | Good | 91.0 | Good | Sample for comparison |
| 246 | B-2 | 5 | 45 | 0.14 | 510 | 0.5 | 220 | 0.3 | 130 | 0.7 | 0.140 | Good | 3.6 | Good | 92.0 | Good | Sample of the invention |
| 247 | B-1 | 0 | 45 | 0.14 | 510 | 0.5 | 212 | 0.8 | 130 | 0.7 | 0.143 | Good | 8.5 | Poor | 91.5 | Good | Sample for comparison (laser-textured dull roll used) |
| 248 | B-2 | 5 | 45 | 0.14 | 540 | 0.5 | 212 | 0.3 | 100 | 0.7 | 0.139 | Good | 3.9 | Good | 91.5 | Good | Sample of the invention |
| 249 | B-2 | 5 | 45 | 0.14 | 570 | 0.5 | 212 | 0.3 | 80 | 0.7 | 0.139 | Good | 4.2 | Good | 92.0 | Good | Sample of the invention |
| 250 | B-2 | 5 | 45 | 0.14 | 600 | 0.5 | 220 | 0.3 | 50 | 0.7 | 0.143 | Good | 4.5 | Good | 92.0 | Good | Sample of the invention |
| 251 | B-2 | 5 | 45 | 0.14 | 620 | 0.5 | 220 | 0.3 | 142 | 0.7 | 0.155 | Poor | 6.5 | Poor | 92.0 | Good | Sample for comparison |
| 252 | B-2 | 5 | 45 | 0.04 | 540 | 0.5 | 212 | 0.3 | 130 | 0.7 | 0.185 | Poor | 7.2 | Poor | 92.0 | Good | Sample for comparison |
| 253 | B-2 | 5 | 45 | 0.08 | 540 | 0.5 | 223 | 0.3 | 130 | 0.7 | 0.148 | Good | 4.2 | Good | 92.0 | Good | Sample of the invention |
| 254 | B-2 | 5 | 45 | 0.12 | 540 | 0.5 | 223 | 0.3 | 130 | 0.7 | 0.142 | Good | 3.6 | Good | 92.0 | Good | Sample of the invention |
| 255 | B-2 | 5 | 45 | 0.16 | 540 | 0.5 | 232 | 0.3 | 130 | 0.7 | 0.138 | Good | 3.6 | Good | 92.0 | Good | Sample of the invention |
| 256 | B-2 | 5 | 45 | 0.20 | 540 | 0.5 | 212 | 0.3 | 130 | 0.7 | 0.138 | Good | 3.6 | Good | 92.0 | Good | Sample of the invention |
| 257 | B-2 | 5 | 45 | 0.30 | 540 | 0.5 | 250 | 0.3 | 130 | 0.7 | 0.139 | Good | 3.6 | Good | 92.0 | Good | Sample of the invention |
| 258 | B-2 | 5 | 30 | 0.32 | 540 | 0.5 | 220 | 0.3 | 130 | 0.7 | — | — | — | — | — | — | Sample for comparison (no alloying reaction) |
| 259 | B-2 | 5 | 45 | 0.14 | 510 | 0.5 | 220 | 0.6 | 226 | 0.7 | 0.140 | Good | 3.6 | Good | 80.0 | Fair | Sample of the invention |

For each of the samples of the invention and the samples for comparison, press-formability, powdering resistance and image clarity after painting were investigated in accordance with the same methods as those in the Example 1 of the fourth invention. The criteria for evaluation of press-formability, powdering resistance and image clarity after painting were the same as those in the Example 1 of the fourth invention. The results of test are shown also in Tables 18 and 19.

As is clear from Tables 18 and 19, the sample of the invention No. 229 was good in all of press-formability, powdering resistance and image clarity after painting. However, because the center-line mean roughness (Ra) of the cold-rolling rolls was small in the manufacturing method of the sample of the invention No. 229, the sample of the invention No. 229 showed a slightly degraded quality of the cold-rolled steel sheet as a result of an easy occurrence of roll defects on the cold-rolling rolls. In the manufacturing method of the samples of the invention Nos. 234 to 236, the hot-rolled steel sheet was cold-rolled with the use of the cold-rolling rolls which gave a high integral value of amplitude spectra to the cold-rolled steel sheet, and the alloying-treated iron-zinc alloy dip-plated steel sheet was temper-rolled with the use of the conventional temper-rolling rolls which gave a high integral value of amplitude spectra to the temper-rolled alloying-treated iron-zinc alloy dip-plated steel sheet. As a result, the samples of the invention Nos. 234 to 236 were somewhat poor in image clarity after painting.

The sample for comparison No. 247 was poor in powdering resistance because a cold-rolled steel sheet of which the surface profile was imparted with the use of the laser-textured dull rolls. The sample for comparison No. 243 was poor in quality of the alloying-treated iron-zinc alloy dip-plated steel sheet because the elongation rate in the temper-rolling treatment was high outside the scope of the present invention. The samples for comparison Nos. 244 and 245 were poor in press-formability because the alloying treatment temperature was low outside the scope of the present invention. The sample for comparison No. 251 was poor in powdering resistance because the alloying treatment temperature was high outside the scope of the present invention. The sample for comparison No. 252 was poor in powdering resistance because the aluminum content in the zinc dip-plating bath was small outside the scope of the present invention.

In the sample for comparison No. 258, no alloying reaction took place between iron and zinc because the aluminum content in the zinc dip-plating bath was large outside the scope of the present invention. The sample for comparison No. 259 was poor in image clarity after painting, because the center-line mean roughness (Ra) of the temper-rolling rolls was high outside the scope of the present invention, and the integral value of amplitude spectra in a wavelength region of from 100 to 2,000 μm, which amplitude spectra were obtained through the Fourier transformation of the profile curve of the alloying-treated iron-zinc alloy dip-plated steel sheet after the temper-rolling treatment, was high outside the scope of the present invention.

In contrast, all the samples of the invention Nos. 230 to 233, 237 to 241, 246, 248 to 250, and 253 to 257 were good in all of press-formability, powdering resistance and image clarity after painting, because the total amount of solid-solution of carbon (C), nitrogen (N) and boron (B) in the cold-rolled steel sheet, the center-line mean roughness (Ra) of the cold-rolling rolls in the cold-rolling treatment, the integral value of amplitude spectra in a wavelength region of from 100 to 2,000 μm, which amplitude spectra were obtained through the Fourier transformation of the profile curve of the cold-rolled steel sheet, the plating weight and the aluminum content in the zinc dip-plating bath in the zinc dip-plating treatment, the alloying treatment temperature in the alloying treatment, the center-line mean roughness (Ra) of the temper-rolling rolls in the temper-rolling treatment, the integral value of amplitude spectra in a wavelength region of from 100 to 2,000 μm, which amplitude spectra were obtained through the Fourier transformation of the profile curve of the alloying-treated iron-zinc alloy dip-plated steel sheet after the temper-rolling treatment, and the elongation rate in the temper-rolling treatment, were all within the scope of the present invention.

Now, the method of the fifth invention for manufacturing an alloying-treated iron-zinc alloy dip-plated steel sheet, is described below further in detail by means of examples while comparing with examples for comparison.

EXAMPLE 1 OF THE FIFTH INVENTION

Various alloying-treated iron-zinc alloy dip-plated steel sheets having a prescribed plating weight, within the scope of the present invention, were manufactured by means of a continuous zinc dip-plating line, with the use of a plurality of IF steel-based cold rolled steel sheets having a thickness of 0.8 mm. More specifically, each of the above-mentioned plurality of cold-rolled steel sheets was subjected to a zinc dip-plating treatment, an alloying treatment, and a temper-rolling treatment under conditions within the scope of the method of the fifth invention, while changing the conditions of these treatments. The thus manufactured alloying-treated iron-zinc alloy dip-plated steel sheets comprised a plurality of plated steel sheets each having a plating weight of 30 $g/m^2$ per surface of the steel sheet, a plurality of plated steel sheets each having a plating weight of 45 $g/m^2$ per surface of the steel sheet, and a plurality of plated steel sheets each having a plating weight of 60 $g/m^2$ per surface of the steel sheet. A plurality of samples within the scope of the present invention (hereinafter referred to as the "samples of the invention") were prepared from the thus manufactured plurality of alloying-treated iron-zinc alloy dip-plated steel sheets each having an alloying-treated iron-zinc alloy dip-plating layer formed on each of the both surfaces thereof.

For comparison purposes, various alloying-treated iron-zinc alloy dip-plated steel sheets outside the scope of the present invention, were manufactured by subjecting a plurality of cold-rolled steel sheets to a zinc dip-plating treatment, an alloying treatment and a temper-rolling treatment under conditions in which at least one of the zinc dip-plating treatment condition and the alloying treatment condition was outside the scope of the present invention. The thus manufactured alloying-treated iron-zinc alloy dip-plated steel sheets comprised a plurality of plated steel sheets each having a plating weight of 30 $g/m^2$ per surface of the steel sheet, a plurality of plated steel sheets each having a plating weight of 45 $g/m^2$ per surface of the steel sheet, and a plurality of plated steel sheets each having a plating weight of 60 $g/m^2$ per surface of the steel sheet. A plurality of samples outside the scope of the present invention (hereinafter referred to as the "samples for comparison") were prepared from the thus manufactured plurality of alloying-treated iron-zinc alloy dip-plated steel sheets each having an alloying-treated iron-zinc alloy dip-plating layer formed on each of the both surfaces thereof.

For each of the samples of the invention and the samples for comparison, the plating weight in the zinc dip-plating treatment and the aluminum content in the zinc dip-plating bath in the zinc dip-plating treatment; the alloying treatment temperature in the alloying treatment; and the elongation rate in the temper-rolling treatment, are shown in Tables 20 and 21.

TABLE 20

| Sample No | Plating weight (g/m²) | Al concentration in bath (wt. %) | Alloying temp. (°C.) | Elongation rate of temper-rolling (%) | Press-formability: Coefficient of friction | Press-formability: Evaluation | Powdering resistance: Amount peeloff of (g/m²) | Powdering resistance: Evaluation | Image clarity after painting: NSIC-value | Image clarity after painting: Evaluaton | Remarks |
|---|---|---|---|---|---|---|---|---|---|---|---|
| 260 | 45 | 0.05 | 500 | 0.7 | 0.180 | Poor | 8.0 | Poor | 90.0 | Good | Sample for comparison |
| 261 | 45 | 0.08 | 500 | 0.7 | 0.161 | Poor | 6.5 | Poor | 89.0 | Good | Sample for comparison |
| 262 | 45 | 0.10 | 500 | 0.7 | 0.148 | Good | 4.9 | Good | 88.0 | Good | Sample of the invention |
| 263 | 45 | 0.12 | 450 | 0.7 | 0.165 | Poor | 3.2 | Good | 89.0 | Good | Sample for comparison |
| 264 | 45 | 0.12 | 500 | 0.7 | 0.145 | Good | 4.3 | Good | 87.0 | Good | Sample of the invention |
| 265 | 45 | 0.12 | 500 | 0.7 | 0.145 | Good | 9.5 | Poor | 90.5 | Good | Sample for comparison |
| 266 | 45 | 0.12 | 540 | 0.7 | 0.142 | Good | 4.5 | Good | 90.2 | Good | Sample of the invention |
| 267 | 45 | 0.12 | 560 | 0.7 | 0.153 | Poor | 4.9 | Good | 89.5 | Good | Sample for comparison |
| 268 | 45 | 0.12 | 610 | 0.7 | 0.142 | Good | 7.2 | Poor | 88.0 | Good | Sample for comparison |
| 269 | 45 | 0.14 | 450 | 0.7 | 0.165 | Poor | 2.3 | Good | 90.0 | Good | Sample for comparison |
| 270 | 45 | 0.14 | 475 | 0.7 | 0.153 | Poor | 3.5 | Good | 91.0 | Good | Sample for comparison |
| 271 | 30 | 0.14 | 500 | 0.7 | 0.138 | Good | 2.3 | Good | 87.8 | Good | Sample of the invention |
| 272 | 45 | 0.14 | 500 | 0.7 | 0.140 | Good | 4.1 | Good | 87.8 | Good | Sample of the invention |
| 273 | 60 | 0.14 | 500 | 0.7 | 0.143 | Good | 4.4 | Good | 87.8 | Good | Sample of the invention |
| 274 | 45 | 0.14 | 500 | 0.7 | 0.145 | Good | 8.2 | Poor | 88.0 | Good | Sample for comparison laser textured dull roll used) |
| 275 | 30 | 0.14 | 525 | 0.7 | 0.140 | Good | 2.3 | Good | 90.0 | Good | Sample of the invention |
| 276 | 45 | 0.14 | 525 | 0.7 | 0.141 | Good | 4.4 | Good | 90.0 | Good | Sample of the invention |
| 277 | 60 | 0.14 | 525 | 0.7 | 0.144 | Good | 4.6 | Good | 90.0 | Good | Sample of the invention |
| 278 | 45 | 0.14 | 550 | 0.7 | 0.142 | Good | 4.8 | Good | 91.0 | Good | Sample of the invention |
| 279 | 45 | 0.14 | 570 | 0.7 | 0.151 | Poor | 4.9 | Good | 91.0 | Good | Sample for comparison |

TABLE 21

| Sample No | Plating weight (g/m²) | Al concentration in bath (wt. %) | Alloying temp. (°C.) | Elongation rate of temper-rolling (%) | Press formability: Coefficient of friction | Press formability: Evaluation | Powdering resistance: Amount peeloff of (g/m²) | Powdering resistance: Evaluation | Image clarity after painting: NSIC-value | Image clarity after painting: Evaluaton | Remarks |
|---|---|---|---|---|---|---|---|---|---|---|---|
| 280 | 45 | 0.14 | 620 | 0.7 | 0.155 | Poor | 7.5 | Poor | 90.5 | Good | Sample for comparison |
| 281 | 45 | 0.16 | 450 | 0.7 | 0.165 | Poor | 2.3 | Good | 90.0 | Good | Sample for comparison |
| 282 | 45 | 0.16 | 475 | 0.7 | 0.155 | Poor | 2.5 | Good | 90.0 | Good | Sample for comparison |
| 283 | 45 | 0.16 | 510 | 0.7 | 0.138 | Good | 2.1 | Good | 89.0 | Good | Sample of the invention |
| 284 | 45 | 0.16 | 510 | 0.7 | 0.141 | Good | 7.5 | Poor | 88.5 | Good | Sample for comparison (laser-tex- |

TABLE 21-continued

| Sample No | Plating weight (g/m²) | Al concentration in bath (wt. %) | Alloying temp. (°C.) | Elongation rate of temper-rolling (%) | Press formability: Coefficient of friction | Press formability: Evaluation | Powdering resistance: Amount peeloff of (g/m²) | Powdering resistance: Evaluation | Image clarity after painting: NSIC-value | Image clarity after painting: Evaluaton | Remarks |
|---|---|---|---|---|---|---|---|---|---|---|---|
| | | | | | | | | | | | tured dull roll used) |
| 285 | 45 | 0.16 | 525 | 0.7 | 0.138 | Good | 3.5 | Good | 90.0 | Good | Sample of the invention |
| 286 | 45 | 0.16 | 550 | 0.7 | 0.141 | Good | 4.3 | Good | 90.0 | Good | Sample of the invention |
| 287 | 45 | 0.16 | 600 | 0.7 | 0.151 | Poor | 4.6 | Good | 90.0 | Good | Sample for comparison |
| 288 | 45 | 0.16 | 650 | 0.7 | 0.153 | Poor | 6.2 | Poor | 91.3 | Good | Sample for comparison |
| 289 | 45 | 0.20 | 450 | 0.7 | 0.153 | Poor | 2.2 | Good | 91.2 | Good | Sample for comparison |
| 290 | 45 | 0.20 | 500 | 0.7 | 0.141 | Good | 2.3 | Good | 88.0 | Good | Sample for comparison (much time required for alloying) |
| 291 | 45 | 0.20 | 550 | 0.7 | 0.140 | Good | 3.8 | Good | 88.0 | Good | Sample of the invention |
| 292 | 45 | 0.20 | 580 | 0.7 | 0.141 | Good | 4.1 | Good | 89.0 | Good | Sample of the invention |
| 293 | 45 | 0.20 | 650 | 0.7 | 0.141 | Good | 5.8 | Poor | 89.2 | Good | Sample for comparison |
| 294 | 45 | 0.25 | 500 | 0.7 | 0.138 | Good | 2.2 | Good | 89.0 | Good | Sample for comparison (much time required for alloying) |
| 295 | 45 | 0.25 | 550 | 0.7 | 0.139 | Good | 2.2 | Good | 89.0 | Good | Sample of the invention |
| 296 | 45 | 0.25 | 600 | 0.7 | 0.141 | Good | 3.4 | Good | 90.0 | Good | Sample of the invention |
| 297 | 45 | 0.25 | 650 | 0.7 | 0.152 | Poor | 5.2 | Poor | 88.0 | Good | Sample for comparison |
| 298 | 45 | 0.30 | 500 | 0.7 | — | — | — | — | — | — | Sample for comparison (no alloying reaction) |
| 299 | 45 | 0.30 | 600 | 0.7 | — | — | — | — | — | — | Sample for comparison (no alloying reaction) |

For each of the samples of the invention and the samples for comparison, press-formability, powdering resistance and image clarity after painting were investigated in accordance with the following test methods.

Press-formability was tested in accordance with the same method as in the Example 1 of the third invention. The criteria for evaluation of press-formability were also the same as those in the Example 1 of the third invention. The test results of press-formability are shown also in Tables 20 and 21.

Powdering resistance was tested in accordance with the same method as in the Example 1 of the third invention. The criteria for evaluation of powdering resistance were also the same as those in the Example 1 of the third invention. The test results of powdering resistance are shown also in Tables 20 and 21.

Image clarity after painting was tested in accordance with the same method as in the Example 1 of the third invention. The criteria for evaluation of image clarity after painting were also the same as those in the Example 1 of the third invention. The test results of image clarity after painting are shown also in Tables 20 and 21.

As is clear from Tables 20 and 21, the samples for comparison Nos. 260, 261, 263, 267 to 270, 279 to 282, 287 to 289, 293 and 297 to 299 were poor in any of press-formability, powdering resistance and image clarity after painting, because any of the aluminum content in the zinc dip-plating bath and the alloying treatment temperature was outside the scope of the present invention. The samples for comparison Nos. 265, 274 and 284 were poor in powdering resistance, because, although the aluminum content in the zinc dip-plating bath and the alloying treatment temperature were within the scope of the present invention, each plated steel sheet was temper-rolled with the use of the laser-textured dull rolls, and as a result, the plating layer was damaged. In the samples for comparison Nos. 290 and 294, completion of the alloying treatment between iron and zinc required a considerable period of time, because the alloying treatment temperature was low.

In contrast, the samples of the invention Nos. 262, 264, 266, 271 to 273, 275 to 278, 283, 285, 286, 291, 292, 295 and 296 were good in all of press-formability, powdering resistance and image clarity after painting.

EXAMPLE 2 OF THE FIFTH INVENTION

A plurality of cold-rolled steel sheets were prepared by subjecting a plurality of IF steel-based hot-rolled steel sheets having a thickness of 0.8 mm to a cold-rolling treatment in accordance with the cold-rolling conditions within the scope of the present invention. Then, various alloying-treated iron-zinc alloy dip-plated steel sheets within the scope of the present invention, were manufactured by subjecting each of the thus prepared cold-rolled steel sheets to a zinc dip-plating treatment, an alloying treatment and a temper-rolling treatment in this order, while changing the conditions of these treatments within the scope of the present invention. The thus manufactured alloying-treated iron-zinc alloy dip-plated steel sheets comprised a plurality of plated steel sheets each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples within the scope of the present invention (hereinafter referred to as the "samples of the invention") were prepared from the thus manufactured plurality of alloying-treated iron-zinc alloy dip-plated steel sheets each having an alloying-treated iron-zinc alloy dip-plating layer formed on each of the both surfaces thereof.

For comparison purposes, various alloying-treated iron-zinc alloy dip-plated steel sheets outside the scope of the present invention, were manufactured by subjecting a plurality of hot-rolled steel sheets to a cold-rolling treatment, a zinc dip-plating treatment, an alloying treatment and a temper-rolling treatment under conditions in which at least one of the cold-rolling treatment condition, the zinc dip-plating treatment condition, the alloying treatment condition, and the temper-rolling treatment condition was outside the scope of the present invention. The thus manufactured alloying-treated iron-zinc alloy dip-plated steel sheets comprised a plurality of plated steel sheet each having a plating weight of 30 g/m$^2$ per surface of the steel sheet, a plurality of plated steel sheets each having a plating weight of 45 g/m$^2$ per surface of the steel sheet, and a plurality of plated steel sheets each having a plating weight of 60 g/m$^2$ per surface of the steel sheet. A plurality of samples outside the scope of the present invention (hereinafter referred to as the "samples for comparison") were prepared from the thus manufactured alloying-treated iron-zinc alloy dip-plated steel sheets each having an alloying-treated iron-zinc alloy dip-plating layer formed on each of the both surfaces thereof.

For each of the samples of the invention and the samples for comparison, the center-line mean roughness (Ra) of the cold-rolling rolls in the cold-rolling treatment, and the integral value of amplitude spectra in a wavelength region of from 100 to 2,000 μm, which amplitude spectra were obtained through the Fourier transformation of the profile curve of the cold-rolled steel sheet; the plating weight and the aluminum content in the zinc dip-plating bath in the zinc dip-plating treatment; the alloying treatment temperature in the alloying treatment; and the center-line mean roughness (Ra) of the temper-rolling rolls, the elongation rate in the temper-rolling treatment, and the integral value of amplitude spectra in a wavelength region of from 100 to 2,000 μm, which amplitude spectra were obtained through the Fourier transformation of the profile curve of the temper-rolled alloying-treated iron-zinc alloy dip-plated steel sheets, are shown in Tables 22 and 23.

TABLE 22

| Sample No. | Plating weight ($g/m^2$) | Al concentration in bath (wt. %) | Alloying temp. (°C.) | Ra of cold-rolling roll (μm) | Integral of amplitude spectra of cold-rolled sheet ($\mu m^3$) | Ra of temper-rolling roll (μm) | Integral of amplitude spectra of temper-rolled sheet ($\mu m^3$) | Elongation rate of temper-rolling (%) | Press-formability: Coefficient of friction | Press-formability: Evaluation | Powdering resistance: Amount of peeloff ($g/m^2$) | Powdering resistance: Evaluation | Imgage clarity after painting: NSIC-value | Imgage clarity after painting: Evaluation | Remarks |
|---|---|---|---|---|---|---|---|---|---|---|---|---|---|---|---|
| 300 | 45 | 0.14 | 500 | 0.08 | 200 | 0.3 | 80 | 0.7 | 0.142 | Good | 3.2 | Good | 92.1 | Good | Sample for comparison (roll defects produced) |
| 301 | 45 | 0.14 | 500 | 0.1 | 210 | 0.3 | 144 | 0.7 | 0.143 | Good | 3.5 | Good | 91.5 | Good | Sample of the invention |
| 302 | 45 | 0.14 | 500 | 0.3 | 180 | 0.3 | 130 | 0.7 | 0.144 | Good | 3.6 | Good | 93.0 | Good | Sample of the invention |
| 303 | 45 | 0.14 | 500 | 0.5 | 230 | 0.3 | 140 | 0.7 | 0.143 | Good | 3.4 | Good | 92.6 | Good | Sample of the invention |
| 304 | 45 | 0.14 | 500 | 0.8 | 300 | 0.3 | 176 | 0.7 | 0.142 | Good | 3.3 | Good | 91.5 | Good | Sample of the invention |
| 305 | 45 | 0.14 | 500 | 0.9 | 400 | 0.3 | 246 | 0.7 | 0.146 | Good | 3.1 | Good | 75.3 | Poor | Sample for comparison |
| 306 | 45 | 0.14 | 500 | 0.5 | 550 | 0.3 | 252 | 5.0 | 0.148 | Good | 3.2 | Good | 78.0 | Poor | Sample for comparison |
| 307 | 45 | 0.14 | 500 | 0.5 | 212 | 0.3 | 240 | 0.0 | 0.143 | Good | 3.5 | Good | 79.0 | Poor | Sample for comparison |
| 308 | 45 | 0.14 | 500 | 0.5 | 212 | 0.3 | 170 | 0.3 | 0.143 | Good | 3.5 | Good | 90.0 | Good | Sample of the invention |
| 309 | 30 | 0.14 | 500 | 0.5 | 212 | 0.3 | 80 | 0.7 | 0.144 | Good | 3.6 | Good | 92.0 | Good | Sample of the invention |
| 310 | 45 | 0.14 | 500 | 0.5 | 212 | 0.3 | 80 | 0.7 | 0.144 | Good | 3.6 | Good | 92.0 | Good | Sample of the invention |
| 311 | 60 | 0.14 | 500 | 0.5 | 212 | 0.3 | 80 | 0.7 | 0.144 | Good | 3.6 | Good | 92.0 | Good | Sample of the invention |
| 312 | 45 | 0.14 | 500 | 0.5 | 230 | 0.3 | 50 | 3.0 | 0.141 | Good | 3.3 | Good | 93.0 | Good | Sample of the invention |
| 313 | 45 | 0.14 | 500 | 0.5 | 210 | 0.3 | 30 | 5.0 | 0.144 | Good | 3.1 | Good | 94.0 | Good | Sample of the invention |
| 314 | 45 | 0.14 | 500 | 0.5 | 230 | 0.3 | 20 | 6.0 | 0.140 | Good | 4.1 | Good | 96.0 | Good | Sample for comparison (quality degraded) |
| 315 | 45 | 0.14 | 450 | 0.5 | 220 | 0.3 | 144 | 0.7 | 0.165 | Poor | 3.2 | Good | 92.0 | Good | Sample for comparison |

TABLE 23

| Sample No. | Plating weight ($g/m^2$) | Al concentration in bath (wt. %) | Alloying temp. (°C.) | Ra of cold-rolling roll (μm) | Integral of amplitude spectra of cold-rolled sheet ($\mu m^3$) | Ra of temper-rolling roll (μm) | Integral of amplitude spectra of temper-rolled sheet ($\mu m^3$) | Elongation rate of temper-rolling (%) | Press-formability: Coefficient of friction | Press-formability: Evaluation | Powdering resistance: Amount of peeloff ($g/m^2$) | Powdering resistance: Evaluation | Imgage clarity after painting: NSIC-value | Imgage clarity after painting: Evaluation | Remarks |
|---|---|---|---|---|---|---|---|---|---|---|---|---|---|---|---|
| 316 | 45 | 0.14 | 475 | 0.5 | 220 | 0.3 | 150 | 0.7 | 0.155 | Poor | 3.2 | Good | 91.0 | Good | Sample for comparison |
| 317 | 45 | 0.14 | 500 | 0.5 | 220 | 0.3 | 130 | 0.7 | 0.140 | Good | 3.6 | Good | 92.0 | Good | Sample of the invention |
| 318 | 45 | 0.14 | 500 | 0.5 | 212 | 0.8 | 130 | 0.7 | 0.143 | Good | 8.5 | Poor | 91.5 | Good | Sample for comparison (laser-textured dull roll used) |
| 319 | 45 | 0.14 | 525 | 0.5 | 212 | 0.3 | 100 | 0.7 | 0.139 | Good | 3.9 | Good | 91.5 | Good | Sample of the invention |
| 320 | 45 | 0.14 | 550 | 0.5 | 212 | 0.3 | 80 | 0.7 | 0.139 | Good | 4.2 | Good | 92.0 | Good | Sample of the invention |
| 321 | 45 | 0.14 | 600 | 0.5 | 220 | 0.3 | 50 | 0.7 | 0.153 | Poor | 4.5 | Good | 92.0 | Good | Sample for comparison |
| 322 | 45 | 0.14 | 650 | 0.5 | 220 | 0.3 | 142 | 0.7 | 0.155 | Poor | 6.5 | Poor | 92.0 | Good | Sample for comparison |
| 323 | 45 | 0.05 | 540 | 0.5 | 212 | 0.3 | 130 | 0.7 | 0.185 | Poor | 7.2 | Poor | 92.0 | Good | Sample for comparison |
| 324 | 45 | 0.08 | 540 | 0.5 | 212 | 0.3 | 130 | 0.7 | 0.172 | Poor | 5.5 | Poor | 92.0 | Good | Sample for comparison |
| 325 | 45 | 0.10 | 540 | 0.5 | 223 | 0.3 | 130 | 0.7 | 0.148 | Good | 3.6 | Good | 92.0 | Good | Sample of the invention |
| 326 | 45 | 0.12 | 540 | 0.5 | 223 | 0.3 | 130 | 0.7 | 0.142 | Good | 3.6 | Good | 92.0 | Good | Sample of the invention |
| 327 | 45 | 0.16 | 540 | 0.5 | 232 | 0.3 | 130 | 0.7 | 0.138 | Good | 3.6 | Good | 92.0 | Good | Sample of the invention |
| 328 | 45 | 0.20 | 540 | 0.5 | 212 | 0.3 | 130 | 0.7 | 0.138 | Good | 3.6 | Good | 92.0 | Good | Sample of the invention |
| 329 | 45 | 0.25 | 540 | 0.5 | 250 | 0.3 | 130 | 0.7 | 0.139 | Good | 3.6 | Good | 92.0 | Good | Sample of the invention |
| 330 | 45 | 0.35 | 540 | 0.5 | 220 | 0.3 | 130 | 0.7 | — | — | — | — | — | — | Sample for comparison (no alloying reaction) |
| 331 | 45 | 0.14 | 500 | 0.5 | 220 | 0.6 | 226 | 0.7 | 0.140 | Good | 3.6 | Good | 80.0 | Poor | Sample for comparison |

For each of the samples of the invention and the samples for comparison, press-formability, powdering resistance and image clarity after painting were investigated in accordance with the following test methods.

Press-formability was tested in accordance with the same method as in the Example 1 of the third invention. The criteria for evaluation of press-formability were also the same as those in the Example 1 of the third invention. The test results of press-formability are shown also in Tables 22 and 23.

Powdering resistance was tested in accordance with the same method as in the Example 1 of the third invention. The criteria for evaluation of powdering resistance were also the same as those in the Example 1 of the third invention. The test results of powdering resistance are shown also in Tables 22 and 23.

Image clarity after painting was tested in accordance with the same method as in the Example 1 of the third invention. The criteria for evaluation of image clarity after painting were also the same as those in the Example 1 of the third invention. The test results of image clarity after painting are shown also in Tables 22 and 23.

As is clear from Tables 22 and 23, the sample for comparison No. 300 was good in all of press-formability, powdering resistance and image clarity after painting. However, because the center-line mean roughness (Ra) of the cold-rolling rolls was small outside the scope of the present invention in the manufacturing method of the sample for comparison No. 300, the sample for comparison No. 300 showed a degraded quality of the cold-rolled steel sheet as a result of occurrence of roll defects on the cold-rolling rolls. In the manufacturing method of the samples for comparison Nos. 305 to 307, the hot-rolled steel sheet was cold-rolled with the use of the cold-rolling rolls which gave a high integral value of amplitude spectra to the cold-rolled steel sheet, and the alloying-treated iron-zinc alloy dip-plated steel sheet was temper-rolled with the use of the conventional temper-rolling rolls which gave a high integral value of amplitude spectra to the temper-rolled alloying-treated iron-zinc alloy dip-plated steel sheet. As a result, the samples for comparison Nos. 305 to 307 were poor in image clarity after painting.

The sample for comparison No. 314, being good in all of press-formability, powdering resistance and image clarity after painting, showed a degraded product quality, because the elongation rate in the temper-rolling treatment was high outside the scope of the present invention. The samples for comparison Nos. 315 and 316 were poor in press-formability, because the alloying treatment temperature was low outside the scope of the present invention. The sample for comparison No. 318 was poor in powdering resistance, because a cold-rolled steel sheet of which the surface profile was imparted with the use of the laser-textured dull rolls. The samples for comparison Nos. 321 and 322 were poor in press-formability, because the alloying treatment temperature was high outside the scope of the present invention. The samples for comparison Nos. 323 and 324 were poor in press-formability and powdering resistance, because the aluminum content in the zinc dip-plating bath was small outside the scope of the present invention. In the sample for comparison No. 330, no alloying reaction took place between iron and zinc, because the aluminum content in the zinc dip-plating bath was large outside the scope of the present invention. The sample for comparison No. 331 was poor in image clarity after painting, because the integral value of amplitude spectra of the temper-rolled alloying-treated iron-zinc alloy dip-plated steel sheet was large outside the scope of the present invention.

In contrast, all the samples of the invention Nos. 301 to 304, 308 to 313, 317, 319, 320, and 325 to 329 were good in all of press-formability, powdering resistance and image clarity after painting, because the center-line mean roughness (Ra) of the cold-rolling rolls, the integral value of amplitude spectra of the cold-rolled steel sheet, the plating weight and the aluminum content in the zinc dip-plating bath in the zinc dip-plating treatment, the alloying treatment temperature in the alloying treatment, and the center-line mean roughness (Ra) of the temper-rolling rolls, the elongation rate, and the integral value of amplitude spectra of the temper-rolled alloying-treated iron-zinc alloy dip-plated steel sheet in the temper-rolling treatment, were all within the scope of the present invention.

As described above in detail, according to the first invention, it is possible to provide an alloying-treated iron-zinc alloy dip-plated steel sheet excellent in press-formability, which enables to solve the problems involved in the prior arts 1 to 4; according to the second invention, it is possible to provide an alloying-treated iron-zinc alloy dip-plated steel sheet excellent in press-formability and image clarity after painting, which enables to solve the problems involved in the prior arts 3 and 4; and according to the third to fifth inventions, it is possible to provide an alloying-treated iron-zinc alloy dip-plated steel sheet excellent in press-formability, which enables to solve the problems involved in the prior arts 5 to 7, thus providing many industrially useful effects.

What is claimed is:

1. An alloying-treated iron-zinc alloy dip-plated steel sheet excellent in press-formability, which comprises:

a steel sheet; and an alloying-treated iron-zinc alloy dip-plating layer formed on at least one surface of said steel sheet, said alloying-treated iron-zinc alloy dip-plating layer having numerous fine concavities on the surface thereof;

characterized in that:

the number of fine concavities having a depth of at least 2 μm from among said numerous fine concavities is within a range of from 200 to 8,200 per $mm^2$ of said alloying-treated iron-zinc alloy dip-plating layer; and the total opening area per unit area of said fine concavities having a depth of at least 2 μm in said alloying-treated iron-zinc alloy dip-plating layer, is within a range of from 10 to 70% of said unit area.

2. An alloying-treated iron-zinc alloy dip-plated steel sheet as claimed in claim 1, wherein:

said fine concavities having a depth of at least 2 μm further satisfies the following condition:

a bearing length ratio tp (80%) is up to 90%, said bearing length ratio tp (80%) being expressed, when cutting a roughness curve having a cutoff value of 0.8 mm over a prescribed length thereof by means of a straight line parallel to a mean line and located below the highest peak by 80% of a vertical distance between the highest peak and the lowest trough in said roughness curve, by a ratio in percentage of a total length of cut portions thus determined of said alloying-treated iron-zinc alloy dip-plating layer having a surface profile which corresponds to said roughness curve, relative to said prescribed length of said roughness curve.

3. An alloying-treated iron-zinc alloy dip-plated steel sheet excellent in press-formability and image clarity after painting, which comprises:

a steel sheet; and an alloying-treated iron-zinc alloy dip-plating layer formed on at least one surface of said steel sheet, said alloying-treated iron-zinc alloy dip-plating layer having numerous fine concavities on the surface thereof;

characterized in that:

the number of fine concavities having a depth of at least 2 μm from among said numerous fine concavities is within a range of from 200 to 8,200 per $mm^2$ of said alloying-treated iron-zinc alloy dip-plating layer; and said fine concavities having a depth of at least 2 μm further satisfy the following condition:

a bearing length ratio tp (2 μm) is within a range of from 30 to 90%, said bearing length ratio tp (2 μm) being expressed, when cutting a profile curve over a prescribed length thereof by means of a straight line parallel to a mean line and located below the highest peak in said profile curve by 2 μm, by a ratio in percentage of a total length of cut portions thus determined of said alloying-treated iron-zinc alloy dip-plating layer having a surface profile which corresponds to said profile curve, relative to said prescribed length of said profile curve.

4. An alloying-treated iron-zinc alloy dip-plated steel sheet as claimed in claim 3, wherein:

said fine concavities having a depth of at least 2 μm further satisfy the following condition:

a bearing length ratio tp (80%) is up to 90%, said bearing ratio tp (80%) being expressed, when cutting said profile curve over said prescribed length thereof by means of a straight line parallel to said mean line and located below the highest peak by 80% of a vertical distance between the highest peak and the lowest trough in said profile curve, by a ratio in percentage of a total length of cut portions thus determined of said alloy-treated iron-zinc alloy dip-plating layer having a surface profile which corresponds to said profile curve, relative to said prescribed length of said profile curve.

5. An alloying-treated iron-zinc alloy dip-plated steel sheet as claimed in any one of claims 1 to 4, wherein:

the number of said fine concavities having a depth of at least 2 μm is within a range of from 500 to 3,000 per $mm^2$ of said alloying-treated iron-zinc alloy dip-plating layer.

6. A method for manufacturing an alloying-treated iron-zinc alloy dip-plated steel sheet excellent in press-formability, which comprises the steps of:

subjecting a hot-rolled steel sheet to a cold-rolling treatment to prepare a cold-rolled steel sheet;

passing said cold-rolled steel sheet through a zinc dip-plating bath having a chemical composition comprising zinc, aluminum and incidental impurities to apply a zinc dip-plating treatment to said cold-rolled steel sheet, thereby forming a zinc dip-plating layer on at least one surface of said cold-rolled steel sheet;

subjecting said cold-rolled steel sheet having said zinc dip-plating layer thus formed on the surface thereof to an alloying treatment at a prescribed temperature, thereby forming an alloying-treated iron-zinc alloy dip-plating layer on said at least one surface of said cold-rolled steel sheet, said alloying-treated iron-zinc alloy dip-plating layer having numerous fine concavities; and then subjecting said cold-rolled steel sheet having said alloying-treated iron-zinc alloy dip-plating layer having said numerous fine concavities thus formed on the surface thereof to a temper-rolling, thereby manufacturing an alloying-treated iron-zinc alloy dip-plated steel sheet excellent in press-formability;

characterized by:

limiting the content of said aluminum in said zinc dip-plating bath within a range of from 0.05 to 0.30 wt. %;

limiting the temperature region causing an initial reaction for forming an iron-aluminum alloy layer in said zinc dip-plating treatment within a range of from 500° to 600° C.; and limiting said prescribed temperature in said alloying treatment within a range of from 480° to 600° C.

7. A method for manufacturing an alloying-treated iron-zinc alloy dip-plated steel sheet excellent in press-formability, which comprises the steps of:

subjecting a hot-rolled steel sheet to a cold-rolling treatment to prepare a cold-rolled steel sheet;

passing said cold-rolled steel sheet through a zinc dip-plating bath having a chemical composition comprising zinc, aluminum and incidental impurities to apply a zinc dip-plating treatment to said cold-rolled steel sheet, thereby forming a zinc dip-plating layer on at least one surface of said cold-rolled steel sheet;

subjecting said cold-rolled steel sheet having said zinc dip-plating layer thus formed on the surface thereof to an alloying treatment at a prescribed temperature, thereby forming an alloying-treated iron-zinc alloy dip-plating layer on said at least one surface of said cold-rolled steel sheet, said alloying-treated iron-zinc alloy dip-plating layer having numerous fine concavities; and then, subjecting said cold-rolled steel sheet having said alloying-treated iron-zinc alloy dip-plating layer having said numerous fine concavities thus formed on the surface thereof to a temper-rolling, thereby manufacturing an alloying-treated iron-zinc alloy dip-plated steel sheet excellent in press-formability;

characterized by:

using, as said cold-rolled steel sheet, a cold-rolled steel sheet into which at least one element selected from the group consisting of carbon, nitrogen and boron is dissolved in the form of solid-solution in an amount within a range of from 1 to 20 ppm;

limiting the content of said aluminum in said zinc dip-plating bath within a range of from 0.05 to 0.30 wt. %; and limiting said prescribed temperature in said alloying treatment within a range of from 480° to 600° C.

8. A method for manufacturing an alloying-treated iron-zinc alloy dip-plated steel sheet excellent in press-formability, which comprises the steps of:

subjecting a hot-rolled steel sheet to a cold-rolling treatment to prepare a cold-rolled steel sheet;

passing said cold-rolled steel sheet through a zinc dip-plating bath having a chemical composition comprising zinc, aluminum and incidental impurities to apply a zinc dip-plating treatment to said cold-rolled steel sheet, thereby forming a zinc dip-plating layer on at least one surface of said cold-rolled steel sheet;

subjecting said cold-rolled steel sheet having said zinc dip-plating layer thus formed on the surface thereof to an alloying treatment at a prescribed temperature, thereby forming an alloying-treated iron-zinc alloy dip-plating layer on at least one surface of said cold-rolled steel sheet, said alloying-treated iron-zinc alloy dip-plating layer having numerous fine concavities; and then subjecting said cold-rolled steel sheet having said alloying-treated iron-zinc alloy dip-plating layer having said numerous fine concavities thus formed on the surface thereof to a temper-rolling, thereby manufacturing an alloying-treated iron-zinc alloy dip-plated steel sheet excellent in press-formability;

characterized by:

limiting the content of said aluminum in said zinc dip-plating bath within a range of from 0.10 to 0.25 wt. %; and carrying out said alloying treatment at a temperature T(°C.) satisfying the following formula:

$$440+400\times[\text{Al wt. \%}]\leqq T\leqq 500+400\times[\text{Al wt. \%}]$$

where, [Al wt. %] is the aluminum content in said zinc dip-plating bath.

9. A method as claimed in any one of claims 6 to 8, wherein:

said cold-rolling treatment is carried out using, at least at a final roll stand in a cold-rolling mill, rolls of which a surface profile is adjusted so that a center-line mean roughness (Ra) is within a range of from 0.1 to 0.8 μm, and an integral value of amplitude spectra in a wavelength region of from 100 to 2,000 μm, which amplitude spectra are obtained through the Fourier transformation of a profile curve of said cold-rolled steel sheet after said cold-rolling treatment, is up to 200 $\mu m^3$.

10. A method as claimed in any one of claims 6 to 8, wherein:

said cold-rolling treatment is carried out using, at least at a final roll stand in a cold-rolling mill, rolls of which a surface profile is adjusted so that a center-line mean roughness (Ra) is within a range of from 0.1 to 0.8 μm, and an integral value of amplitude spectra in a wavelength region of from 100 to 2,000 μm, which amplitude spectra are obtained through the Fourier transformation of a profile curve of said cold-rolled steel sheet after said cold-rolling treatment, is up to 500 $\mu m^3$; and said temper-rolling treatment is carried out at an elongation rate within a range of from 0.3 to 5.0%, using rolls of which a surface profile is adjusted so that a center-line mean roughness (Ra) is up to 0.5 μm, and an integral value of amplitude spectra in a wavelength region of from 100 to 2,000 μm, which amplitude spectra are obtained through the Fourier transformation of a profile curve of said alloying-treated iron-zinc alloy dip-plated steel sheet after said temper-rolling treatment, is up to 200 $\mu m^3$.

11. A method as claimed in claim 6 or 7, wherein:

said prescribed temperature in said alloying treatment is limited within a range of from 480° to 540° C.

* * * * *